US008647172B2

(12) United States Patent
Duescher

(10) Patent No.: US 8,647,172 B2
(45) Date of Patent: Feb. 11, 2014

(54) WAFER PADS FOR FIXED-SPINDLE FLOATING-PLATEN LAPPING

(76) Inventor: Wayne O. Duescher, Roseville, MN (US)

( * ) Notice: Subject to any disclaimer, the term of this patent is extended or adjusted under 35 U.S.C. 154(b) by 220 days.

(21) Appl. No.: 13/417,485

(22) Filed: Mar. 12, 2012

(65) Prior Publication Data

US 2012/0270478 A1 Oct. 25, 2012

Related U.S. Application Data

(63) Continuation-in-part of application No. 13/370,246, filed on Feb. 9, 2012, which is a continuation-in-part of application No. 13/351,415, filed on Jan. 17, 2012, which is a continuation-in-part of application No. 13/280,983, filed on Oct. 25, 2011, which is a continuation-in-part of application No. 13/267,305, filed on Oct. 6, 2011, which is a continuation-in-part of application No. 13/207,871, filed on Aug. 11, 2011, now Pat. No. 8,328,600, which is a continuation-in-part of application No. 12/807,802, filed on Sep. 14, 2010, now Pat. No. 8,500,515, which is a continuation-in-part of application No. 12/799,841, filed on May 3, 2010, now Pat. No. 8,602,842, which is a continuation-in-part of application No. 12/661,212, filed on Mar. 12, 2010.

(51) Int. Cl.
*B24B 7/22* (2006.01)

(52) U.S. Cl.
CPC .. *B24B 7/22* (2013.01); *B24B 7/228* (2013.01)
USPC ..... 451/11; 451/5; 451/288

(58) Field of Classification Search
CPC ..... B24B 7/22; B24B 37/10; B24B 37/107
USPC ..... 451/5, 11, 28, 36, 37, 41, 59, 64, 259, 451/260, 270, 271, 280, 283, 285, 288, 287
See application file for complete search history.

(56) References Cited

U.S. PATENT DOCUMENTS

| | | | |
|---|---|---|---|
| 4,593,495 | A | 6/1986 | Kawakami et al. |
| 4,918,870 | A | 4/1990 | Torbert et al. |
| 5,014,468 | A | 5/1991 | Ravipati et al. |
| 5,205,082 | A | 4/1993 | Shendon et al. |
| 5,314,513 | A | 5/1994 | Miller et al. |
| 5,364,655 | A | 11/1994 | Nakamura et al. |
| 5,569,062 | A | 10/1996 | Karlsrud |
| 5,643,067 | A | 7/1997 | Katsuoka et al. |

(Continued)

*Primary Examiner* — Robert Rose
(74) *Attorney, Agent, or Firm* — Mark A. Litman & Associates, P.A.

(57) ABSTRACT

Three rotary wafer abrasive lapping spindles having attached wafers are mounted on the flat surface of a granite lapping machine base. A flexible raised island abrasive disk is attached to the annular abrading surface of an abrading platen that is rotated at high speeds to flat lap, or polish, the exposed surfaces of the rotating wafers. Resilient wafer pads are used to minimize the effects of the abraded surfaces of the wafers not being precisely parallel to the platen abrading surface due to misalignment of the spindle tops. The resilient pads also compensate for two opposed flat surfaces of wafers not precisely parallel with each other. A mixture of the same types of chemicals that are used in the conventional CMP polishing of wafers with applied coolant water can be used with this abrasive lapping or polishing system to enhance abrading and to continually wash abrading debris from the wafers.

20 Claims, 23 Drawing Sheets

(56) References Cited

U.S. PATENT DOCUMENTS

| | | | | |
|---|---|---|---|---|
| 5,769,697 | A | 6/1998 | Nishio | |
| 5,800,254 | A | 9/1998 | Motley et al. | |
| 5,863,306 | A | 1/1999 | Wei et al. | |
| 5,910,041 | A | 6/1999 | Duescher | |
| 5,916,009 | A | 6/1999 | Izumi et al. | |
| 5,964,651 | A | 10/1999 | Hose | |
| 5,967,882 | A | 10/1999 | Duescher | |
| 5,975,997 | A | 11/1999 | Minami | |
| 5,989,104 | A | 11/1999 | Kim et al. | |
| 5,993,298 | A | 11/1999 | Duescher | |
| 6,001,008 | A | 12/1999 | Fujimori et al. | |
| 6,048,254 | A | 4/2000 | Duescher | |
| 6,077,153 | A * | 6/2000 | Fujita et al. | 451/259 |
| 6,089,959 | A | 7/2000 | Nagahashi | |
| 6,102,777 | A | 8/2000 | Duescher et al. | |
| 6,120,352 | A | 9/2000 | Duescher | |
| 6,149,506 | A | 11/2000 | Duescher | |
| 6,165,056 | A | 12/2000 | Hayashi et al. | |
| 6,168,506 | B1 | 1/2001 | McJunken | |
| 6,217,433 | B1 | 4/2001 | Herrman et al. | |
| 6,371,838 | B1 | 4/2002 | Holzapfel | |
| 6,398,906 | B1 | 6/2002 | Kobayashi et al. | |
| 6,425,809 | B1 * | 7/2002 | Ichimura | 451/287 |
| 6,439,965 | B1 | 8/2002 | Ichino et al. | |
| 6,506,105 | B1 | 1/2003 | Kajiwara et al. | |
| 6,607,157 | B1 | 8/2003 | Duescher | |
| 6,752,700 | B2 | 6/2004 | Duescher | |
| 6,769,969 | B1 * | 8/2004 | Duescher | 451/59 |
| 6,786,810 | B2 | 9/2004 | Muilenburg et al. | |
| 6,893,332 | B2 | 5/2005 | Castor | |
| 6,896,584 | B2 | 5/2005 | Perlov et al. | |
| 6,899,603 | B2 | 5/2005 | Homma et al. | |
| 6,935,013 | B1 | 8/2005 | Markevitch et al. | |
| 7,001,251 | B2 | 2/2006 | Doan et al. | |
| 7,008,303 | B2 | 3/2006 | White et al. | |
| 7,014,535 | B2 | 3/2006 | Custer et al. | |
| 7,029,380 | B2 | 4/2006 | Horiguchi et al. | |
| 7,033,251 | B2 | 4/2006 | Elledge | |
| 7,044,838 | B2 | 5/2006 | Maloney et al. | |
| 7,125,313 | B2 | 10/2006 | Zelenski et al. | |
| 7,144,304 | B2 | 12/2006 | Moore | |
| 7,147,541 | B2 | 12/2006 | Nagayama et al. | |
| 7,166,016 | B1 | 1/2007 | Chen | |
| 7,250,368 | B2 | 7/2007 | Kida et al. | |
| 7,276,446 | B2 | 10/2007 | Robinson et al. | |
| 7,357,699 | B2 | 4/2008 | Togawa et al. | |
| 7,367,867 | B2 | 5/2008 | Boller | |
| 7,393,790 | B2 | 7/2008 | Britt et al. | |
| 7,422,634 | B2 | 9/2008 | Powell et al. | |
| 7,446,018 | B2 | 11/2008 | Brogan et al. | |
| 7,456,106 | B2 | 11/2008 | Koyata et al. | |
| 7,470,169 | B2 | 12/2008 | Taniguchi et al. | |
| 7,491,342 | B2 | 2/2009 | Kamiyama et al. | |
| 7,507,148 | B2 | 3/2009 | Kitahashi et al. | |
| 7,520,800 | B2 | 4/2009 | Duescher | |
| 7,527,722 | B2 | 5/2009 | Sharan | |
| 7,582,221 | B2 | 9/2009 | Netsu et al. | |
| 7,614,939 | B2 | 11/2009 | Tolles et al. | |
| 7,632,434 | B2 | 12/2009 | Duescher | |
| 8,062,098 | B2 | 11/2011 | Duescher | |
| 2005/0118939 | A1 | 6/2005 | Duescher | |
| 2008/0299875 | A1 | 12/2008 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |

* cited by examiner

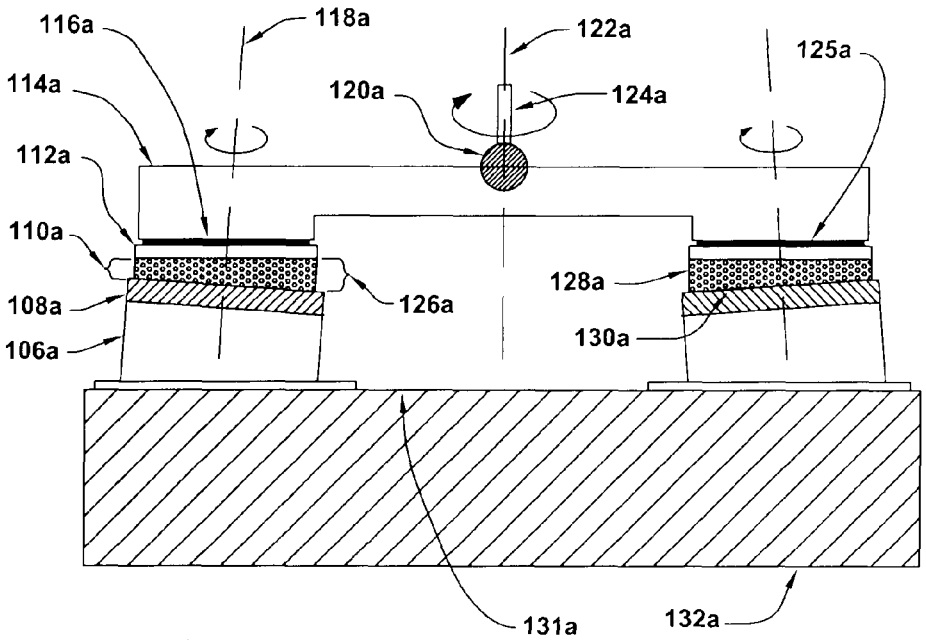
*Fig. 6.1*
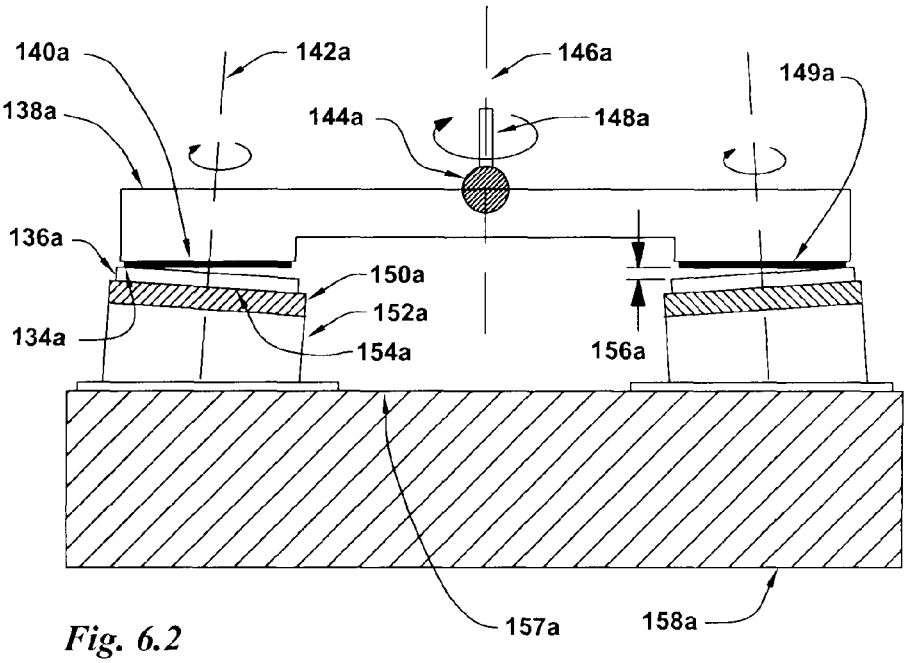
*Fig. 6.2*

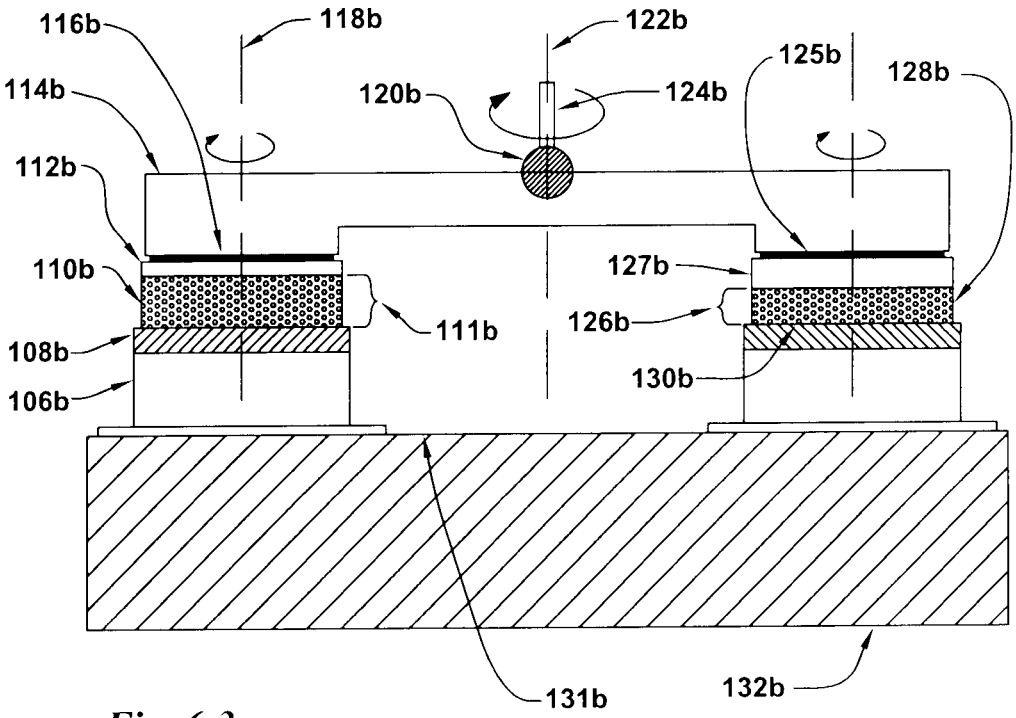
*Fig. 6.3*
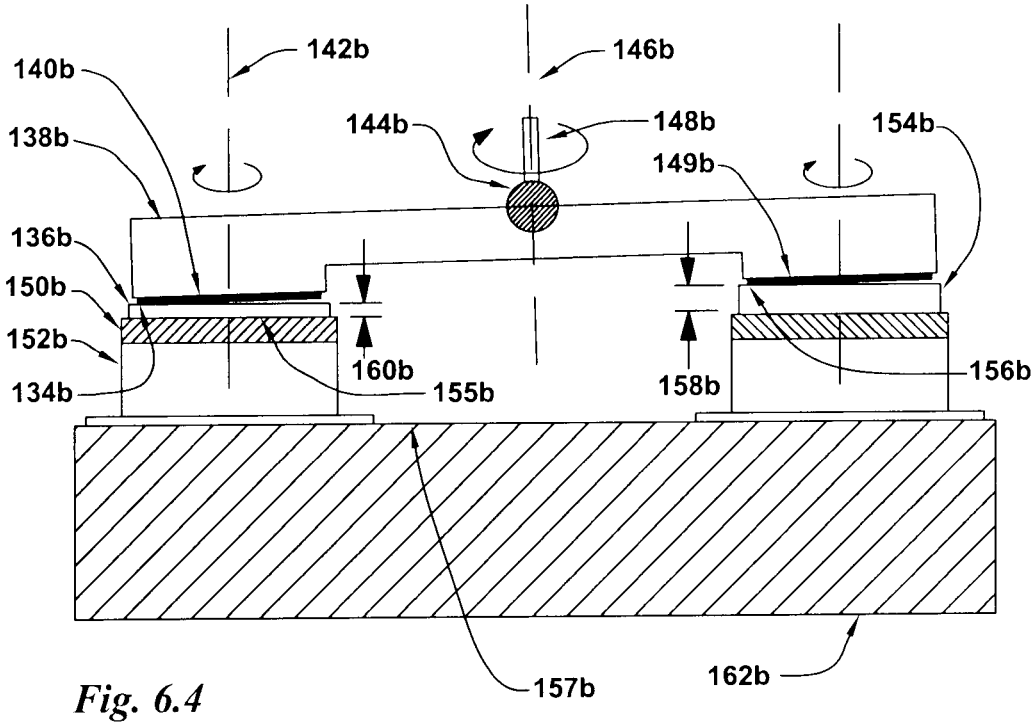
*Fig. 6.4*

WAFER PADS FOR FIXED-SPINDLE FLOATING-PLATEN LAPPING

CROSS REFERENCE TO RELATED APPLICATION

This invention is a continuation-in-part of U.S. patent application Ser. No. 13/370,246 filed Feb. 9, 2012 that is a continuation-in-part of U.S. patent application Ser. No. 13/351,415 filed Jan. 17, 2012 that is a continuation-in-part of U.S. patent application Ser. No. 13/280,983 filed Oct. 25, 2011 that is a continuation-in-part of U.S. patent application Ser. No. 13/267,305 filed Oct. 6, 2011 that discloses subject matter that is novel and unobvious over the technical field-related technology disclosed in U.S. patent application Ser. No. 13/207,871 filed Aug. 11, 2011 that is a continuation-in-part of U.S. patent application Ser. No. 12/807,802 filed Sep. 14, 2010 that is a continuation-in-part of U.S. patent application Ser. No. 12/799,841 filed May 3, 2010, which is in turn a continuation-in-part of the U.S. patent application Ser. No. 12/661,212 filed Mar. 12, 2010. These are each incorporated herein by reference in their entirety.

BACKGROUND OF THE INVENTION

1 Field of the Invention

The present invention relates to the field of abrasive treatment of surfaces such as grinding, polishing and lapping. In particular, the present invention relates to a high speed lapping system that provides simplicity, quality and efficiency to existing lapping technology using multiple floating platens.

Flat lapping of workpiece surfaces used to produce precision-flat and minor smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy liquid abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

Fixed-Spindle-Floating-Platen System

The present invention relates to methods and devices for a single-sided lapping machine that is capable of producing ultra-thin semiconductor wafer workpieces at high abrading speeds. This is done by providing a flat surfaced granite machine base that is used for mounting three individual rigid flat-surfaced rotatable workpiece spindles. Flexible abrasive disks having annular bands of fixed-abrasive coated raised islands are attached to a rigid flat-surfaced rotary platen. The platen annular abrading surface floats in three-point abrading contact with flat surfaced workpieces that are mounted on the three equal-spaced flat-surfaced rotatable workpiece spindles. Water coolant is used with these raised island abrasive disks.

Presently, floating abrasive platens are used in double-sided lapping and double-sided micro-grinding (flat-honing) but the abrading speeds of both of these systems are very low.

The upper floating platen used with these systems are positioned in conformal contact with multiple equal-thickness workpieces that are in flat contact with the flat abrading surface of a lower rotary platen. Both the upper and lower abrasive coated platens are typically concentric with each other and they are rotated independent of each other. Often the platens are rotated in opposite directions to minimize the net abrading forces that are applied to the workpieces that are sandwiched between the flat annular abrading surfaces of the two platens.

In order to compensate for the different abrading speeds that exist at the inner and outer radii of the annular band of abrasive that is present on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece rotation and is unfavorable for the other platen that rotates in a direction that opposes the workpiece rotation direction. Here, the speed differential provided by the rotated workpiece acts against the abrading speed of the opposed rotation direction platen. Because the localized abrading speed represents the net speed difference between the workpieces and the platen, rotating them in opposite directions increases the localized abrading speeds to where it is too fast. Providing double-sided abrading where the upper and lower platens are rotated in opposed directions results over-speeding of the abrasive on one surface of a workpiece compared to an optimum abrading speed on the opposed workpiece surface.

In double-sided abrading, rotation of the workpieces is typically done with thin gear-driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net workpiece abrading force is applied to the fragile disk-type workholders. It is not practical to abrade very thin workpieces with double-sided platen abrasive systems because the required very thin planetary workholder disks are so fragile.

Multiple workpieces are often abrasive slurry lapped using flat-surfaced single-sided platens that are coated with a layer of loose abrasive particles that are in a liquid mixture. Slurry lapping is very slow, and also, very messy.

The platen slurry abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving annular abrasive surface to re-establish the planar flatness of the platen annular band of abrasive.

In single-sided slurry lapping, a rigid rotating platen has a coating of abrasive in an annular band on its planar surface. Floating-type spherical-action workholder spindles hold individual workpieces in flat-surfaced abrading contact with the moving platen slurry abrasive with controlled abrading pressure.

The fixed-spindle-floating-platen abrading system has many unique features that allow it to provide flat-lapped precision-flat and smoothly-polished thin workpieces at very high abrading speeds. Here, the top flat surfaces of the individual spindles are aligned in a common plane where the flat surface of each spindle top is co-planar with each other. Each of the three rigid spindles is positioned with approximately equal spacing between them to form a triangle of spindles that provide three-point support of the rotary abrading platen. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all three rotating workpieces to perform single-sided abrading on the exposed surfaces of the workpieces. The fixed-spindle-floating platen system can be used at high abrading speeds with water cooling to produce precision-flat and mirror-smooth workpieces at very high production rates. There is no abrasive wear of the platen surface because it is protected by the attached flexible abrasive disks. Use of abrasive disks that have annular bands of abrasive coated raised islands prevents the common problem of hydroplaning of workpieces when contacting coolant water-wetted continuous-abrasive coatings. Hydroplaning of workpieces causes non-flat workpiece surfaces.

This fixed-spindle-floating-platen system is particularly suited for flat-lapping large diameter semiconductor wafers. High-value large-sized workpieces such as 12 inch diameter (300 mm) semiconductor wafers can be attached with vacuum or by other means to ultra-precise flat-surfaced air bearing spindles for precision lapping of the wafers. Commercially available abrading machine components can be easily assembled to construct these lapper machines. Ultra-precise 12 inch diameter air bearing spindles can provide flat rotary mounting surfaces for flat wafer workpieces. These spindles typically provide spindle top flatness accuracy of 5 millionths of an inch (0.13 micron) (or less, if desired) during rotation. They are also very stiff for resisting abrading load deflections and can support loads of 900 lbs. A typical air bearing spindle having a stiffness of 4,000,000 lbs/inch is more resistant to deflections from abrading forces than a mechanical spindle having steel roller bearings.

Air bearing workpiece spindles can be replaced or extra units added as needed. These air bearing spindles are preferred because of their precision flatness of the spindle surfaces at all abrading speeds and their friction-free rotation. Commercial 12 inch (300 mm) diameter air bearing spindles that are suitable for high speed flat lapping are available from Nelson Air Corp, Milford, N.H. Air bearing spindles are preferred for high speed flat lapping but suitable rotary flat-surfaced spindles having conventional roller bearings can also be used.

Thick-section granite bases that have the required surface flatness accuracy, structural stiffness and dimensional stability to support these heavy air bearing spindles without distortion are also commercially available from numerous sources. Fluid passageways can be provided within the granite bases to allow the circulation of heat transfer fluids that thermally stabilize the bases. This machine base temperature control system provides long-term dimensional stability of the precision-flat granite bases and isolates them from changes in the ambient temperature changes in a production facility. Floating platens having precision-flat planar annular abrading surfaces can also be fabricated or readily purchased.

The flexible abrasive disks that are attached to the platen annular abrading surfaces typically have annular bands of fixed-abrasive coated rigid raised-island structures. There is insignificant elastic distortion of the individual raised islands through the thickness of the raised island structures or elastic distortion of the complete thickness of the raised island abrasive disks when they are subjected to typical abrading pressures. These abrasive disks must also be precisely uniform in thickness across the full annular abrading surface of the disk. This is necessary to assure that uniform abrading takes place over the full flat surface of the workpieces that are attached onto the top surfaces of each of the three spindles. The term "precisely" as used herein refers to within ±5 wavelengths planarity and within ±0.01 degrees of perpendicular or parallel, and precisely coplanar means within ±0.01 degrees of parallel, thickness or flatness variations of less than 0.0001 inches (3 microns) and with a standard deviation between planes that does not exceed ±20 microns.

During an abrading or lapping procedure, both the workpieces and the abrasive platens are rotated simultaneously. Once a floating platen "assumes" a position as it rests conformably upon workpieces attached to the spindle tops and the platen is supported by the three spindles, the planar abrasive surface of the platen retains this nominal platen alignment even as the floating platen is rotated. The three-point spindles are located with approximately equal spacing between them circumferentially around the platen and their rotational centers are in alignment with the radial centerline of the platen annular abrading surface. A controlled abrading pressure is applied by the abrasive platen to the equal-thickness workpieces that are attached to the three rotary workpiece spindles. Due to the evenly-spaced three-point support of the floating platen, the equal-sized workpieces attached to the spindle tops experience the same shared platen-imposed abrading forces and abrading pressures. Here, precision-flat and smoothly polished semiconductor wafer surfaces can be simultaneously produced at all three spindle stations by the fixed-spindle-floating platen abrading system.

Because the floating-platen and fixed-spindle abrading system is a single-sided process, very thin workpieces such as semiconductor wafers or flat-surfaced solar panels can be attached to the rotatable spindle tops by vacuum or other attachment means. To provide abrading of the opposite side of a workpiece, it is removed from the spindle, flipped over and abraded with the floating platen. This is a simple two-step procedure. Here, the rotating spindles provide a workpiece surface that is precisely co-planar with the opposed workpiece surface.

The spindles and the platens can be rotated at very high speeds, particularly with the use of precision-thickness raised-island abrasive disks. These abrading speeds can exceed 10,000 surface feet per minute (SFPM) or 3,048 surface meters per minute. The abrading pressures used here for flat lapping are very low because of the extraordinary high material removal rates of superabrasives (including diamond or cubic boron nitride (CBN)) when operated at very high abrading speeds. The abrading pressures are often less than 1 pound per square inch (0.07 kilogram per square cm) which is a small fraction of the abrading pressures commonly used in abrading. Flat honing (micro-grinding) uses extremely high abrading pressures which can result in substantial sub-surface damage of high value workpieces. The low abrading pressures used here result in highly desired low subsurface damage. In addition, low abrading pressures result in lapper machines that have considerably less weight and bulk than conventional abrading machines.

Use of a platen vacuum disk attachment system allows quick set-up changes where abrasive disks having different sizes of abrasive particles and different types of abrasive material can be quickly attached to the flat platen annular abrading surfaces. Changing the sized of the abrasive particles on all of the other abrading systems is slow and tedious. Also, the use of messy loose-abrasive slurries is avoided by using the fixed-abrasive disks.

A minimum of three evenly-spaced spindles are used to obtain the three-point support of the upper floating platen by contacting the spaced workpieces. However, additional spindles can be mounted between any two of the three spindles that form three-point support of the floating platen. Here all of the workpieces attached to the spindle-tops are in mutual flat abrading contact with the rotating platen abrasive.

The system has the capability to resist large mechanical abrading forces that can be present with abrading processes while maintaining unprecedented rotatable workpiece spindle tops flatness accuracies and minimum mechanical flatness out-of-planar variations, even at very high abrading speeds. There is no abrasive wear of the flat surfaces of the spindle tops because the workpieces are firmly attached to the spindle tops and there is no motion of the workpieces relative to the spindle tops. Rotary abrading platens are inherently robust, structurally stiff and resistant to deflections and surface flatness distortions when they are subjected to substantial abrading forces. Because the system is comprised of robust components, it has a long production usage lifetime with little maintenance even in the harsh abrading environment present with most abrading processes. Air bearing spindles are not prone to failure or degradation and provide a flexible system that is quickly adapted to different polishing processes. Drip shields can be attached to the air bearing spindles to prevent abrasive debris from contaminating the spindle.

All of the precision-flat abrading processes presently in commercial lapping use typically have very slow abrading speeds of about 5 mph (8 kph). By comparison, the high speed flat lapping system operates at or above 100 mph (160 kph). This is a speed difference ratio of 20 to 1. Increasing abrading speeds increase the material removal rates. High abrading speeds result in high workpiece production rates and large cost savings.

Workpieces are often rotated at rotational speeds that are approximately equal to the rotational speeds of the platens to provide approximately equal localized abrading speeds across the full radial width of the platen abrasive when the workpiece spindles are rotated in the same rotation direction as the platens.

Unlike slurry lapping, there is no abrasive wear of raised island abrasive disk platens because only the non-abrasive flexible disk backing surface contacts the platen surface. Here, the abrasive disk is firmly attached to the platen flat annular abrading surface. Also, the precision flatness of the high speed flat lapper abrasive surfaces can be completely re-established by simply and quickly replacing an abrasive disk having a non-flat abrasive surface with another abrasive disk that has a precision-flat abrasive surface.

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Abrasive disk and floating platens can have a wide range of abrading surface diameters that range from 2 inches (5 cm) to 72 inches (183 cm) or even much greater diameters. Abrasive disks that have non-island continuous coatings of abrasive material can also be used on the fixed-spindle floating-platen abrading system.

Hydroplaning of workpieces occurs when smooth abrasive surfaces, having a continuous thin-coated abrasive, are in fast-moving contact with a flat workpiece surface in the presence of surface water. However, hydroplaning does not occur when interrupted-surfaces, such as abrasive coated raised islands, contact a flat water-wetted workpiece surface. An analogy to the use of raised islands in the presence of coolant water films is the use of tread lugs on auto tires which are used on rain slicked roads. Tires with lugs grip the road at high speeds while bald smooth-surfaced tires hydroplane. In the same way, the abrasive coatings of the flat-surface tops of the raised islands remain in abrading contact with water-wetted flat-surfaced workpieces, even at very high abrading speeds.

A uniform thermal expansion and contraction of air bearing spindles occurs on all of the air bearing spindles mounted on the granite or other material machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems.

Resilient Workpiece Support Pads

Flat lapped or polished workpieces such as semiconductor wafers require extremely flat surfaces to perform their functions. Mechanical seals must be flat and smoothly polished to prevent leakage of liquids. Optical devices must also be flat and smoothly polished. When photolithography is used to deposit patterns of materials to form circuits across the full flat surface of a semiconductor wafer, the wafer surface must be flat and smoothly polished. When theses wafers are abrasively polished between deposition steps, the surfaces of the wafers must remain precisely flat. In the event, that the rotatable wafer spindles are aligned where the flat-surfaced spindle-tops are not precisely parallel to the flat annular abrading surface of the floating rotating platen, the abraded surfaces of the wafers can become non-flat during a polishing operation. Also, if the two opposed flat surfaces of wafers are not precisely parallel with each other, where the wafer abraded surfaces are not precisely parallel to the flat annular abrading surface of the floating rotating platen, the abraded surfaces of the wafers can become non-flat during a polishing operation.

Resilient wafer pads can be used to minimize the effects of the abraded surfaces of the wafers not being precisely parallel to the platen abrading surface. When the platen is lowered into abrading contact with the workpieces, the resilient pads are compressed and the wafer assumes full flat-surfaced contact with the platen abrading surface. The wafers are then abraded uniformly across the full abraded surfaces of the wafers. Typically, the misalignment of the wafers and the platen is very small, less than 0.001 inches (25 microns). The resilient wafer pads can easily compensate for misalignments of this magnitude, and larger.

Because the resilient wafer pads are used with a fixed-spindle floating-platen abrading system, liquid coolants and chemicals are applied to the wafer pads. The resilient wafer pads can be constructed from the same types of CMP pad materials that have been widely used in the semiconductor industry for many years to CMP polish wafers. However, it is important that the wafer pads are impervious to the applied coolant liquids and debris to prevent them from becoming saturated with or contaminated with liquid or debris such as abrading debris. If the pads become saturated or contaminated, the liquid or debris prevents the resilient pads form having a fast dimensional recovery after being compressed during once-around rotations of the wafer workpiece spindles. Sealants and liquid-repellant coatings can be applied to the exterior surfaces of open-celled or liquid-absorbent resilient wafer pads to provide that the wafer pads are impervious to coolant, other liquids or debris that are applied the wafer pads during lapping or polishing operations. Some pad materials can be used to construct the pads that are inherently impervious to liquids and debris such as closed-cell foam polymer materials. Also, the resilient wafer pads can be constructed from sealed and impervious compressible air bags or sealed and impervious compressible pleated air bags.

The wafer pads have the same nominal sizes as the wafer so abrasive polishing is uniform across the full surface of the wafers. Use of the same-sized wafer pads avoids the undesirable excessive abrasion at the outer flat-surfaced periphery of wafers that commonly occurs when wafers are polished using large-diameter rotating resilient abrasive slurry coated pads. In that polishing system, the stationary-position rotating wafers are thrust downward into the surface-depths of resilient moving CMP pads. Distortion of the resilient CMP pads at the periphery of the wafers causes the excessive abrading of the flat-surfaced periphery of the wafers.

This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pr3essure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallow-islands of abrasive coated on a web backing using a rotogravure roll to deposit the abrasive islands on the web backing. U.S. Pat. No. 5,314,513 (Milleret al) describes the use of ceria for abrading.

U.S. Pat. No. 6,001,801 (Fujimori et al) describes an abrasive dressing tool that is used for abrading a rotatable CMP polishing pad that is attached to a rigidly mounted lower rotatable platen.

U.S. Pat. No. 6,077,153 (Fujita et al) describes a semiconductor wafer polishing machine where a polishing pad is attached to a rigid platen that rotates. The polishing pad is positioned to contact wafer-type workpieces that are attached to rotary workpiece spindles. These rotary workpiece spindles are mounted on a rigidly-mounted rotary platen. The rotatable abrasive polishing pad platen is rigidly mounted and travels along its rotation axis. However, it does not have a floating-platen action that allows the platen to have a spherical-action motion as it rotates. Because the workpiece spindles are mounted on a rotary platen they are not attached to a stationary machine base such as a granite base. Because of the configuration of the Fujita machine, it can not be used to provide a floating abrasive coated platen that allows the flat surface of the platen abrasive to be in floating conformal abrading contact with multiple workpieces that are attached to rotary workpiece spindles that are mounted on a rigid machine base.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

Various abrading machines and abrading processes are described in U.S. Pat. Nos. 5,364,655 (Nakamura et al). 5,569,062 (Karlsrud), 5,643,067 (Katsuoka et al), 5,769,697 (Nisho), 5,800,254 (Motley et al), 5,916,009 (Izumi et al), 5,964,651 (hose), 5,975,997 (Minami, 5,989,104 (Kim et al), 6,089,959 (Nagahashi, 6,165,056 (Hayashi et al), 6,168,506 (McJunken), 6,217,433 (Herrman et al), 6,439,965 (Ichino), 6,893,332 (Castor), 6,896,584 (Perlov et al), 6,899,603 (Homma et al), 6,935,013 (Markevitch et al), 7,001,251 (Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,250,368 (Kida et al), 7,367,867 (Boller), 7,393,790 (Britt et al), 7,422,634 (Powell et al), 7,446,018 (Brogan et al), 7,456,106 (Koyata et al), 7,470,169 (Taniguchi et al), 7,491,342 (Kamiyama et al), 7,507,148 (Kitahashi et al), 7,527,722 (Sharan) and 7,582,221 (Netsu et al).

Also, various CMP machines, resilient pads, materials and processes are described in U.S. Pat. Nos. 8,101,093 (de Rege Thesauro et al.), 8,101,060 (Lee), 8,071,479 (Liu), 8,062,096 (Brusic et al.), 8,047,899 (Chen et al.), 8,043,140 (Fujita), 8,025,813 (Liu et al.), 8,002,860 (Koyama et al.), 7,972,396 (Feng et al.), 7,955,964 (Wu et al.), 7,922,783 (Sakurai et al.), 7,897,250 (Iwase et al.), 7,884,020 (Hirabayashi et al.), 7,840,305 (Behr et al.), 7,838,482 (Fukasawa et al.), 7,837,800 (Fukasawa et al.), 7,833,907 (Anderson et al.), 7,822,500 (Kobayashi et al.), 7,807,252 (Hendron et al.), 7,762,870 (Ono et al.), 7,754,611 (Chen et al.), 7,753,761 (Fujita), 7,741,656 (Nakayama et al.), 7,731,568 (Shimomura et al.), 7,708,621 (Saito), 7,699,684 (Prasad), 7,648,410 (Choi), 7,618,529 (Ameen et al.), 7,579,071 (Huh et al.), 7,572,172 (Aoyama et al.), 7,568,970 (Wang), 7,553,214 (Menk et al.), 7,520,798 (Muldowney), 7,510,974 (Li et al.), 7,491,116 (Sung), 7,488,236 (Shimomura et al.), 7,488,240 (Saito), 7,488,235 (Park et al.), 7,485,241 (Schroeder et al.), 7,485,028 (Wilkinson et al), 7,456,107 (Keleher et al.), 7,452,817 (Yoon et al.), 7,445,847 (Kulp), 7,419,910 (Minamihaba et al.), 7,018,906 (Chen et al.), 6,899,609 (Hong), 6,729,944 (Birang et al.), 6,672,949 (Chopra et al.), 6,585,567 (Black et al.), 6,270,392 (Hayashi et al.), 6,165,056 (Hayashi et al.), 6,116,993 (Tanaka), 6,074,277 (Arai), 6,027,398 (Numoto et al.), 5,985,093 (Chen), 5,944,583 (Cruz et al.), 5,874,318 (Baker et al.), 5,683,289 (Hempel Jr.), 5,643,053 (Shendon),), 5,597,346 (Hempel Jr.).

SUMMARY OF THE INVENTION

The presently disclosed technology includes a fixed-spindle, floating-platen system which is a new configuration of a single-sided lapping machine system. This system is capable of producing ultra-flat thin semiconductor wafer workpieces at high abrading speeds. This can be done by providing a precision-flat, rigid (e.g., synthetic, composite or granite) machine base that is used as the planar mounting surface for at least three rigid flat-surfaced rotatable workpiece spindles. Precision-thickness flexible abrasive disks are attached to a rigid flat-surfaced rotary platen that floats in three-point abrading contact with the three equal-spaced flat-surfaced rotatable workpiece spindles. These abrasive coated raised island disks have disk thickness variations of less than 0.0001 inches (3 microns) across the full annular bands of abrasive-coated raised islands to allow flat-surfaced contact with workpieces at very high abrading speeds and to assure that all of the expensive diamond abrasive particles that are coated on the island are fully utilized during the abrading process. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

The fixed-spindle floating-platen flat lapping system has two primary planar references. One planar reference is the precision-flat annular abrading surface of the rotatable floating platen. The other planar reference is the precision co-planar alignment of the flat surfaces of the rotary spindle tops of the three workpiece spindles that provide three-point support of the floating platen.

Flat surfaced workpieces are attached to the spindle tops and are contacted by the abrasive coating on the platen abrading surface. Both the workpiece spindles and the abrasive coated platens are simultaneously rotated while the platen abrasive is in controlled abrading pressure contact with the exposed surfaces of the workpieces. Workpieces are sandwiched between the spindle tops and the floating platen. This lapping process is a single-sided workpiece abrading process. The opposite surfaces of the workpieces can be lapped by removing the workpieces from the spindle tops, flipping them over, attaching them to the spindle tops and abrading the second opposed workpiece surfaces with the platen abrasive.

A granite machine base provides a dimensionally stable platform upon which the three (or more) workpiece spindles are mounted. The spindles must be mounted where their spindle tops are precisely co-planar within 0.0001 inches (3 microns) in order to successfully perform high speed flat lapping. The rotary workpiece spindles must provide rotary spindle tops that remain precisely flat at all operating speeds. Also, the spindles must be structurally stiff to avoid deflections in reaction to static or dynamic abrading forces.

Air bearing spindles are the preferred choice over roller bearing spindles for high speed flat lapping. They are extremely stiff, can be operated at very high rotational speeds and are frictionless. Because the air bearing spindles have no friction, torque feedback signal data from the internal or external spindle drive motors can be used to determine the state-of-finish of lapped workpieces. Here, as workpieces become flatter and smoother, the water wetted adhesive bonding stiction between the flat surfaced workpieces and the flat-type abrasive media increase. The relationship between the state-of-finish of the workpieces and the adhesive stiction is a very predictable characteristic and can be readily used to control or terminate the flat lapping process.

Air bearing or mechanical roller bearing workpiece spindles having near-equal spindle heights can be mounted on flat granite bases to provide a system where the flat spindle tops are co-planar with each other. These precision-height spindles and precision flat granite bases are more expensive than commodity type spindles and granite bases. Commodity type air bearing spindles and non-precision flat granite bases can be utilized with the use of adjustable height legs that are attached to the bodies of the spindles.

An alternative method that can be used to attach rotary workpiece spindles to granite bases is to provide spherical-action mounts for each spindle. These spherical mounts allow each spindle top to be aligned to be co-planar with the other attached spindles. Workpiece spindles are attached to the rotor portion of the spherical mount that has a spherical-action rotation within a spherical base that has a matching spherical shaped contacting area. The spherical-action base is attached to the flat surface of a granite machine base. After the spindle tops are precisely aligned to be co-planar with each other, a mechanical or adhesive-based fastener device can be used to fixture or lock the spherical mount rotor to the spherical mount base. Using these spherical-action mounts, the precision aligned workpiece spindles are structurally attached to the granite base. The flat surfaces of the spindle tops can be aligned to be precisely co-planar within the required 0.0001 inches (3 microns) with the use of various leaser beam measurement devices and various alignment techniques For typical air bearing spindles used as a rotary alignment spindle, the out-of-plane variations of the spindle-top flat surfaces are less than 5 millionths of an inches during rotation as measured relative to a selected point or selected points that are external to the alignment spindle body. The planar accuracy of the air bearing alignment rotary spindle is more than sufficient to provide co-planar alignment of the workpiece spindle-tops to within the desired 0.0001 inches using the laser measurement devices that are attached to the laser arm. These air bearing spindles are also very stiff in resisting applied force load deflections. The same air bearing rotary spindles that are used for workpieces can also be used as a rotary alignment spindle. Also, specialty small-sized, light-weight, low-profile or non-driven air bearing rotary spindles can be used as rotary alignment spindles.

Semiconductor wafers require extremely flat surfaces when using photolithography to deposit patterns of materials to form circuits across the full flat surface of a wafer. When theses wafers are abrasively polished between deposition steps, the surfaces of the wafers must remain precisely flat. In the event, that the rotatable wafer spindles are aligned where the flat-surfaced spindle-tops are not precisely parallel to the flat annular abrading surface of the floating rotating platen, the abraded surfaces of the wafers can become non-flat during a polishing operation. Also, if the two opposed flat surfaces of wafers are not precisely parallel with each other, where the wafer abraded surfaces are not precisely parallel to the flat annular abrading surface of the floating rotating platen, the abraded surfaces of the wafers can become non-flat during a polishing operation.

Resilient wafer pads can be used to minimize the effects of the abraded surfaces of the wafers not being precisely parallel to the platen abrading surface. When the platen is lowered into abrading contact with the workpieces, the resilient pads are compressed and the wafer assumes full flat-surfaced contact with the platen abrading surface. The wafers are then abraded uniformly across the full abraded surfaces of the wafers. Typically, the misalignment of the wafers and the platen is very small, less than 0.001 inches (25 microns). The resilient wafer pads can easily compensate for misalignments of this magnitude, and larger.

Because the resilient wafer pads are used with a fixed-spindle floating-platen abrading system, liquid coolants and chemicals are applied to the wafer pads. The resilient wafer pads can be constructed from the same types of CMP pad materials that have been widely used in the semiconductor industry for many years to CMP polish wafers. However, it is important that the wafer pads are impervious to the applied coolant liquids, liquid chemicals and abrading debris to prevent them from becoming saturated with liquid or debris. If the pads become saturated, the liquid and debris prevents the resilient pads form having a fast dimensional recovery after being compressed during once-around rotations of the wafer workpiece spindles. Sealants and liquid-repellant coatings can be applied to the exterior surfaces of open-celled or liquid-absorbent resilient wafer pads to provide that the wafer pads are impervious to coolants, other liquids and abrading debris that are applied the wafer pads during lapping or polishing operations. Some pad materials can be used to construct the pads that are inherently impervious to liquids and abrading debris such as closed-cell foam polymer materials. Also, the resilient wafer pads can be constructed from sealed and impervious compressible air bags or sealed and impervious compressible pleated air bags.

The wafer pads have the same nominal sizes as the wafer so abrasive polishing is uniform across the full surface of the wafers. Use of the same-sized wafer pads avoids the undesirable excessive abrasion at the outer flat-surfaced periphery of wafers that commonly occurs when wafers are polished using large-diameter rotating resilient abrasive slurry coated pads. In that polishing system, the stationary-position rotating wafers are thrust downward into the surface-depths of resilient moving CMP pads. Distortion of the resilient CMP pads at the periphery of the wafers causes the excessive abrading of the flat-surfaced periphery of the wafers.

The same types of chemicals that are used in the conventional CMP polishing of wafers can be used with this abrasive lapping or polishing system. These liquid chemicals can be applied as a mixture with the coolant water that is used to cool both the wafers and the fixed abrasive coatings on the rotating abrading platen This mixture of coolant water and chemicals continually washes the abrading debris away from the abrading surfaces of the fixed-abrasive coated raised islands which prevents unwanted abrading contact of the abrasive debris with the abraded surfaces of the wafers.

BRIEF DESCRIPTION OF THE DRAWING

FIG. 6.1 is a cross section view of tilt-angled workpiece spindles supporting a platen.

FIG. 6.2 is a cross section view of tilt-angled spindles supporting a floating abrasive platen.

FIG. 6.3 is a cross section view of spindles with different-thickness workpieces.

FIG. 6.4 is a cross section view of spindles with different-thickness workpieces and a platen.

DETAILED DESCRIPTION OF THE INVENTION

Figure 1:
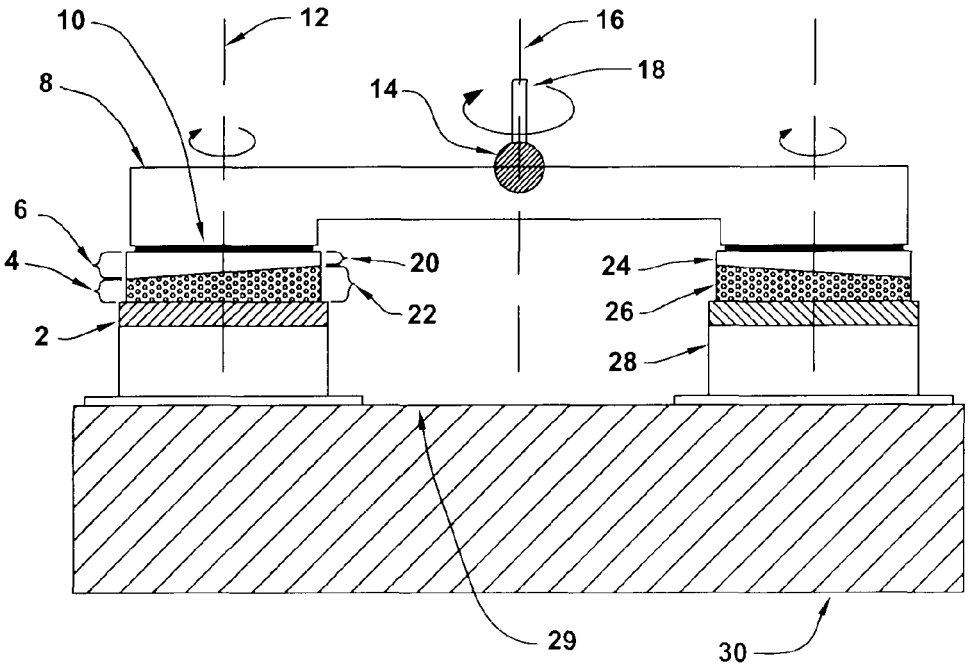
FIG. 1 is a cross section view of spindles supporting a rotating floating abrasive platen.

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping. Also, the lapping machines must be robust to resist abrading forces without distortion of the machine members in a way that affects the flatness of the workpieces. Further, the machine must be light in weight, easy to use and tolerant of the harsh abrasive environment.

Pivot-Balance Floating-Platen Machine

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping.

Also, the lapping machines must be robust to resist abrading forces without distortion of the machine members in a way that affects the flatness of the workpieces. Further, the machine must be light in weight, easy to use and tolerant of the harsh abrasive environment The pivot-balance floating-platen lapping machine provides these desirable features. The lapper machine components such as the platen drive motor are used to counterbalance the weight of the abrasive platen assembly. Low friction pivot bearings are used. The whole pivot frame can be raised or lowered from a machine base by an electric motor driven screw jack. Zero-friction air bearing cylinders can be used to apply the desired abrading forces to the platen as it is held in 3-point abrading contact with the workpieces attached to rotary spindles.

The air pressure applied to the air cylinder is typically provide by a I/P (electrical current-to-pressure) pressure regulator that is activated by an abrading process controller. The actual force generated by the air cylinder can be sensed and verified by an electronic force sensor load cell that is attached to the piston end of the air cylinder. The force sensor allows feed-back type closed-loop control of the abrading pressure that is applied to the workpieces. Abrading pressures on the workpieces can be precisely changed throughout the lapping operation by the lapping process controller.

The spindles are attached to a dimensionally stable granite base. Spherical bearings allow the platen to freely float during the lapping operation. A right-angle gear box has a hollow drive shaft to provide vacuum to attach raised island abrasive disks to the platen. A set of two constant velocity universal joints attached to drive shafts allow the spherical motion of the rotating platen.

When the pivot balance is adjusted where the weight of the drive motor and hardware equals the weight of the platen and its hardware, then the pivot balance frame has a "tared" or "zero" balance condition. To accomplish this, a counterbalance weight can be moved along the pivot balance frame. Also, weighted mechanical screw devices can be easily adjusted to provide a true balance condition. Use of frictionless air bearings at the rotational axis of the pivot frame allows this precision balancing to take place.

Co-Planar Aligned Workpiece Spindles

FIG. 1 is a cross section view of three-point fixed-position spindles supporting a rotating floating abrasive platen with non-uniform-thickness flat-surfaced wafers. Three semiconductor wafer workpiece 24 spindles 28 (one not shown) having rotatable spindle-tops 2 that have flat top surfaces are mounted to the top flat surface 29 of a machine base 30 that is constructed from granite, metal or composite materials or other materials. The workpiece 24 spindles 28 are preferred to be air bearing spindles 28 but can be roller bearing spindles 28. The flat top surfaces of the spindles' 28 spindle-tops are all in a common plane is nominally parallel with the top flat surface 29 of the machine base 30.

Non-uniform-thickness flat-surfaced wafer workpieces 24 or non-wafer workpieces are attached to resilient wafer pads 26 that are attached to the spindles 28 spindle-tops 2 top flat surfaces by vacuum, adhesives, low-tack adhesives, adhesives, low-tack adhesives, mechanical fastener, electro-static, liquid surface tension, or other, wafer pad 26 attachment devices. The workpieces 24 can be attached to the resilient wafer pads 26 by vacuum, adhesives, low-tack adhesives, adhesives, low-tack adhesives, mechanical fastener, electrostatic, liquid surface tension, or other, wafer pad 26 attachment devices. Here, the top surfaces of the three wafer workpieces 24 are mutually contacted by the abrading surface of an annular flexible abrasive disk 10 that is attached to the precision-flat annular surface of a floating rotary platen 8.

The resilient pads 26 nominally have the same diameter as the circular wafers 24 but the resilient pads 26 can have larger or smaller diameters than the wafers 24. The resilient pads 26 can have a pad 26 non-compressed thickness that is uniform across the full flat surface of the pads 26 where the pad 26 nominal thicknesses ranges from 0.005 inches (0.0127 cm) to 0.50 inches (1.27 cm). The resilient pads 26 can be constructed from materials comprising metal materials, polymer materials, open or closed cell foamed polymer materials, synthetic or organic fiber materials and can be constructed as laminated pads 26 or constructed as composite pads 26 that are comprised of the construction materials defined here.

The resilient pads 26 can also be constructed to have non-continuous surfaces with patterns of raised sections and recessed sections or through-hole sections where the raised sections are in flat-surfaced contact with the flat surfaces of the workpieces 24. Likewise, the resilient pads 26 can also be constructed with patterns of raised sections and recessed sections or open through-hole sections where the raised sections are in flat-surfaced contact with the flat surfaces of the spindle-tops 2.

The resilient pads 26 can be used with non-circular workpieces 24 that have rectangular abraded-surface shapes, elliptical abraded-surface shapes, irregular abraded-surface shapes, incongruous or non-continuous abraded-surface shapes, or other non-circular abraded-surface shapes. The resilient pads 26 can nominally have the same flat-surfaced shape as the flat-surfaced periphery outline shapes of the abraded-surface of the workpieces 24. Also, the resilient pads 26 can have flat-surfaced shapes that are larger or smaller than the workpieces' 24 flat-surfaced abraded-surfaces The floating platen 8 flexible abrasive disk 10 attachment surface is precisely flat, preferably within 0.0001 inches (3 microns) and the precision-thickness abrasive disk 10 annular abrasive surface has a minimal thickness variation, preferably within 0.0001 inches (3 microns) and is precisely parallel with the platen 8 disk attachment surface. The floating platen 8 annular abrasive surface is nominally parallel with the flat top surfaces of each of the three independent spindle 28 spindle-top 2 flat surfaces.

The floating platen 8 is supported by the three equally-spaced spindles 28 where the flat flexible abrasive disk attachment surface of the platen 8 is nominally parallel with the top surface 29 of the machine base 30. The three equally-spaced spindles 28, of the three-point set of spindles 28, provide stable support to the floating platen 8. The rotary floating platen 8 spherical-action drive mechanism 14 restrains the platen 8 in a circular platen 8 radial direction. Also, the rotary floating platen 8 spherical-action drive mechanism 14 allows the rotary floating platen 8 to freely have spherical rotation as the flexible abrasive disk 10 that is attached to the rotary floating platen 8 assumes conformal contact with the non-uniform-thickness flat-surfaced workpieces 24 that are supported by the three spaced spindle 28 spindle-tops 2.

The spindles' 28 spindle-tops 2 are driven (not shown) in either clockwise or counterclockwise directions with rotation axes 12 while the rotating platen 8 having a support shaft 18 is also driven about a platen axis 16. Typically, the spindles' 28 spindle-tops 2 are driven in the same rotation direction as the platen 8. The workpiece spindle 28 spindle-tops 2 can be rotationally driven by motors (not shown) that are an integral part of the spindles 28 or the spindle-tops 2 can be driven by internal spindle shafts (not shown) that extend through the bottom mounting surface of the spindles 28 and into or through the granite machine base 30 or the spindles 28 can be driven by external drive belts (not shown).

The rotary workpiece spindles 28 having rotary spindle-tops 2 are mounted on at the outer periphery of a granite machine base 30. Three workpiece spindles 28 are mounted on the flat surface 29 of the machine base 30 where the rotational axes 12 of the spindle-tops 2 intersect the spindle-tops 2 rotation centers. The workpiece spindles 28 are positioned with near-equal distances between them.

The spindles 28 are preferred to be air bearing workpiece spindles 28 which typically provide spindle-top 2 flat surface flatness accuracy of 5 millionths of an inch (0.13 microns) but can have spindle-top 2 flat surface flatness accuracies of only 2 millionths of an inch (0.05 microns). These workpiece spindle 28 spindle-top 2 flatness accuracies are preferably co-planar aligned within the 0.0001 inches (3 microns) that is typically required for high speed flat lapping. The workpieces 24 are referred to here as wafers or semiconductor wafers 24 but other types of workpieces 24 such as optical workpieces, ceramic or metal sealing device workpieces 24 or fiber optic workpieces 24 can be used interchangeably with the resilient wafer pads 26 to perform lapping or polishing operations on the workpiece 24 flat surfaces.

A circular semiconductor wafer 24 is shown with non-parallel surfaces where one wafer 24 side portion has a thickness 6 that is greater than the wafer 24 other opposed side portion that has a thickness 20. The top flat surface of the wafer 24 is shown in flat conformal contact with the abrasive surface of the abrasive disk 10 while the opposed flat surface of the wafer 24 is attached to and supported by a conformable resilient wafer pad 26. The resilient wafer pad 26 has a uniform non-compressed thickness but as shown here, the wafer pad 26 is compressed where one wafer pad 26 side portion has a thickness 22 that is greater than the wafer pad 26 opposed side portion that has a thickness 4. Localized compression of the resilient wafer pad 26 allows the abraded surface of the non-uniform thickness wafer 24 to be held in flat conformal abrading contact with the abrasive disk 10 flat abrasive surface while the opposed surface of the wafer 24 is attached to and supported by the conformable wafer pad 26. The surface of the wafer pad 26 that is opposed to the surface of the wafer pad 26 that the wafer 24 is attached to and supported by the top flat surface of the spindle 28 spindle-top 2.

When the precision-flat spindle-top 2 is rotated, the wafer pad 26 retains the initially-established compressed geometry for each rotation of the spindle-top 2. Here, the wafer pad 26 becomes initially distorted when the platen 8 is lowered to provide abrading-force controlled abrading of the workpiece wafers 24. This original distortion of the wafer pad 26 is retained for each revolution of the spindle-top 2. Periodic compression and relaxation of different portions of the wafer pads 26 is not required during revolutions of the spindle-tops 2 to maintain uniform abrading pressure contact of the wafer 24 with the abrasive surface of the abrasive disk 10.

The rotation speed of the spindle-top 2 is not restrained by slow-response dynamic restoration of the original non-distorted shape of the wafer pad 26 material during each high-speed revolution of the spindle-top 2. Here, the top flat surface of the spindle-top 2 that the wafer pad 26 is attached to is precisely parallel to the annular abrading surface of the rotating platen 8. The wafer pad 26 is only distorted initially to compensate for the non-parallel flat surfaces of the workpiece wafer 24.

Figure 2:
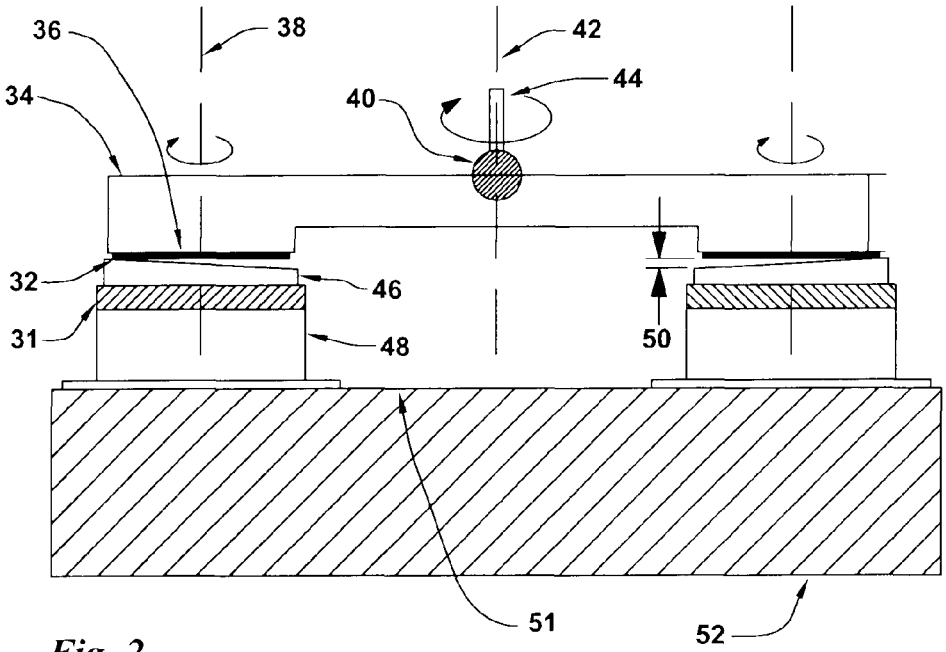
FIG. 2 is a cross section view of spindles with non-uniform-thickness wafer workpieces.

FIG. 2 is a cross section view of three-point fixed-position spindles supporting a rotating floating abrasive platen with non-uniform-thickness flat-surfaced wafer workpieces. Three semiconductor wafer workpiece 46 spindles 48 (one not shown) having rotatable spindle-tops 31 that have flat top surfaces are mounted to the top flat surface 51 of a machine base 52 that is constructed from granite, metal or composite materials or other materials. The flat top surfaces of the spindle 48 spindle-tops are all in a common plane is nominally parallel with the top flat surface 51 of the machine base 52.

Non-uniform-thickness flat-surfaced wafer workpieces 46 or non-wafer workpieces are attached directly to the spindles 48 spindle-tops 31 top flat surfaces by vacuum, adhesives, low-tack adhesives, mechanical fastener, electro-static, liquid surface tension, or other, wafer workpiece 46 attachment devices without the use of a resilient wafer pad (not shown). The top surfaces of the three wafer workpieces 46 are mutually contacted by the abrading surface of an annular flexible abrasive disk 36 that is attached to the flat annular surface of a floating rotary platen 34. The spindle-tops 31 rotate about a spindle axis 38 and the platen 34 rotates about a platen axis 42.

The floating platen 34 flexible abrasive disk 36 attachment surface is precisely flat and the precision-thickness abrasive disk 36 annular abrasive surface is precisely parallel with the platen 34 disk attachment surface. The floating platen 34 annular abrasive surface is nominally parallel with the flat top surfaces of each of the three independent spindle 48 spindle-top 31 flat surfaces.

The floating platen 34 is supported by the three equally-spaced spindles 48 where the abrasive disk 36 flat attachment surface of the platen 34 is nominally parallel with the top surface 51 of the machine base 52. The three equally-spaced spindles 48 of the three-point set of spindles 48 provide stable support to the floating rotary platen 34. The rotary floating platen 34 spherical-action drive mechanism 40 restrains the platen 34 in a circular platen 34 radial direction. The platen 34 spherical-action device mechanism 40 has a drive shaft 44 that provides rotation of the platen 34 about the axis 42. Also, the rotary floating platen 34 spherical-action drive mechanism 40 allows the rotary floating platen 34 to freely have spherical rotation as the abrasive disk 36 that is attached to the rotary floating platen 34 assumes abrading contact with the flat-surfaced workpieces 46 that are supported by the three spaced spindle 48 spindle-tops 31.

A circular semiconductor wafer 46 is shown with non-parallel surfaces where one wafer 46 side portion has a thickness that is greater than the wafer other opposed side portion where the non-parallel thickness variation of the wafer 46 is shown as the distance 50. For workpieces 46 such as semiconductor wafers, the non-flat thickness variation 50 is typically very small where the thickness variation 50 is often less than 0.001 inches (25 microns). However, due to the rigidity of the platen 34 and the rigidity of the air bearing spindle 48 and the rigidity of the air bearing spindle 48 spindle-top 31, the workpiece or wafer 46 only contacts the abrasive surface of the abrasive disk 36 at a point 32. Much of the abrading action is concentrated at this abrading contact point 32 which results in non-uniform abrading of the surface of the workpiece wafer 46.

Figure 3:
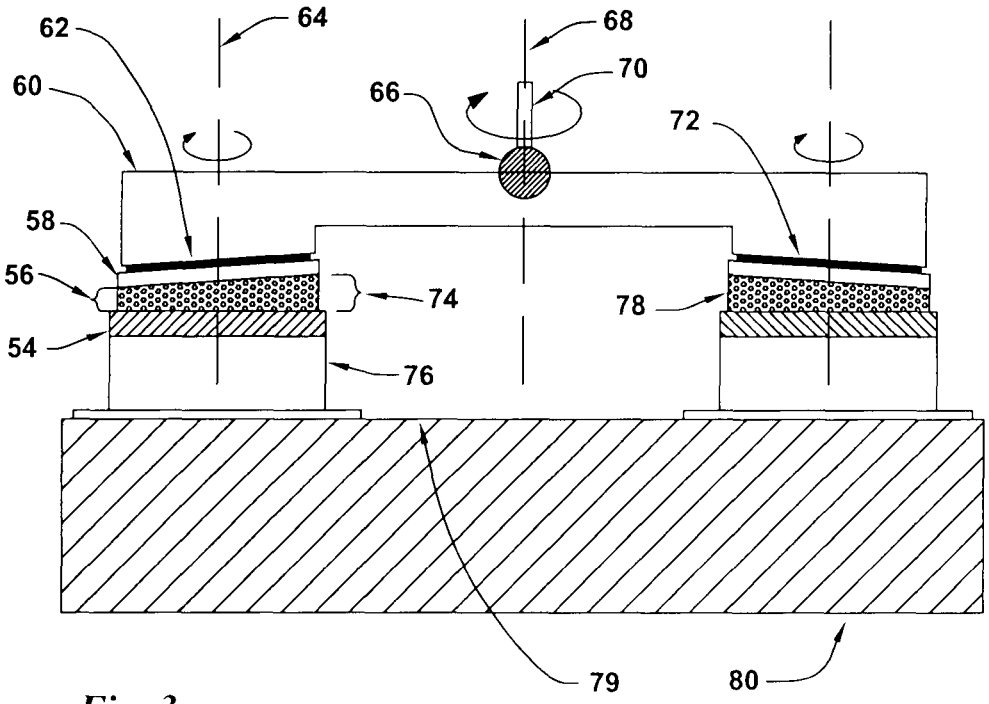
FIG. 3 is a cross section view of supporting a non-flat rotating floating abrasive platen.

FIG. 3 is a cross section view of three-point fixed-position spindles supporting a non-flat rotating floating abrasive platen. Three semiconductor wafer workpiece 58 spindles 76 (one not shown) having rotatable spindle-tops 54 that have flat top surfaces are mounted to the top flat surface 79 of a machine base 80 that is constructed from granite, metal or composite materials or other materials. The flat top surfaces of the spindle 76 spindle-tops are all in a common plane is nominally parallel with the top flat surface 79 of the machine base 80.

Uniform-thickness flat-surfaced wafer workpieces 58 or non-wafer workpieces are attached to resilient wafer pads 78 that are attached to the spindles 76 spindle-tops 54 top flat surfaces where the top surfaces of the three wafer workpieces 58 are mutually contacted by the abrading surface of an annular flexible abrasive disk 62 that is attached to an angled flat annular surface 72 of a floating rotary platen 60. The resilient pads 78 nominally have the same diameter as the circular wafers 58 but the resilient pads 78 can have larger or smaller diameters than the wafers 58. The resilient pads 78 can have a pad 78 non-compressed thickness that is uniform across the full flat surface of the pads 78 where the pad 78 thicknesses ranges from 0.005 inches (0.0127 cm) to 0.50 inches (1.27 cm). The resilient pads 78 can be constructed from materials comprising metal materials, polymer materials, open or closed cell foamed polymer materials, synthetic or organic fiber materials and can be constructed as laminated pads 78 or constructed as composite pads 78 that are comprised of the construction materials defined here.

The resilient pads 78 can also be constructed to have non-continuous surfaces with patterns of raised sections and recessed sections or through-hole sections where the raised sections are in flat-surfaced contact with the flat surfaces of the workpieces 58. Likewise, the resilient pads 78 can also be constructed with patterns of raised sections and recessed sections or open through-hole sections where the raised sections are in flat-surfaced contact with the flat surfaces of the spindle-tops 54.

The resilient pads 78 can be used with non-circular workpieces 58 that have rectangular abraded-surface shapes, elliptical abraded-surface shapes, irregular abraded-surface shapes, incongruous or non-continuous abraded-surface shapes, or other non-circular abraded-surface shapes. The resilient pads 78 can nominally have the same flat-surfaced shape as the flat-surfaced periphery outline shapes of the abraded-surface of the workpieces 58. Also, the resilient pads 78 can have flat-surfaced shapes that are larger or smaller than the workpieces' 58 flat-surfaced abraded-surfaces The floating platen 60 disk attachment surface 72 is non-flat as it is angled in a radial direction relative to the platen 60 rotation axis 68 and the precision-thickness flexible abrasive disk 62 annular abrasive surface is conformed with the platen 60 angled abrasive disk 62 attachment surface 72. The floating platen 60 annular abrasive surface 72 is not precisely parallel with the flat top surfaces of each of the three independent spindle 76 spindle-top 54 flat surfaces.

The floating platen 60 is supported by the three equally-spaced spindles 76 where the shallow-cone-shaped non-flat flat disk attachment surface 72 of the platen 60 is not nominally parallel with the top surface 79 of the machine base 80. The three equally-spaced spindles 76 of the three-point set of spindles 76 provide stable support to the floating platen 60. The rotary floating platen 60 spherical-action drive mechanism 66 restrains the platen 60 in a circular platen 60 radial direction. Also, the rotary floating platen 60 spherical-action drive mechanism 66 allows the rotary floating platen 60 to freely have spherical rotation as the abrasive disk 62 that is attached to the rotary floating platen 60 assumes conformal contact with the uniform-thickness flat-surfaced workpieces 58 that are supported by the resilient wafer pads 78 that are attached to the three spaced spindle 76 spindle-tops 54.

The spindle 76 spindle-tops 54 are driven (not shown) in either clockwise or counterclockwise directions with rotation axes 64 while the rotating platen 60 having a support shaft 70 is also driven about a platen axis 68. Typically, the spindle 76 spindle-tops 54 are driven in the same rotation direction as the platen 60. The workpiece spindle 76 spindle-tops 54 can be rotationally driven by motors (not shown) that are an integral part of the spindles 76 or the spindle-tops 54 can be driven by internal spindle shafts (not shown) that extend through the bottom mounting surface of the spindles 76 and into or through the granite machine base 80 or the spindles 76 can be driven by external drive belts (not shown).

The rotary workpiece spindles 76 having rotary spindle-tops 54 are mounted on at the outer periphery of a granite machine base 80. Three workpiece spindles 76 are mounted on the flat surface 79 of the machine base 80 where the rotational axes 64 of the spindle-tops 54 intersect the spindle-tops 54 rotation centers. The workpiece spindles 76 are positioned with near-equal distances between them.

The spindles 76 are preferred to be air bearing workpiece spindles 76 which typically provide spindle-top 54 flat surface flatness accuracy of 5 millionths of an inch (0.13 microns) but can have spindle-top 54 flat surface flatness accuracies of only 2 millionths of an inch (0.05 microns). These workpiece spindle 76 spindle-top 54 flatness accuracies are preferably co-planar aligned within the 0.0001 inches (3 microns) that is typically required for high speed flat lapping. The workpieces 58 are referred to here as wafers or semiconductor wafers 58 but other types of workpieces 58 such as optical workpieces, ceramic or metal sealing device workpieces 58 or fiber optic workpieces 58 can be used interchangeably with the resilient wafer pads 78 to perform lapping or polishing operations on the workpiece 58 flat surfaces.

Circular semiconductor wafer 58 are shown with opposed parallel surfaces. The top surface of the wafer 58 is shown in flat conformal contact with the non-flat shallow-angled cone-shaped abrasive surface 72 of the abrasive disk 62 while the opposed flat surface of the wafer 58 is attached to and supported by a conformable resilient wafer pad 78. The resilient wafer pad 78 has a uniform non-compressed thickness but as shown here, the wafer pad 78 is compressed where one wafer pad 78 side portion has a thickness 74 that is greater than the wafer pad 78 opposed side portion that has a thickness 56. Localized compression of the resilient wafer pad 78 allows the abraded surface of the uniform thickness wafer 58 to be held in flat conformal abrading contact with the abrasive disk 62 non-flat angled abrasive surface while the opposed surface of the wafer 58 is attached to and supported by the conformable resilient wafer pad 78. The surface of the wafer pad 78 that is opposed to the surface of the wafer pad 78 that the wafer 58 is attached to and supported by the top flat surface of the spindle 76 spindle-top 54.

When the precision-flat spindle-top 54 is rotated, the wafer pad 78 is flexed upon each rotation of the spindle-top 54. Here, the wafer pad 78 becomes initially distorted when the platen 60 is lowered to provide abrading-force controlled abrading of the workpiece wafers 58. Periodic compression and relaxation of different portions of the wafer pads 78 occurs during each revolution of the spindle-tops 54 to maintain uniform abrading pressure contact of the wafer 58 with the angled abrasive surface of the abrasive disk 62.

The rotation speed of the spindle-top 54 can be restrained by slow-response dynamic restoration of the original non-distorted shape of the wafer pad 78 material during each revolution of the spindle-top 54. Here, the top flat surface of the spindle-top 54 that the wafer pad 78 is attached to is not precisely parallel to the non-flat angled annular abrading surface 72 of the rotating platen 60. The wafer pad 78 is periodically distorted during each revolution of the spindle-top 54 to compensate for the non-parallel alignment of the flat surfaces of the spindle-top 54 and the abrasive surface of the flexible abrasive disk 62 that is conformably attached to the non-flat angled abrading surface 72 of the rotary platen 60. If the rotation speed of the spindle-top 54 is too fast, compression and relaxation of the resilient wafer pad 78 material typically can not take place fast enough to provide uniform abrading pressures across the full flat surface of the wafer workpiece 58. Non-uniform abrading pressures across the surface of the wafer 58 can result in non-uniform material removal rates across the flat abraded surface of the wafer 58.

Figure 4:
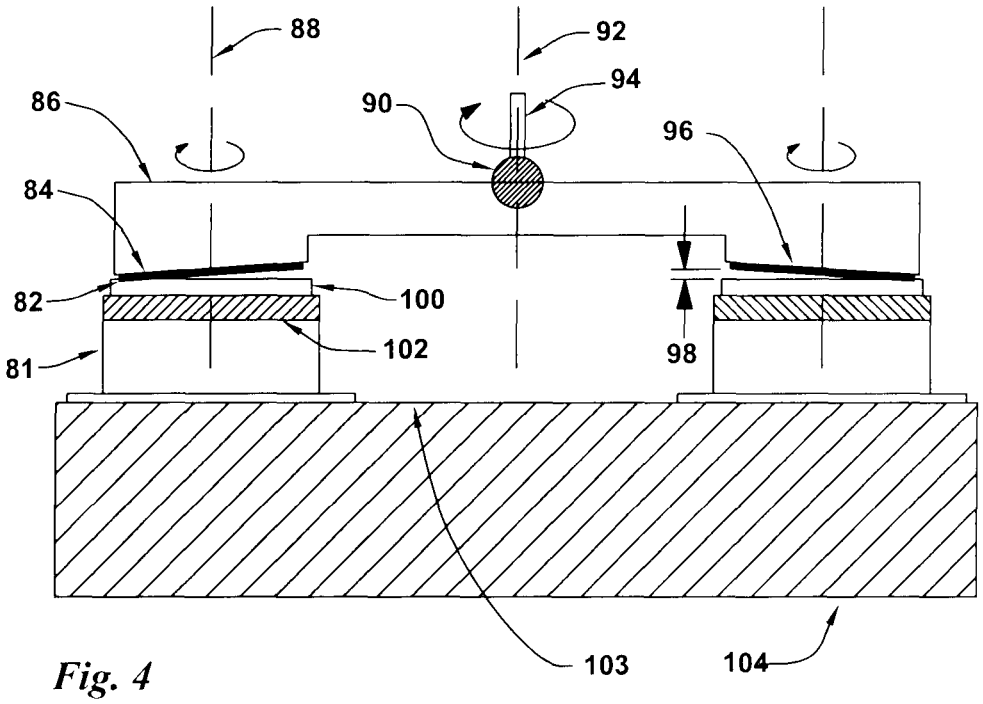
FIG. 4 is a cross section view of spindles supporting a floating non-flat abrasive platen.

FIG. 4 is a cross section view of three-point fixed-position spindles supporting a rotating floating non-flat abrasive platen. Three semiconductor wafer workpiece 100 spindles 81 (one not shown) having rotatable spindle-tops 102 that have flat top surfaces are mounted to the top flat surface 103 of a machine base 104 that is constructed from granite, metal or composite materials or other materials. The flat top surfaces of the spindle 81 spindle-tops 102 are all in a common plane is nominally parallel with the top flat surface 103 of the machine base 104.

Uniform-thickness flat-surfaced wafer workpieces 100 or non-wafer workpieces are attached directly to the spindles 81 spindle-tops 102 top flat surfaces by vacuum, adhesives, low-tack adhesives, mechanical fastener, electro-static, liquid surface tension, or other, wafer workpiece 100 attachment devices without the use of a resilient wafer pad (not shown). The top surfaces of the three wafer workpieces 100 are mutually contacted by the abrading surface of an annular flexible abrasive disk 84 that is attached to the shallow-angled non-flat cone-shaped annular surface 96 of a floating rotary platen 86. The spindle-tops 102 rotate about a spindle axis 88 and the platen 86 rotates about a platen axis 92.

The floating platen 86 flexible abrasive disk 84 attachment surface 96 is non-flat and the precision-thickness abrasive disk 84 annular abrasive surface is also non-flat as it is conformably attached to the platen 86 disk attachment non-flat surface 96. The floating platen 86 flexible abrasive disk 84 cone-shaped attachment surface 96 is angled in a radial direction relative to the platen 86 rotation axis 92. Here, the floating platen 86 annular abrasive cone-shaped surface 96 is not parallel with the flat top surfaces of each of the three independent spindle 81 spindle-top 102 flat surfaces.

The floating platen 86 is supported by the three equally-spaced spindles 81 where the abrasive disk 84 attachment surface 96 of the platen 86 is approximately parallel with the top surface 103 of the machine base 104. The three equally-spaced spindles 81 of the three-point set of spindles 81 provide stable support to the floating platen 86. The rotary floating platen 86 spherical-action drive mechanism 90 restrains the platen 86 in a circular platen 86 radial direction. The platen 86 spherical-action mechanism device 90 has a drive shaft 94 that provides rotation of the platen 86 about the axis 92. Also, the rotary floating platen 86 spherical-action drive mechanism 90 allows the rotary floating platen 86 to freely have spherical rotation as the abrasive disk 84 that is attached to the rotary floating platen 86 assumes abrading contact with the uniform-thickness flat-surfaced workpieces 100 that are supported by the three spaced spindle 81 spindle-tops 102.

Uniform-thickness circular semiconductor wafers 100 are shown with parallel surfaces. The out-of-plane flatness variation of the platen 86 annular abrading surface is shown by the variation distance 98. For platens 86, the non-flat thickness variation 98 is typically very small where the thickness variation 98 is often less than 0.001 inches (25 microns). However, due to the rigidity of the platen 86 and the rigidity of the spindle 81 and the rigidity of the air bearing spindle 81 spindle-top 102, the wafer 100 only contacts the abrasive surface of the abrasive disk 84 at a point 82. Much of the abrading action is concentrated at this abrading contact point 82 which results in non-uniform abrading of the surface of the workpiece wafer 100.

Figure 5:
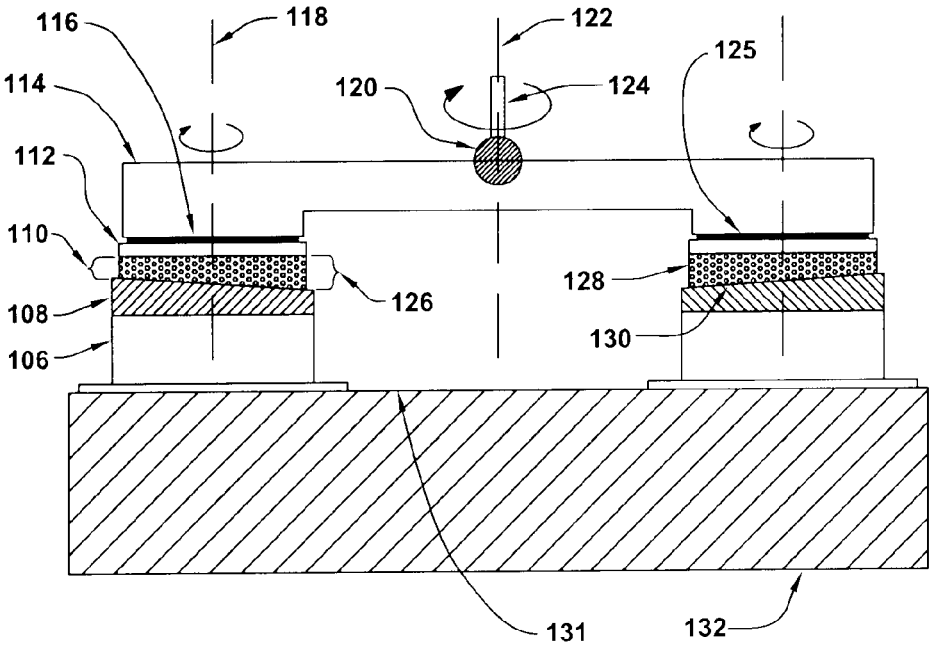
FIG. 5 is a cross section view of spindles with flat angled surfaces supporting a platen.

FIG. 5 is a cross section view of three-point fixed-position workpiece spindles with flat angled surfaces supporting a rotating floating abrasive platen. Three semiconductor wafer workpiece 112 spindles 106 (one not shown) having rotatable spindle-tops 108 that have flat angled top surfaces 130 are mounted to the top flat surface 131 of a machine base 132 that is constructed from granite, metal or composite materials or other materials. The flat angled top surfaces 130 of the spindle 106 spindle-tops 108 are not in a common plane that is approximately parallel with the top flat surface 131 of the machine base 132.

Uniform-thickness flat-surfaced wafer workpieces 112 or non-wafer workpieces are attached to resilient wafer pads 128 that are attached to the spindles 106 spindle-tops' 108 flat surfaces 130 where the top surfaces of the three wafer workpieces 112 are mutually contacted by the abrading surface of an annular flexible abrasive disk 116 that is attached to a precision-flat annular surface 125 of a floating rotary platen 114.

The floating platen 114 disk attachment surface 125 is precision-flat and the precision-thickness flexible abrasive disk 116 annular abrasive surface is conformed with the platen 114 precision-flat abrasive disk 116 annular attachment surface 125. The floating platen 114 annular abrasive surface 125 is not parallel with the angled flat top surfaces 130 of each of the three independent spindles' 106 spindle-tops 108.

The floating platen 114 is supported by the three equally-spaced spindles 106 where the flat disk attachment surface 125 of the platen 114 is nominally parallel with the top surface 131 of the machine base 132. The three equally-spaced spindles 106 of the three-point set of spindles 106 provide stable support to the floating platen 114. The rotary floating platen 114 spherical-action drive mechanism 120 restrains the platen 114 in a circular platen 114 radial direction. The platen 114 spherical-action mechanism device 120 has a drive shaft 124 that provides rotation of the platen 114 about the axis 122. Also, the rotary floating platen 114 spherical-action drive mechanism 120 allows the rotary floating platen 114 to freely have spherical rotation as the abrasive disk 116 that is attached to the rotary floating platen 114 assumes conformal contact with the uniform-thickness flat-surfaced workpieces 112 that are attached to and supported by the resilient pads 128 that are attached to and supported by the three spaced spindles' 106 spindle-tops 108.

The rotary workpiece spindles 106 having rotary spindle-tops 108 are mounted on at the outer periphery of a granite machine base 132. Three workpiece spindles 106 are mounted on the flat surface 131 of the machine base 132 where the rotational axes 118 of the spindle-tops 108 intersect the spindle-tops 108 rotation centers. The workpiece spindles 106 are positioned with near-equal distances between them.

A circular semiconductor wafer 112 is shown with opposed parallel surfaces. The top surface of the wafer 112 is shown in flat conformal contact with the precision-flat abrasive surface of the abrasive disk 116 while the opposed flat surface of the wafer 112 is attached to and supported by a conformable resilient wafer pad 128. The resilient wafer pad 128 has a uniform non-compressed thickness but as shown here, the wafer pad 128 is compressed where one wafer pad 128 side portion has a thickness 126 that is greater than the wafer pad 128 opposed side portion that has a thickness 110. Localized compression of the resilient wafer pad 128 allows the abraded surface of the uniform thickness wafer 112 to be held in flat conformal abrading contact with the abrasive disk 116 flat but angled abrasive surface while the opposed surface of the wafer 112 is attached to and supported by the conformable wafer pad 128. The surface of the wafer pad 128 that is opposed to the surface of the wafer pad 128 that the wafer 112 is attached to and supported by the top flat surface of the spindle 106 spindle-top 108.

When the spindle-top 108 having a flat surface 130 is rotated, the wafer pad 128 retains the initially-established compressed geometry for each rotation of the spindle-top 108. Here, the wafer pad 128 becomes initially distorted when the platen 114 is lowered to provide abrading-force controlled abrading of the uniform-thickness workpiece wafers 112. This original distortion of the wafer pad 128 is retained for each revolution of the spindle-top 108. Periodic compression and relaxation of different portions of the wafer pads 128 is not required during revolutions of the spindle-tops 108 to maintain uniform abrading pressure contact of the wafer 112 with the abrasive surface of the abrasive disk 116.

The rotation speed of the spindle-top 108 is not restrained by slow-response dynamic restoration of the original non-distorted shape of the wafer pad 128 material during each high-speed revolution of the spindle-top 108. Here, the top flat surfaces 130 of the spindle-tops 108 that the wafer pads 128 are attached to are not parallel to the precision-flat annular abrading surface 125 of the rotating platen 114. The wafer pad 128 is only distorted initially to compensate for the flat angled flat surfaces of the spindle-top 108. The flat-surfaced spindle-tops 108 can be rotated at high rotational speeds while maintaining a uniform abrading pressure across the full abraded surface of the wafer workpieces 112.

Figure 6:
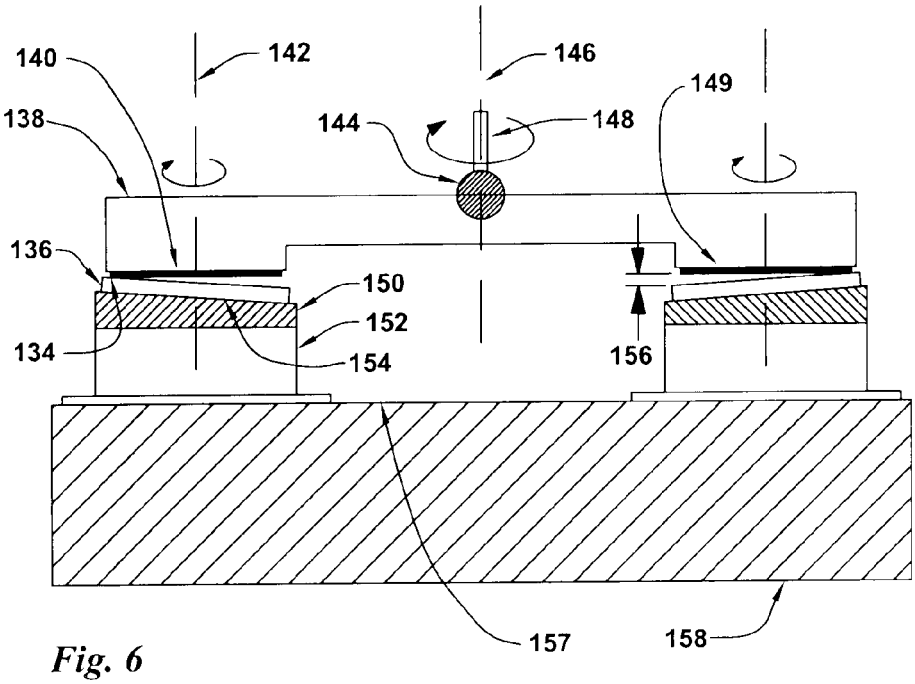
FIG. 6 is a cross section view of spindles with angled surfaces supporting a platen.

FIG. 6 is a cross section view of three-point fixed-position workpiece spindles with angled flat surface supporting a rotating floating abrasive platen. Three semiconductor wafer workpiece 136 spindles 152 (one not shown) having rotatable spindle-tops' 150 angled flat surfaces 154 are mounted to the top flat surface 157 of a machine base 158 that is constructed from granite, metal or composite materials or other materials. The angled flat top surfaces 154 of the spindle 152 spindle-tops 150 are not all in a common plane that is nominally parallel with the top flat surface 157 of the machine base 158.

Uniform-thickness flat-surfaced wafer workpieces 136 or non-wafer workpieces are attached directly to the spindles' 152 spindle-tops 150 top flat surfaces 154 without the use of a resilient wafer pad (not shown). The top surfaces of the three wafer workpieces 136 are mutually contacted by the abrading surface of an annular flexible abrasive disk 140 that is attached to the flat annular surface 149 of a floating rotary platen 138. The spindle-tops 150 rotate about a spindle axis 142 and the platen 138 rotates about a platen axis 146.

The floating platen 138 flexible abrasive disk 140 attachment surface 149 is precisely-flat and the precision-thickness abrasive disk 140 annular abrasive surface is also precisely-flat as it is conformably attached to the platen 138 disk attachment surface 149. Here, the floating platen 138 annular abrasive surface 149 is not parallel with the flat top surfaces 154 of each of the three independent rotatable spindles' 152 spindle-tops 150.

The floating platen 138 is supported by the three equally-spaced spindles 152 where the flat abrasive disk 140 attachment surface 149 of the platen 138 is nominally parallel with the top surface 157 of the machine base 158. The three equally-spaced spindles 152 of the three-point set of spindles 152 provide stable support to the floating platen 138. The rotary floating platen 138 spherical-action drive mechanism 144 restrains the platen 138 in a circular platen 138 radial direction. The platen 138 spherical-action device 144 has a drive shaft 148 that provides rotation of the platen 138 about the platen rotation axis 146. Also, the rotary floating platen 138 spherical-action drive mechanism 144 allows the rotary floating platen 138 to freely have spherical rotation as the abrasive disk 140 that is attached to the rotary floating platen 138 assumes abrading contact with the uniform-thickness flat-surfaced workpieces 136 that are supported by the three spaced spindles' 152 spindle-tops 150.

Uniform-thickness circular semiconductor wafers 136 are shown with parallel surfaces. The out-of-plane flatness dimensional variation of the angled but flat spindle-tops 150 surfaces 154 is shown by the variation distance 156. For spindle-tops 150, the non-flat dimensional variation 156 is typically very small where the thickness variation 156 is often less than 0.001 inches (25 microns). However, due to the rigidity of the platen 138 and the rigidity of the air bearing spindle 152 and the rigidity of the air bearing spindle 152 spindle-top 150, the wafer 136 only contacts the abrasive surface of the abrasive disk 140 at a point 134. Much of the abrading action is concentrated at this abrading contact point 134 which results in non-uniform abrading of the surface of the workpiece wafer 136.

FIG. 6.1 is a cross section view of three-point fixed-position tilt-angled workpiece spindles supporting a rotating floating abrasive platen. Three semiconductor wafer workpiece 112*a* tilt-angled spindles 106*a* (one not shown) having rotatable spindle-tops 108*a* that have flat top surfaces 130*a* are mounted to the top flat surface 131*a* of a machine base 132*a* that is constructed from granite, metal or composite materials or other materials. The flat top surfaces 130*a* of the tilt-angled spindle 106*a* spindle-tops 108*a* are not all in a common plane that is approximately parallel with the top flat surface 131*a* of the machine base 132*a*.

Uniform-thickness flat-surfaced wafer workpieces 112*a* or non-wafer workpieces are attached to resilient wafer pads 128*a* that are attached to the tilt-angled spindles 106*a* spindle-tops' 108*a* flat surfaces 130*a* where the top surfaces of the three wafer workpieces 112*a* are mutually contacted by the abrading surface of an annular flexible abrasive disk 116*a* that is attached to a precision-flat annular surface 125*a* of a floating rotary platen 114*a*.

The floating platen 114*a* disk attachment surface 125*a* is precision-flat and the precision-thickness flexible abrasive disk 116*a* annular abrasive surface is conformed with the platen 114*a* precision-thickness abrasive disk 116*a* annular attachment surface 125*a*. The floating platen 114*a* annular abrasive surface 125*a* is not parallel with the flat top surfaces 130*a* of each of the three independent tilt-angled spindles' 106*a* spindle-tops 108*a*.

The floating platen 114*a* is supported by the three equally-spaced tilt-angled spindles 106*a* where the flat disk attachment surface 125*a* of the platen 114*a* is nominally parallel with the top surface 131*a* of the machine base 132*a*. The three equally-spaced tilt-angled spindles 106*a* of the three-point set of tilt-angled spindles 106*a* provide stable support to the floating platen 114*a*. The rotary floating platen 114*a* spherical-action drive mechanism 120*a* restrains the platen 114*a* in a circular platen 114*a* radial direction. The platen 114*a* spherical-action mechanism device 120*a* has a drive shaft 124*a* that provides rotation of the platen 114*a* about the axis 122*a*. Also, the rotary floating platen 114*a* spherical-action drive mechanism 120*a* allows the rotary floating platen 114*a* to freely have spherical rotation as the abrasive disk 116*a* that is attached to the rotary floating platen 114*a* assumes conformal contact with the uniform-thickness flat-surfaced workpieces 112*a* that are attached to the wafer pads 128*a* that are attached to and supported by the wafer pads 128*a* that are attached to and supported by the three spaced tilt-angled spindle 106*a* spindle-tops 108*a*.

The rotary workpiece tilt-angled spindles 106*a* having rotary spindle-tops 108*a* are mounted on at the outer periphery of a granite machine base 132*a*. Three workpiece tilt-angled spindles 106*a* are mounted on the flat surface 131*a* of the machine base 132*a* where the rotational axes 118*a* of the spindle-tops 108*a* intersect the spindle-tops 108*a* rotation centers. The workpiece tilt-angled spindles 106*a* are positioned with near-equal distances between them.

Uniform-thickness circular semiconductor wafers 112*a* are shown with opposed parallel surfaces. The top surface of the wafers 112*a* are shown in flat conformal contact with the precision-flat abrasive surface of the abrasive disk 116*a* while the opposed flat surface of the wafer 112*a* is attached to and supported by a conformable resilient wafer pad 128*a*. The resilient wafer pad 128*a* has a uniform non-compressed thickness but as shown here, the wafer pad 128*a* is compressed where one wafer pad 128*a* side portion has a thickness 126*a* that is greater than the wafer pad 128*a* opposed side portion that has a thickness 110*a*. Localized compression of the resilient wafer pad 128*a* allows the abraded surface of the uniform thickness wafer 112*a* to be held in flat conformal abrading contact with the abrasive disk 116*a* flat angled abrasive surface while the opposed surface of the wafer 112*a* is attached to and supported by the conformable resilient wafer pad 128*a*. The surface of the wafer pad 128*a* that is opposed to the surface of the wafer pad 128*a* that the wafer 112*a* is attached to and supported by the top flat surface 130*a* of the tilt-angled spindle 106*a* spindle-top 108*a*.

When the precision-flat spindle-top 108*a* is rotated, the wafer pad 128*a* is flexed upon each rotation of the spindle-top 108*a*. Here, the wafer pad 128*a* becomes initially distorted when the platen 114*a* is lowered to provide abrading-force controlled abrading of the workpiece wafers 112*a*. Periodic compression and relaxation of different portions of the wafer pads 128*a* occurs during each revolution of the spindle-tops 108*a* to maintain uniform abrading pressure contact of the wafer 112*a* with the angled abrasive surface of the abrasive disk 116*a*.

When the spindle-top 108*a*, having a precision-flat surface 130*a* is rotated, the wafer pad 128*a* is flexed upon each rotation of the spindle-top 108*a*. Here, the wafer pad 128*a* becomes initially distorted when the platen 114*a* is lowered to provide abrading-force controlled abrading of the uniform-thickness workpiece wafers 112*a*. Periodic compression and relaxation of different portions of the wafer pads 128*a* occurs during each revolution of the spindle-tops 108*a* to maintain uniform abrading pressure contact of the wafer 112*a* with the angled abrasive surface of the abrasive disk 116*a*.

The rotation speed of the spindle-top 108*a* can be restrained by slow-response dynamic restoration of the original non-distorted shape of the wafer pad 128*a* material during each revolution of the spindle-top 108*a*. Here, the top flat surface of the spindle-top 108*a* that the wafer pad 128*a* is attached to is not parallel to the precision-flat annular abrading surface 125*a* of the rotating platen 114*a*. The wafer pad 128*a* is periodically distorted during each revolution of the spindle-top 108*a* to compensate for the non-parallel alignment of the flat surfaces of the spindle-top 108*a* and the abrasive surface of the flexible abrasive disk 116*a* that is conformably attached to the precision-flat abrading surface 125*a* of the rotary platen 114*a*. If the rotation speed of the spindle-top 108*a* is too fast, compression and relaxation of the resilient wafer pad 128*a* material typically can not take place fast enough to provide uniform abrading pressures across the full flat surface of the wafer workpiece 112*a*. Non-uniform abrading pressures across the surface of the wafer 112*a* can result in non-uniform material removal rates across the flat abraded surface of the wafer 112*a*.

FIG. 6.2 is a cross section view of three-point fixed-position tilt-angled workpiece spindles supporting a rotating floating abrasive platen. Three semiconductor wafer workpiece 136*a* tilt-angled spindles 152*a* (one not shown) having rotatable spindle-tops' 150*a* precision-flat surfaces 154*a* are mounted to the top flat surface 157*a* of a machine base 158*a* that is constructed from granite, metal or composite materials or other materials. The flat top surfaces 154*a* of the tilt-angled spindle 152*a* spindle-tops 150*a* are not all in a common plane that is nominally parallel with the top flat surface 157*a* of the machine base 158*a*.

Uniform-thickness flat-surfaced wafer workpieces 136*a* or non-wafer workpieces are attached directly to the tilt-angled spindles' 152*a* spindle-tops 150*a* top flat surfaces 154*a* by without the use of a resilient wafer pad (not shown). The top surfaces of the three wafer workpieces 136*a* are mutually contacted by the abrading surface of an annular flexible abrasive disk 140*a* that is attached to the flat annular surface 149*a* of a floating rotary platen 138*a*. The spindle-tops 150*a* rotate about a tilt-angled spindle axis 142*a* and the platen 138*a* rotates about a platen axis 146*a*.

The floating platen 138*a* flexible abrasive disk 140*a* attachment surface 149*a* is precisely-flat and the precision-thickness abrasive disk 140*a* annular abrasive surface is also precisely-flat as it is conformably attached to the platen 138*a* disk attachment surface 149*a*. Here, the floating platen 138*a* annular abrasive surface 149*a* is not parallel with the flat top surfaces 154*a* of each of the three independent tilt-angled spindle 152*a* spindle-tops 150*a*.

The floating platen 138*a* is supported by the three equally-spaced tilt-angled spindles 152*a* where the flat abrasive disk 140*a* attachment surface 149*a* of the platen 138*a* is nominally parallel with the top surface 157*a* of the machine base 158*a*. The three equally-spaced tilt-angled spindles 152*a* of the three-point set of tilt-angled spindles 152*a* provide stable support to the floating platen 138*a*. The rotary floating platen 138*a* spherical-action drive mechanism 144*a* restrains the platen 138*a* in a circular platen 138*a* radial direction. The platen 138*a* spherical-action device 144*a* has a drive shaft 148*a* that provides rotation of the platen 138*a* about the platen axis 146*a*. Also, the rotary floating platen 138*a* spherical-action drive mechanism 144*a* allows the rotary floating platen 138*a* to freely have spherical rotation as the abrasive disk 140*a* that is attached to the rotary floating platen 138*a* assumes abrading contact with the uniform-thickness flat-surfaced workpieces 136*a* that are supported by the three spaced tilt-angled spindles' 152*a* spindle-tops 150*a*.

Uniform-thickness circular semiconductor wafers 136*a* are shown with parallel surfaces. The out-of-plane flatness dimensional variation of the tilt-angled spindles 152*a* flat spindle-tops 150*a* surface 154*a* is shown by the variation distance 156*a*. For spindle-tops 150*a*, the dimensional variation 156*a* is typically very small where the thickness variation 156*a* is often less than 0.001 inches (25 microns). However, due to the rigidity of the platen 138*a* and the rigidity of the tilt-angled air bearing spindle 152*a* and the rigidity of the air bearing tilt-angled spindle 152*a* spindle-top 150*a*, the wafer 136*a* only contacts the abrasive surface of the abrasive disk 140*a* at a point 134*a*. Much of the abrading action is concentrated at this abrading contact point 134*a* which results in non-uniform abrading of the surface of the workpiece wafer 136*a*.

FIG. 6.3 is a cross section view of three-point fixed-position spindles with different-thickness workpieces supporting a rotating floating abrasive platen. Three different-thickness semiconductor wafer workpiece 112*b*, 127*b* spindles 106*b* (one not shown) having rotatable spindle-tops 108*b* that have flat top surfaces 130*b* are mounted to the top flat surface 131*b* of a machine base 132*b* that is constructed from granite, metal or composite materials or other materials. The flat top surfaces 130*b* of the spindles' 106*b* spindle-tops 108*b* are in a common plane that is nominally parallel with the top flat surface 131*b* of the machine base 132*b*.

Different-thickness flat-surfaced wafer workpieces 112*b*, 127*b* or non-wafer workpieces are attached to resilient wafer pads 110*b*, 128*b* that are attached to the spindles 106*b* spindle-tops' 108*b* flat surfaces 130*b* where the top surfaces of the three different-thickness wafer workpieces 112*b*, 127*b* are mutually contacted by the abrading surface of an annular flexible abrasive disk 116*b* that is attached to a precision-flat annular surface 125*b* of a floating rotary platen 114*b*.

The floating platen 114*b* disk attachment surface 125*b* is precision-flat and the precision-thickness flexible abrasive disk 116*b* annular abrasive surface is conformed with the platen 114*b* precision-flat abrasive disk 116*b* annular attachment surface 125*b*. The floating platen 114*b* annular abrasive surface 125*b* is nominally parallel with the flat top surfaces 130*b* of each of the three independent spindles' 106*b* spindle-tops 108*b*.

The floating platen 114*b* is supported by the three equally-spaced spindles 106*b* where the flat disk attachment surface 125*b* of the platen 114*b* is nominally parallel with the top surface 131*b* of the machine base 132*b*. The three equally-spaced spindles 106*b* of the three-point set of spindles 106*b* provide stable support to the floating platen 114*b*. The rotary floating platen 114*b* spherical-action drive mechanism 120*b* restrains the platen 114*b* in a circular platen 114*b* radial direction. The platen 114*b* spherical-action mechanism device 120*b* has a drive shaft 124*b* that provides rotation of the platen 114*b* about the axis 122*b*. Also, the rotary floating platen 114*b* spherical-action drive mechanism 120*b* allows the rotary floating platen 114*b* to freely have spherical rotation as the abrasive disk 116*b* that is attached to the rotary floating platen 114*b* assumes conformal contact with the different-thickness flat-surfaced workpieces 112*b*,127*b* that are attached to the wafer pads 110*b*, 128*b* that are attached to and supported by the three spaced spindle 106*b* spindle-tops 108*b*.

The rotary workpiece spindles 106*b* having rotary spindle-tops 108*b* are mounted on at the outer periphery of a granite machine base 132*b*. Three workpiece spindles 106*b* are mounted on the flat surface 131*b* of the machine base 132*b* where the rotational axes 118*b* of the spindle-tops 108*b* intersect the spindle-tops 108*b* rotation centers. The workpiece spindles 106*b* are positioned with near-equal distances between them.

Different-thickness circular semiconductor wafers 112*b*, 127*b* having different thicknesses where workpiece 127*b* is much thicker than workpiece 112*b* are shown with respective opposed parallel surfaces. The top surface of the wafers 112*b*, 127*b* are shown in flat conformal abrading contact with the precision-flat abrasive surface of the abrasive disk 116*b* while the opposed flat surface of the wafers 112*b*, 127*b* are attached to and supported by a conformable resilient wafer pads 110*b*, 128*b*. The resilient wafer pads 110*b*, 128*b* have equal and uniform non-compressed thicknesses. As shown here, one wafer pad 110*b* has a resultant large thickness 111*b* due to the small compression of its original thickness. Also, the wafer pad 128*b* has a resultant small thickness 126*b* due to the relatively large compression of its original thickness.

Localized compression of the resilient wafer pads 110*b*, 128*b* allow the abraded surface of the uniform thickness wafers 112*b*, 127*b* to be held in flat conformal abrading contact with the abrasive disk 116*b* flat abrasive surface while the opposed surface of the wafers 112*b*, 127*b* are attached to and supported by the conformable wafer pads 110*b*, 128*b*. The surfaces of the wafer pads 110*b*, 128*b* that are opposed to the surfaces of the wafer pads 110*b*, 128*b* that the wafers 112*b*, 127*b* are attached to are attached to and supported by the top flat surfaces 130*b* of the spindles' 106*b* spindle-tops 108*b*.

When the spindle-tops 108*b*, having flat surfaces 130*b*, are rotated, the wafer pads 110*b*, 128*b* retain their initially-established compressed geometry for each rotation of the spindle-tops 108*b*. Here, the wafer pads 110*b*, 128*b* become initially distorted when the platen 114*b* is lowered to provide abrading-force controlled abrading of the different-thickness workpiece wafers 112*b*, 127*b*. The original respective distortions of the wafer pads 110*b*, 128*b* are retained for each revolution of the spindle-tops 108*b*. Periodic compression and relaxation of different portions of the wafer pads 110*b*, 128*b* are not required during revolutions of the spindle-tops 108*b* to maintain uniform abrading pressure contact of the wafers 112*b*, 127*b* with the abrasive surface of the abrasive disk 116*b*.

The rotation speeds of the spindle-tops 108*b* are not restrained by slow-response dynamic restoration of the original non-distorted shape of the wafer pads 110*b*, 128 material during each high-speed revolution of the spindle-tops 108*b*. Here, the top flat surfaces 130*b* of the spindle-tops 108*b* that the wafer pads 110*b*, 128 are attached to are parallel to the precision-flat annular abrading surface 125*b* of the rotating platen 114*b*. The wafer pads 110*b*, 128 are only distorted initially to compensate for the non-uniform thicknesses of the flat-surfaced 112*b*, 127*b* wafer workpieces. The flat-surfaced spindle-tops 108*b* can be rotated at high rotational speeds while maintaining a uniform abrading pressure across the full abraded surface of the wafer workpieces 112*b*, 127*b*.

FIG. 6.4 is a cross section view of three-point fixed-position spindles with different-thickness workpieces supporting a rotating floating abrasive platen. Three different-thickness semiconductor wafer workpiece 136*b*, 154*b* spindles 152*b* (one not shown) having rotatable spindle-tops' 150*b* precision-flat surfaces 155*b* are mounted to the top flat surface 157*b* of a machine base 162*b* that is constructed from granite, metal or composite materials or other materials. The flat top surfaces 155*b* of the spindle 152*b* spindle-tops 150*b* are all in a common plane that is nominally parallel with the top flat surface 157*b* of the machine base 162*b*.

Different-thickness flat-surfaced wafer workpieces 136*b*, 154*b* or non-wafer workpieces are attached directly to the spindles' 152*b* spindle-tops 150*b* top flat surfaces 155*b* without the use of a resilient wafer pad (not shown). The top surfaces of the three different-thickness wafer workpieces 136*b*, 154*b* are mutually contacted by the abrading surface of an annular flexible abrasive disk 140*b* that is attached to the flat annular surface 149*b* of a floating rotary platen 138*b*. The spindle-tops 150*b* rotate about a spindle axis 142*b* and the platen 138*b* rotates about a platen axis 146*b*.

The floating platen 138*b* flexible abrasive disk 140*b* attachment surface 149*b* is precisely-flat and the precision-thickness abrasive disk 140*b* annular abrasive surface is also precisely-flat as it is conformably attached to the platen 138*b* disk attachment surface 149*b*. Here, the floating platen 138*b* annular abrasive surface 149*b* is parallel with the flat top surfaces 155*b* of each of the three independent spindles' 152*b* spindle-tops 150*b*.

The floating platen 138*b* is supported by the three equally-spaced spindles 152*b* where the flat abrasive disk 140*b* attachment surface 149*b* of the platen 138*b* is nominally parallel with the top surface 157*b* of the machine base 158*b*. The three equally-spaced spindles 152*b* of the three-point set of spindles 152*b* provide stable support to the floating platen 138*b*. The rotary floating platen 138*b* spherical-action drive mechanism 144*b* restrains the platen 138*b* in a circular platen 138*b* radial direction. The platen 138*b* spherical-action mechanism device 144*b* has a drive shaft 148*b* that provides rotation of the platen 138*b* about the axis 146*b*. Also, the rotary floating platen 138*b* spherical-action drive mechanism 144*b* allows the rotary floating platen 138*b* to freely have spherical rotation as the abrasive disk 140*b* that is attached to the rotary floating platen 138*b* assumes abrading contact with the different-thickness flat-surfaced workpieces 136*b*, 154*b* that are supported by the three spaced spindle 152*b* spindle-tops 150*b*.

Different-thickness circular semiconductor wafers 136*b*, 154*b* having different thicknesses where workpiece 136*b* having a thickness 160*b* is much thinner than workpiece 154*b* having a thickness 158*b* and both are shown with respective opposed parallel surfaces. For different-thickness circular semiconductor wafers 136*b*, 154*b*, the dimensional variation between the thicknesses 160*b* and 158*b* is typically very small where the thickness variation between the two is often less than 0.001 inches (25 microns).

However, due to the rigidity of the platen 138*b* and the rigidity of the air bearing spindles 152*b* and the rigidity of the air bearing spindle 152*b* spindle-top 150*b*, the wafer 136*b* only contacts the abrasive surface of the abrasive disk 140*b* at a point 134*b*. Likewise, the wafer 154*b* only contacts the abrasive surface of the abrasive disk 140*b* at a point 156*b*. Much of the abrading action is concentrated at these abrading contact points 134*b*, 156*b* which results in non-uniform abrading of the surfaces of the workpiece wafers 136*b*, 154*b*.

Fixed-Spindles Floating-Platen

Figure 7:
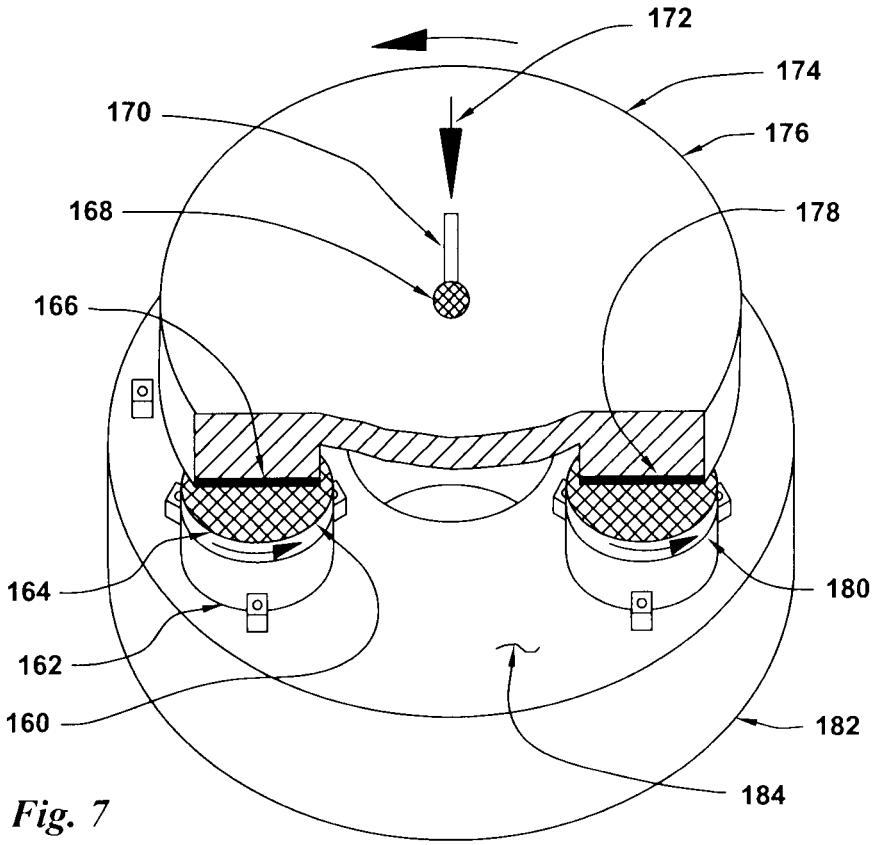
FIG. 7 is an isometric view of spindles supporting a floating rotating abrasive platen.

FIG. 7 is an isometric view of an abrading system having three-point fixed-position rotating workpiece spindles supporting a floating rotating abrasive platen. Three evenly-spaced rotatable spindles 162 (one not shown) having rotating tops 180 that have attached workpieces 164 support a floating abrasive platen 174. The platen 174 has a vacuum, or other, abrasive disk attachment device (not shown) that is used to attach an annular abrasive disk 178 to the precision-flat platen 174 abrasive-disk mounting surface 166. The abrasive disk 178 is in flat abrasive surface contact with all three of the workpieces 164. The rotating floating platen 174 is driven through a spherical-action universal-joint type of device 168 having a platen drive shaft 170 to which is applied an abrasive contact force 172 to control the abrading pressure applied to the workpieces 164. The workpiece rotary spindles 162 are mounted on a granite, or other material, base 182 that has a flat surface 184. The three workpiece spindles 162 have spindle top surfaces that are co-planar. The workpiece spindles 162 can be interchanged or a new workpiece spindle 162 can be changed with an existing spindle 162 where the flat top surfaces of the spindles 162 are co-planar. Here, the equal-thickness workpieces 164 are in the same plane and are abraded uniformly across each individual workpiece 164 surface by the platen 174 precision-flat planar abrasive disk 178 abrading surface. The planar abrading surface 166 of the floating platen 174 is approximately co-planar with the flat surface 184 of the granite base 182.

The spindle 162 rotating surfaces spindle tops 180 can driven by different techniques comprising spindle 162 internal spindle shafts (not shown), external spindle 162 flexible drive belts (not shown) and spindle 162 internal drive motors (not shown). The individual spindle 162 spindle tops 180 can be driven independently in both rotation directions and at a wide range of rotation speeds including very high speeds of 10,000 surface feet per minute (3,048 meters per minute). Typically the spindles 162 are air bearing spindles that are very stiff to maintain high rigidity against abrading forces and they have very low friction and can operate at very high rotational speeds. Suitable roller bearing spindles can also be used in place of air bearing spindles.

Abrasive disks (not shown) can be attached to the spindle 162 spindle tops 180 to abrade the platen 174 annular flat surface 166 by rotating the spindle tops 180 while the platen 174 flat surface 166 is positioned in abrading contact with the spindle abrasive disks that are rotated in selected directions and at selected rotational speeds when the platen 174 is rotated at selected speeds and selected rotation direction when applying a controlled abrading force 172. The top surfaces 160 of the individual three-point spindle 162 rotating spindle tops 180 can be also be abraded by the platen 174 planar abrasive disk 178 by placing the platen 174 and the abrasive disk 178 in flat conformal contact with the top surfaces 160 of the workpiece spindles 162 as both the platen 174 and the spindle tops 180 are rotated in selected directions when an abrading pressure force 172 is applied. The top surfaces 160 of the spindles 162 abraded by the platen 174 results in all of the spindle 162 top surfaces 160 being in a common plane.

The granite base 182 is known to provide a time-stable precision-flat surface 184 to which the precision-flat three-point spindles 162 can be mounted. One unique capability provided by this abrading system 176 is that the primary datum-reference can be the fixed-position granite base 182 flat surface 184. Here, spindles 162 can all have the precisely equal heights where they are mounted on a precision-flat surface 184 of a granite base 182 where the flat surfaces 160 of the spindle tops 180 are co-planar with each other.

When the abrading system 176 is initially assembled it can provide extremely flat abrading workpiece 164 spindle 162 top 180 mounting surfaces and extremely flat platen 174 abrading surfaces 166. The extreme flatness accuracy of the abrading system 176 provides the capability of abrading ultra-thin and large-diameter and high-value workpieces 164, such as semiconductor wafers, at very high abrading speeds with a fully automated workpiece 164 robotic device (not shown).

In addition, the system 176 can provide unprecedented system 176 component flatness and workpiece abrading accuracy by using the system 176 components to "abrasively dress" other of these same-machine system 176 critical components such as the spindle tops 180 and the platen 174 planar-surface 166. These spindle top 180 and the platen 174 annular planar surface 166 component dressing actions can be alternatively repeated on each other to progressively bring the system 176 critical components comprising the spindle tops 180 and the platen 174 planar-surface 166 into a higher state of operational flatness perfection than existed when the system 176 was initially assembled. This system 176 self-dressing process is simple, easy to do and can be done as often as desired to reestablish the precision flatness of the system 176 component or to improve their flatness for specific abrading operations.

This single-sided abrading system 176 self-enhancement surface-flattening process is unique among conventional floating-platen abrasive systems. Other abrading systems use floating platens but these systems are typically double-sided abrading systems. These other systems comprise slurry lapping and micro-grinding (flat-honing) systems that have rigid bearing-supported rotated lower abrasive coated platens. They also have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) often have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 176 is completely different than the double-sided system (not-shown).

The floating platen 174 system 176 performance is based on supporting a floating abrasive platen 174 on the top surfaces 160 of three-point spaced fixed-position rotary workpiece spindles 162 that are mounted on a stable machine base 182 flat surface 184 where the top surfaces 160 of the spindles 162 are precisely located in a common plane. The top surfaces 160 of the spindles 162 can be approximately or substantially co-planar with the precision-flat surface 184 of a rigid fixed-position granite, or other material, base 182 or the top surfaces 160 of the spindles 162 can be precisely co-planar with the precision-flat surface 184 of a rigid fixed-position granite, or other material, base 182. The three-point support is required to provide a stable support for the floating platen 174 as rigid components, in general, only contact each other at three points. As an option, additional spindles 162 can be added to the system 176 by attaching them to the granite base 182 at locations between the original three spindles 162.

This three-point workpiece spindle abrading system 176 can also be used for abrasive slurry lapping (not shown), for micro-grinding (flat-honing) (not shown) and also for chemical mechanical planarization (CMP) (not shown) abrading to provide ultra-flat abraded workpieces 164.

Figure 8:
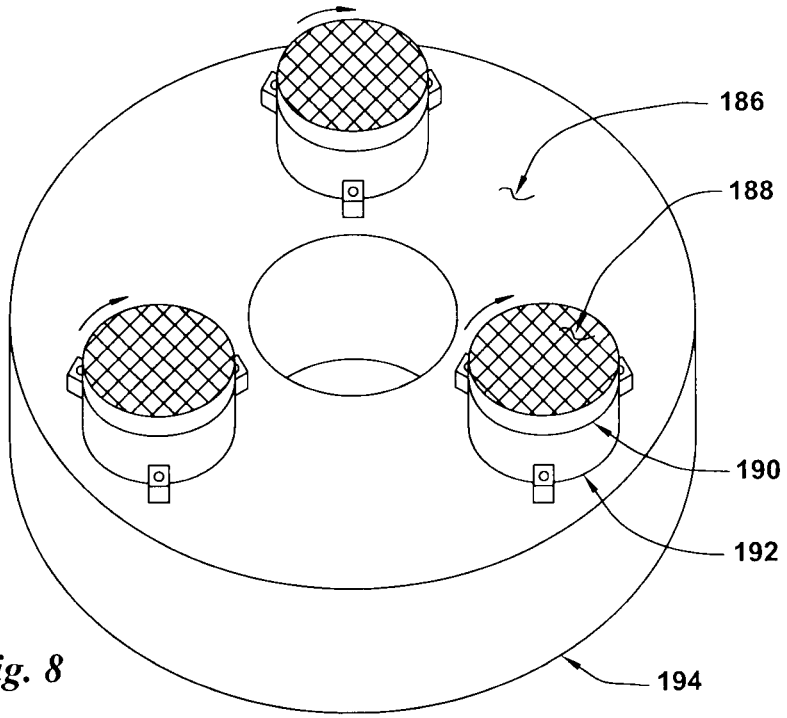
FIG. 8 is an isometric view of three-point fixed-position spindles mounted on a granite base.

FIG. 8 is an isometric view of three-point fixed-position spindles mounted on a granite base. A granite base 194 has a precision-flat top surface 186 that supports three attached workpiece spindles 192 that have rotatable driven tops 190 where flat-surfaced workpieces 188 are attached to the flat-surfaced spindle tops 190.

Raised Elevation Frame and Pivot Frames

The frame of the pivot-balance lapper is attached to a pair of linear slides where the frame can be raised with the use of a pair of electric jacks such as linear actuators. These actuators can provide closed-loop precision control of the position of the pivot frame and are well suited for long term use in a harsh abrading environment. When the pivot frame and floating platen are raised, workpieces can be changed and the abrasive disks that are attached to the platen can be easily changed. The platen is allowed to float with the use of a spherical-action platen shaft bearing.

Single or multiple friction-free air bearing air cylinders can be used to precisely control the abrading forces that are applied to the workpieces by the platen. These air cylinders are located at one end of the beam-balance pivot frame and the platen is located at the opposed end of the beam-balance pivot frame. Use of air bearings on the pivot frame pivot axis shaft eliminates any bearing friction. Cylindrical air bearings that are used on the pivot axis are available from New Way Air Bearing Company, Aston, Pa.

Any force that is applied by the air cylinders is directly transmitted across the length of the pivot frame to the platen because of the lack of pivot bearing friction. Other bearings such as needle bearings, roller bearings or fluid lubricated journal bearings can be used but all of these have more rotational friction than the air bearings. Air bearing cylinders such as the AirPel® cylinders from Airpot Corporation of Norwalk, Conn. can be selected where the cylinder diameter can provide the desired range of abrading forces.

Once the frictionless pivot frame is balanced, any force applied by the abrading force cylinders on one end of the pivot frame is directly transmitted to the platen abrasive surface that is located at the other end of this balance-beam apparatus. To provide a wide range of abrading forces, multiple air cylinders of different diameter sizes can be used in parallel with each other. Because the range of air pressure supplied to the cylinders has a typical limited range of from 0 to 100 psia with limited allowable incremental pressure control changes, it is difficult to provide the extra-precise abrading force load changes required for high speed flat lapping. Use of small-diameter cylinders provide very finely adjusted abrading forces because these small cylinders have nominal force capabilities.

The exact forces that are generated by the air cylinders can be very accurately determined with load cell force sensors. The output of these load cells can be used by feedback controller devices to dynamically adjust the abrading forces on the platen abrasive throughout the lapping procedure. This abrading force control system can even be programmed to automatically change the applied-force cylinder forces to compensate for the very small weight loss experienced by an abrasive disk during a specific lapping operation. Also, the weight variation of "new" abrasive disks that are attached to a platen to provide different sized abrasive particles can be predetermined. Then the abrading force control system can be used to compensate for this abrasive disk weight change from the previous abrasive disk and provide the exact desired abrading force on the platen abrasive.

The abrading force feedback controller provides an electrical current input to an air pressure regulator referred to as an I/P (current to pressure) controller. The abrading force controller has the capability to change the pressures that are independently supplied to each of the parallel abrading force air cylinders. The actual force produced by each independently controlled air cylinder is determined by a respected force sensor load cell to close the feedback loop.

Figure 9:
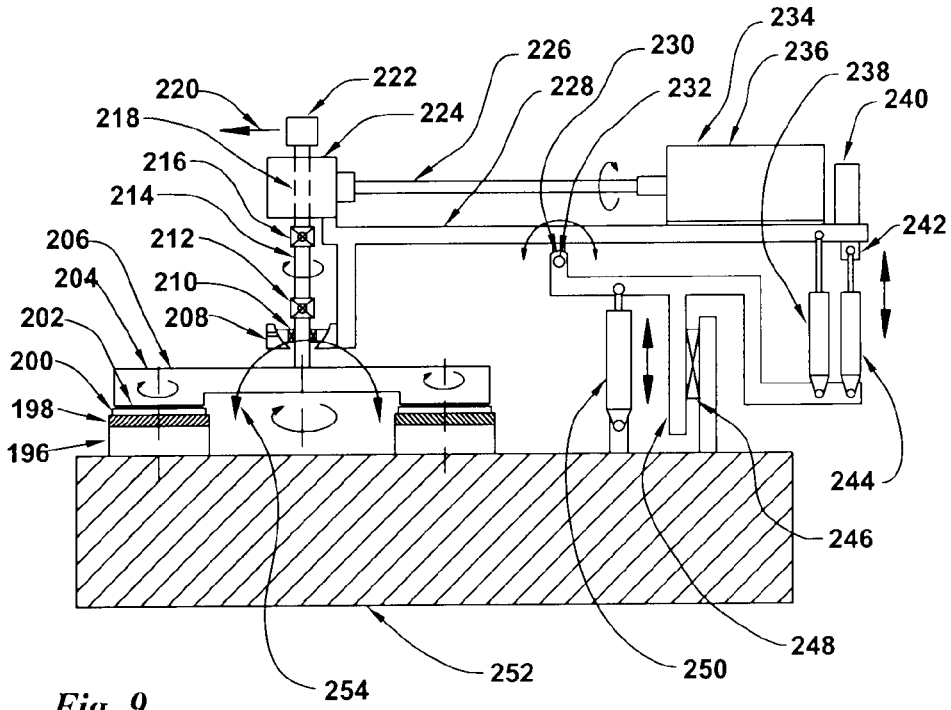
FIG. 9 is a cross section view of a pivot-balance floating-platen lapper machine.

FIG. 9 is a cross section view of a pivot-balance floating-platen lapper machine. The pivot-balance floating-platen lapping machine 234 provides these desirable features. The lapper machine 234 components such as the platen drive motor 236 and a counterweight 240 are used to counterbalance the weight of the abrasive platen assembly 206 where the pivot frame 228 is balanced about the pivot frame 228 pivot center 230. A right-angle gear box 224 has a hollow drive shaft to provide vacuum to attach raised island abrasive disks 202 to the platen 204. The spherical bearing 210 having a spherical rotation 254 can be a roller bearing or an air bearing having an air passage 208 that allows pressurized air to be applied to create an air bearing effect or vacuum to be applied to lock the spherical bearing 210 rotor and housing components together. One or more conventional universal joints or plate-type universal joints or constant velocity universal joints or a set of two constant velocity universal joints 212, 216 attached to the drive shaft 214 allow the spherical rotation and cylindrical rotation motion of the rotating platen 204.

The pivot frame 228 has a rotation axis centered at the pivot frame pivot center 230 where the platen assembly 206 is attached at one end of the pivot frame 228 from the pivot center 230 and the platen motor 236 and a counterbalance weight 240 are attached to the pivot frame 228 at the opposed end of the pivot frame 228 from the pivot center 230. The pivot frame 228 has low friction rotary pivot bearings 232 at the pivot center 230 where the pivot bearings 232 can be frictionless air bearings or low friction roller bearings. The platen drive motor 236 is attached to the pivot frame 228 in a position where the weight of the platen drive motor 236 nominally or partially counterbalances the weight of the abrasive platen assembly 206. A movable and weight-adjustable counterweight 240 is attached to the pivot frame 228 in a position where the weight of the counterweight 240 partially counterbalances the weight of the abrasive platen assembly 206.

The weight of the counterweight 240 is used together with the weight of the platen motor 236 to effectively counterbalance the weight of the abrasive platen assembly 206 that is also attached to the pivot frame 228. When the pivot frame 228 is counterbalanced, the pivot frame 228 pivots freely about the pivot center 230. The platen drive motor 236 rotates a drive shaft 226 that is coupled to the gear box 224 to rotate the gear box 224 hollow drive shaft 218. Vacuum 220 is applied to a rotary union 222 that allows rotation of the gear box 224 hollow drive shaft 218 to route vacuum to the platen 204 through tubing or other passageway devices (not shown) where abrasive disks 202 can be attached to the platen 204 by vacuum. The pivot frame 228 can be rotated to desired positions and locked at the desired rotation position by use of a pivot frame locking device 238 that is attached to the pivot frame 228 and to the pivot frame 228 elevation frame 248. Zero-friction air bearing cylinders 244 can be used to apply the desired abrading forces to the platen 204 as it is held in 3-point abrading contact with the workpieces 200 attached to rotary spindles 196 having rotary spindle-tops 198. The zero-friction air bearing cylinders 244 can be used to apply the desired abrading forces to a force load cell 242 that measures the force applied by the air cylinders 244.

The whole pivot frame 228 can be raised or lowered from a machine base 252 by a elevation frame 248 lift device 250 that can be an electric motor driven screw jack lift device or a hydraulic lift device. The elevation frame 248 lift device 250 is attached to a linear slide 246 that is attached to the machine base 252 and also is attached to the elevation lift frame 248 where the elevation lift frame 248 lift device 250 can have a position sensor (not shown) that can be used to precisely control the vertical position of the elevation frame 248. Zero-friction air bearing cylinders 244 can be used to apply the desired abrading forces to the platen 204 as it is held in 3-point abrading contact with the workpieces 200 attached to rotary spindles 196 having rotary spindle-tops 198. One end of one or more air bearing cylinders 244 can be attached to the pivot frame 228 at different positions to apply forces to the pivot frame 228 where these applied forces provide an abrading force to the platen 204. The support end of the air bearing cylinders can be attached to the elevation frame 248.

Figure 10:
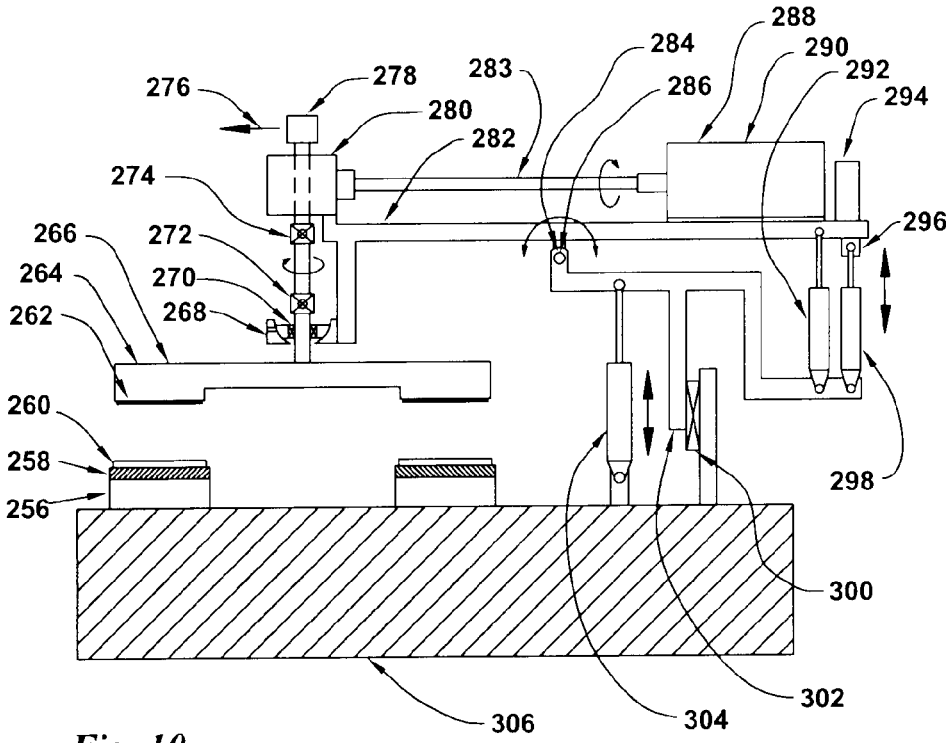
FIG. 10 is a cross section view of a raised pivot-balance floating-platen lapper machine.

FIG. 10 is a cross section view of a raised pivot-balance floating-platen lapper machine. Here, the pivot frame is raised up to allow workpieces and abrasive disks to be changed. The pivot-balance floating-platen lapping machine 288 provides these desirable features. The lapper machine 288 components such as the platen drive motor 290 and a counterweight 294 are used to counterbalance the weight of the abrasive platen assembly 266 where the pivot frame 282 is balanced about the pivot frame 282 pivot center 284.

The pivot frame 282 has a rotation axis centered at the pivot frame pivot center 284 where the platen assembly 266 is attached at one end of the pivot frame 282 from the pivot center 284 and the platen motor 290 and a counterbalance weight 294 are attached to the pivot frame 282 at the opposed end of the pivot frame 282 from the pivot center 284. The pivot frame 282 has low friction rotary pivot bearings 286 at the pivot center 284 where the pivot bearings 286 can be frictionless air bearings or low friction roller bearings. The platen drive motor 290 is attached to the pivot frame 282 in a position where the weight of the platen drive motor 290 nominally or partially counterbalances the weight of the abrasive platen assembly 266. A movable and weight-adjustable counterweight 294 is attached to the pivot frame 282 in a position where the weight of the counterweight 294 partially counterbalances the weight of the abrasive platen assembly 266. The weight of the counterweight 294 is used together with the weight of the platen motor 290 to effectively counterbalance the weight of the abrasive platen assembly 266 that is also attached to the pivot frame 282. When the pivot frame 282 is counterbalanced, the pivot frame 282 pivots freely about the pivot center 284. The platen drive motor 290 rotates a drive shaft 226 that is coupled to the gear box 280 to rotate the gear box 280 hollow drive shaft.

The whole pivot frame 282 can be raised or lowered from a machine base 306 by a elevation frame 302 lift device 304 that can be an electric motor driven screw jack lift device or a hydraulic lift device. The elevation frame 302 lift device 304 can have a position sensor that can be used to precisely control the vertical position of the elevation frame 302. Zero-friction air bearing cylinders 298 can be used to apply the desired abrading forces to the platen 264 as it is held in 3-point abrading contact with the workpieces 260 attached to rotary spindles 256 having rotary spindle-tops 258. One end of one or more air bearing cylinders 298 can be attached to the pivot frame 282 at different positions to apply forces to the pivot frame 282 where these applied forces provide an abrading force to the platen 264. The support end of the air bearing cylinders 298 can also be attached to the elevation frame 302. The floating platen 264 has a spherical rotation and a cylindrical that is provided by the spherical-action platen support bearing 270 that supports the weight of the floating platen 264 where the spherical-action platen support bearing 270 is supported by the pivot frame 282.

The air pressure applied to the air cylinder 298 is typically provide by an I/P (electrical current-to-pressure) pressure regulator (not shown) that is activated by an abrading process controller (not shown). The actual force generated by the air cylinder 298 can be sensed and verified by an electronic force sensor load cell 296 that is attached to the cylinder rod end of the air cylinder 298. The force sensor 296 allows feed-back type closed-loop control of the abrading pressure that is applied to the workpieces 260. Abrading pressures on the workpieces 260 can be precisely changed throughout the lapping operation by the lapping process controller.

The spindles 256 are attached to a dimensionally stable granite or epoxy-granite base 306. A spherical-action bearing 270 allows the platen 264 to freely float with a spherical action motion during the lapping operation. A right-angle gear box 280 has a hollow drive shaft to provide vacuum to attach raised island abrasive disks 262 to the platen 264. Vacuum 276 is applied to a rotary union 278 that allows rotation of the gear box 280 drive hollow shaft to route vacuum to the platen 264 through tubing or other passageway devices (not shown) where abrasive disks 262 can be attached to the platen 264 by vacuum. The spherical bearing 270 can be a roller bearing or an air bearing having an air passage 268 that allows pressurized air to be applied to create an air bearing effect or vacuum to be applied to lock the spherical bearing 270 rotor and housing components together. One or more conventional universal joints or plate-type universal joints or constant velocity universal joints or a set of two constant velocity universal joints 272, 274 attached to the drive shaft allow the spherical rotation and cylindrical rotation motion of the rotating platen 264.

The pivot frame 282 can be rotated to desired positions and locked at the desired rotation position by use of a pivot frame locking device 292 that is attached to the pivot frame 282 and to the pivot frame 282 elevation frame 302. The pivot frame 282 can be raised or lowered to selected elevation positions by the electric motor lift device screw jack 304 or by a hydraulic jack 304 that is attached to the machine base 306 and to the pivot frame 282 elevation frame 302 where the pivot frame 282 elevation frame 302 is supported by a translatable slide device 300 that is attached to the machine base 306.

Pivot-Balance Platen Spherical Rotation

When the pivot frame is raised by the pair of electric actuators (or by hydraulic cylinders) and tilted, the floating platen can also be rotated back into a horizontal position because of the use of a spherical-action platen shaft bearing. The drive shafts that are used to rotate the platen are connected with constant velocity universal joints to the platen drive shaft and to the gear box drive shaft. These universal joints allow the floating platen to have a spherical rotation while rotational power is supplied by the drive shafts to rotate the platen. The constant velocity universal joints are sealed and are well suited for use in a harsh abrading environment. If desired, the platen can be rotated at very low speeds while the pivot frame is tilted and the platen is tilted back where the abrading surface is nominally horizontal.

Figure 11:
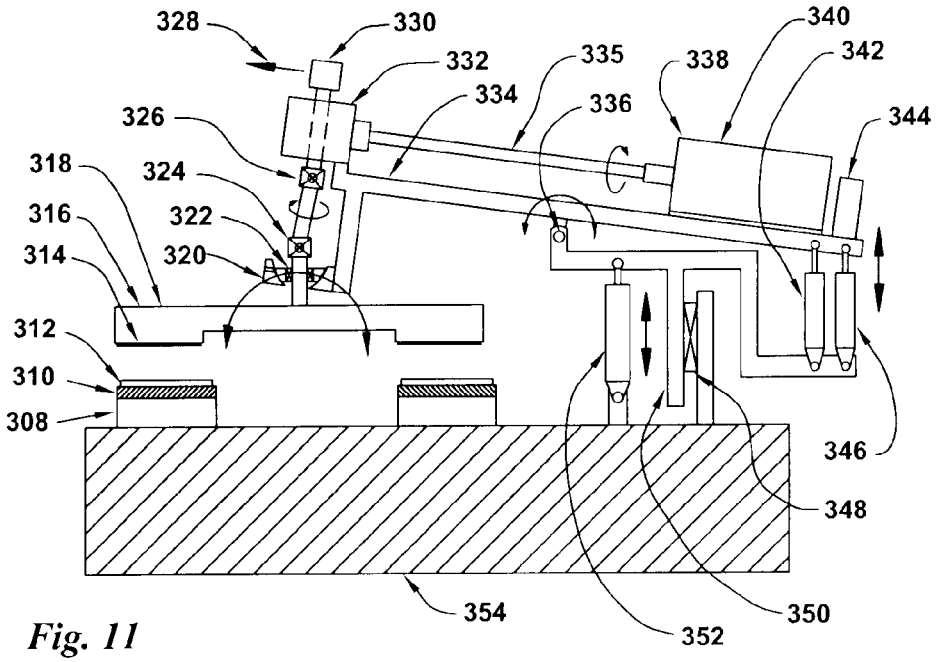
FIG. 11 is a cross section view of a raised pivot-balance floating-platen lapper machine.

FIG. 11 is a cross section view of a raised pivot-balance floating-platen lapper machine with a horizontal platen. Here, the pivot frame is raised and rotated and the floating-platen is rotated back to a nominally horizontal position. The pivot-balance floating-platen lapping machine 338 provides these desirable features. The lapper machine 338 components such as the platen drive motor 340 and a counterweight 344 are used to counterbalance the weight of the abrasive platen assembly 318 where the pivot frame 334 is balanced about the pivot frame 334 pivot center 336. Vacuum 328 is applied to a rotary union 330 that allows rotation of the gear box 332 drive hollow shaft to route vacuum 328 to the platen 316 through tubing or other passageway devices (not shown) where abrasive disks 314 can be attached to the platen 316 by vacuum.

The pivot frame 334 has a rotation axis centered at the pivot frame pivot center 336 where the platen assembly 318 is attached at one end of the pivot frame 334 from the pivot center 336 and the platen motor 340 and a counterbalance weight 344 are attached to the pivot frame 334 at the opposed end of the pivot frame 334 from the pivot center 336. The pivot frame 334 has low friction rotary pivot bearings at the pivot center 336 where the pivot bearings can be frictionless air bearings or low friction roller bearings. The platen drive motor 340 is attached to the pivot frame 334 in a position where the weight of the platen drive motor 340 nominally or partially counterbalances the weight of the abrasive platen assembly 318. A movable and weight-adjustable counterweight 344 is attached to the pivot frame 334 in a position where the weight of the counterweight 344 partially counterbalances the weight of the abrasive platen assembly 318. The weight of the counterweight 344 is used together with the weight of the platen motor 340 to effectively counterbalance the weight of the abrasive platen assembly 318 that is also attached to the pivot frame 334. When the pivot frame 334 is counterbalanced, the pivot frame 334 pivots freely about the pivot center 336. The platen drive motor 340 rotates a drive shaft 335 that is coupled to the gear box 332 to rotate the gear box 332 hollow drive shaft.

The whole pivot frame 334 can be raised or lowered from a machine base 354 by a elevation frame 350 lift device 352 that can be an electric motor driven screw jack lift device or a hydraulic lift device. The elevation frame 350 lift device 352 can have a position sensor that can be used to precisely control the vertical position of the elevation frame 350. Zero-friction air bearing cylinders 346 can be used to apply the desired abrading forces to the platen 316 as it is held in 3-point abrading contact with the workpieces 312 attached to rotary spindles 308 having rotary spindle-tops 310. One end of one or more air bearing cylinders 346 can be attached to the pivot frame 334 at different positions to apply forces to the pivot frame 334 where these applied forces provide an abrading force to the platen 316. The support end of the air bearing cylinders 346 can also be attached to the elevation frame 350. The floating platen 316 has a spherical rotation and a cylindrical rotation that is provided by the spherical-action platen support bearing 322 that supports the weight of the floating platen 316 where the spherical-action platen support bearing 322 is supported by the pivot frame 334.

The air pressure applied to the air cylinder 346 is typically provide by an I/P (electrical current-to-pressure) pressure regulator (not shown) that is activated by an abrading process controller (not shown). The actual force generated by the air cylinder 346 can be sensed and verified by an electronic force sensor load cell that is attached to the cylinder rod end of the air cylinder 346. The force sensor allows feed-back type closed-loop control of the abrading pressure that is applied to the workpieces 312. Abrading pressures on the workpieces 312 can be precisely changed throughout the lapping operation by the lapping process controller.

The spindles 308 are attached to a dimensionally stable granite or epoxy-granite base 354. A spherical-action bearing 322 allows the platen 316 to freely float with a spherical action motion during the lapping operation. A right-angle gear box 330 has a hollow drive shaft to provide vacuum to attach raised island abrasive disks 314 to the platen 316. Vacuum 328 is applied to a rotary union 330 that allows rotation of the gear box 332 drive hollow shaft to route vacuum 328 to the platen 316 through tubing or other passageway devices (not shown) where abrasive disks 314 can be attached to the platen 316 by vacuum. The spherical bearing 322 can be a spherical roller bearing or an air bearing having an air passage 320 that allows pressurized air to be applied to create an air bearing effect or vacuum to be applied to lock the spherical bearing 322 rotor and housing components together. One or more conventional universal joints or plate-type universal joints or constant velocity universal joints or a set of two constant velocity universal joints 324, 326 attached to the drive shaft allow the spherical rotation motion and the cylindrical rotation motion of the rotating platen 316 that rotates the abrasive disk 314 when the abrasive disk 314 is in abrading contact with workpieces 312.

The pivot frame 334 can be rotated to desired positions and locked at the desired rotation position by use of a pivot frame locking device 342 that is attached to the pivot frame 334 and to the pivot frame 334 elevation frame 350. The pivot frame 334 can be raised or lowered to selected elevation positions by the electric motor screw jack 352 or by a hydraulic jack 352 that is attached to the machine base 354 and to the pivot frame 334 elevation frame 350 where the pivot frame 334 elevation frame 350 is supported by a translatable slide device 348 that is attached to the machine base 354.

Pivot-Balance Lapper Frame

A top view of the pivot-balance lapping machine shows how this lightweight framework and platen assembly has widespread support members that provide unusual stiffness to the abrading system. The two primary supports of the pivot frame are the two linear slides that have a very wide stance by being positioned at the outboard sides of the rigid granite base. The two precision-type heavy-duty sealed pivot frame linear slides have roller bearings that provide great structural rigidity for the abrasive platen as the platen rotates during the lapping operation.

Very low friction pivot bearings are used on the pivot shaft to minimize the pivot shaft friction as the pivot frame rotates. Because this pivot shaft friction is so low, the exact abrading force that is generated by the pivot abrading force air cylinder is transmitted to the abrading platen during the lapping operation. Cylindrical air bearings can provide zero-friction rotation of the pivot frame support shaft even when the pivot frame and platen system is quite heavy.

Figure 12:
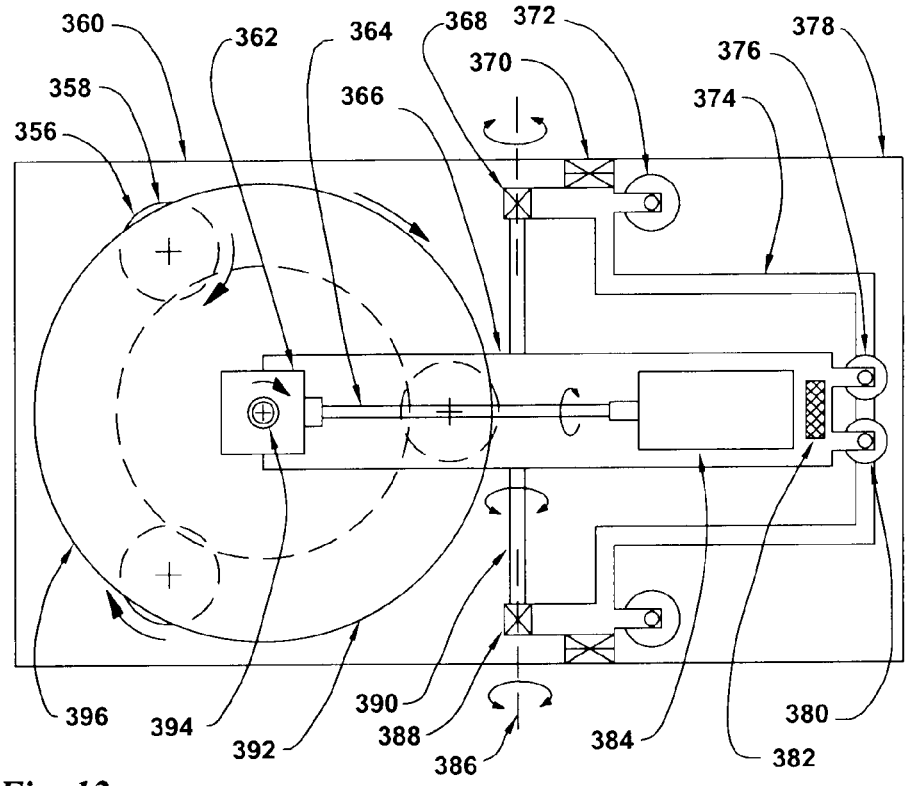
FIG. 12 is a top view of a pivot-balance floating-platen lapper machine.

FIG. 12 is a top view of a pivot-balance floating-platen lapper machine. The pivot-balance floating-platen lapping machine 360 components include the platen drive motor 384 and a counterweight 382 are that are used to counterbalance the weight of the abrasive platen assembly 392 where the pivot frame 366 is balanced about the pivot frame 366 pivot center 368 rotation axis 386.

The pivot frame 366 has a rotation axis 386 centered at the pivot frame pivot center 368 where the platen assembly 392 is attached at one end of the pivot frame 366 from the pivot axis 386 and the platen motor 384 and a counterbalance weight 382 are attached to the pivot frame 366 at the opposed end of the pivot frame 366 from the pivot axis 386. The pivot frame 366 has low friction rotary pivot bearings 388 at the pivot center 368 where the pivot bearings 388 can be frictionless air bearings or low friction roller bearings. The radial stiffness of these pivot frame 366 air bears 388 are typically much stiffer than equivalent roller bearings 388. The platen drive motor 384 is attached to the pivot frame 366 in a position where the weight of the platen drive motor 384 nominally or partially counterbalances the weight of the abrasive platen assembly 392. A movable and weight-adjustable counterweight 382 is attached to the pivot frame 366 in a position where the weight of the counterweight 382 partially counterbalances the weight of the abrasive platen assembly 392. The weight of the counterweight 382 is used together with the weight of the platen motor 384 to effectively counterbalance the weight of the abrasive platen assembly 392 that is also attached to the pivot frame 366. When the pivot frame 366 is counterbalanced, the pivot frame 366 pivots freely about the pivot axis 386. The platen drive motor 384 rotates a drive shaft 364 that is coupled to the gearbox 362 to rotate the gearbox 362 hollow abrading platen 396 rotary drive shaft 394.

The whole pivot frame 366 can be raised or lowered from a machine base 378 by a elevation frame 374 lift device 372 that can be an electric motor driven screw jack lift device or a hydraulic lift device. The elevation frame 374 lift device 372 is attached to a linear slide 370 that is attached to the machine base 378 and also is attached to the elevation lift frame 374 where the elevation lift frame 374 lift device 372 can have a position sensor (not shown) that can be used to precisely control the vertical position of the elevation lift frame 374.

The elevation frame 374 can be raised with the use of an elevation frame 374 lift devices 372 such as a pair of electric jacks such as a linear actuator produced by Exlar Corporation, Minneapolis, Minn. These linear actuators can provide closed-loop precision control of the position of the elevation frame 374 and are well suited for long term use in a harsh abrading environment. When the elevation frame 374 and the pivot frame 366 and the abrasive platen assembly 392 and the floating platen 396 are raised, workpieces can be changed and the abrasive disks (not shown) that are attached to the platen can be easily changed. Here the floating platen 396 is allowed to have a spherical motion floatation and cylindrical rotation with the use of a spherical-action platen shaft bearing (not shown that rotates the abrasive disk when the abrasive disk is in abrading contact with workpieces (not shown).

Zero-friction air bearing cylinders 376 can be used to apply the desired abrading forces to the platen 396 as it is held in 3-point abrading contact with the workpieces 356 attached to rotary spindles 358 having rotary spindle-tops. One end of one or more air bearing cylinders 376 can be attached to the pivot frame 366 at different positions to apply forces to the pivot frame 366 where these applied forces provide an abrading force to the platen 396. The support end of the air bearing cylinders 376 can be attached to the elevation frame 374. A pivot frame 366 locking device 380 is attached both to the pivot frame 366 locking and the elevation frame 374.

The top view of the pivot-balance lapping machine 360 shows how this lightweight framework and platen assembly has widespread support members that provide unusual stiffness to the abrading system. The two primary supports of the pivot frame are the two linear slides 370 that have a very wide stance by being positioned at the outboard sides of the rigid granite, epoxy-granite, cast iron or steel machine base 378. The two precision-type heavy-duty sealed pivot frame machine tool type linear slides 370 have roller bearings that provide great structural rigidity for the lapping machine 360 and particularly for the abrasive platen 396 when the platen 396 is rotated during the lapping operation.

Very low friction pivot bearings 388 are used on the pivot shaft 390 to minimize the pivot shaft 390 friction as the pivot frame 366 rotates. Because this pivot shaft 390 friction is so low, the abrading force that is generated by the pivot abrading force air cylinder 376 is transmitted without friction-distortion to the abrading platen 396 during the lapping operation. Cylindrical air bearings 388 can provide zero-friction rotation of the pivot frame 366 support shaft 390 even when the pivot frame 366 and platen assembly 392 is quite heavy.

The pivot-balance floating-platen lapping machine 360 is an elegantly simple abrading machine that provides extraordinary precision control of abrading forces for this abrasive high speed flat lapping system. All of its components are all robust and are well suited for operation in a harsh abrading atmosphere with minimal maintenance.

Figure 13:
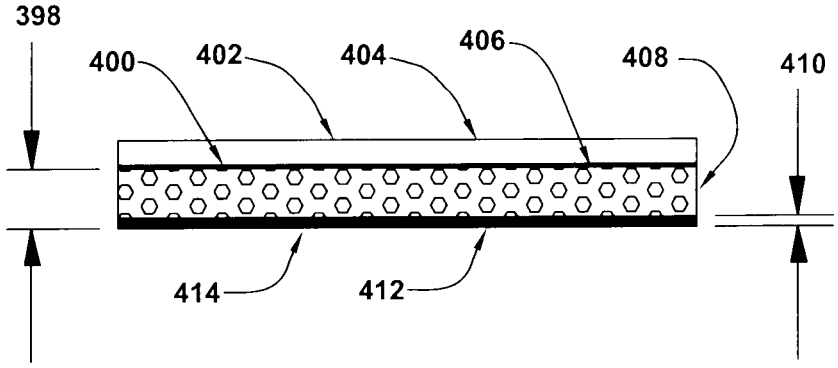
FIG. 13 is a cross section view of a semiconductor wafer with an attached resilient pad.

FIG. 13 is a cross section view of a semiconductor wafer with an attached resilient pad. A semiconductor wafer workpiece 402, or other type of workpiece 402, having a flat surface 404 that is abraded is attached to a compressible resilient wafer pad 408. The wafer pad 408 has a layer of adhesive or low-tack adhesive or coating or an attached flexible polymer film 406 which bonds the wafer 402 bottom surface 400 to the wafer pad 408. Also, in one embodiment, the wafer pad 408 has a bottom flexible metal or polymer layer 412 having a layer 412 thickness 410 where the layer 412 has a flat surface 414. The wafer pad 408 layer 412 can be a vacuum-sealed layer that allows vacuum to be used where the wafer pad 408 is attached to a rotary workpiece spindle (not shown) by the vacuum acting on the layer 412 flat surface 414. The compressible resilient wafer pad 408 has a nominal uncompressed thickness 398 that is uniform over the full surface of the pad 408.

Uniform-thickness or non-uniform-thickness flat-surfaced wafer workpieces 402 or non-wafer workpieces can be attached to resilient wafer pads 408 that are attached to the spindles rotary spindle-tops (not shown) top flat surfaces by vacuum, adhesives, low-tack adhesives, mechanical fastener, electro-static, liquid surface tension, or other, wafer pad 408 attachment devices. The workpieces 402 can be attached to the resilient wafer pads 408 by vacuum, adhesives, low-tack adhesives, mechanical fastener, electro-static, liquid surface tension, or other, wafer pad 408 attachment devices. Here, the top surfaces 404 of wafer workpieces 402 are mutually contacted by the abrading surface of an annular flexible abrasive disk (not shown) that is attached to the precision-flat annular surface of a floating rotary platen (not shown).

The resilient wafer pads 408 can also be used with workpieces 402 in other abrading operations such as for CMP (chemical mechanical planarization) operations. Further, the resilient wafer pads 408 can be used to support other workpieces 402 comprising optical devices, fiber optics devices, mechanical fluid seal devices for use in other abrading operations such as lapping, grinding, flat honing and micro-grinding operations.

The resilient workpiece pads 408 nominally have the same diameter as the circular wafers or workpieces 402 but the resilient pads 408 can have larger or smaller diameters than the wafers 402. The resilient pads 408 can have a pad 408 non-compressed thickness 398 that is uniform across the full flat surface of the pads 408 where the pad 408 nominal thicknesses 398 ranges from 0.005 inches (0.0127 cm) to 0.50 inches (1.27 cm). The resilient pads 408 can be constructed from materials comprising metal materials, polymer materials, open or closed cell foamed polymer materials, synthetic or organic fiber materials and can be constructed as laminated pads 408 or constructed as composite pads 408 that are comprised of the construction materials defined here.

The resilient pads 408 can also be constructed to have non-continuous surfaces with patterns of raised sections and recessed sections or through-hole sections where the raised sections are in flat-surfaced contact with the flat surfaces of the workpieces 402. Likewise, the resilient pads 408 can also be constructed with patterns of raised sections and recessed sections or open through-hole sections where the raised sections are in flat-surfaced contact with the flat surfaces of the spindle-tops.

Figure 14:
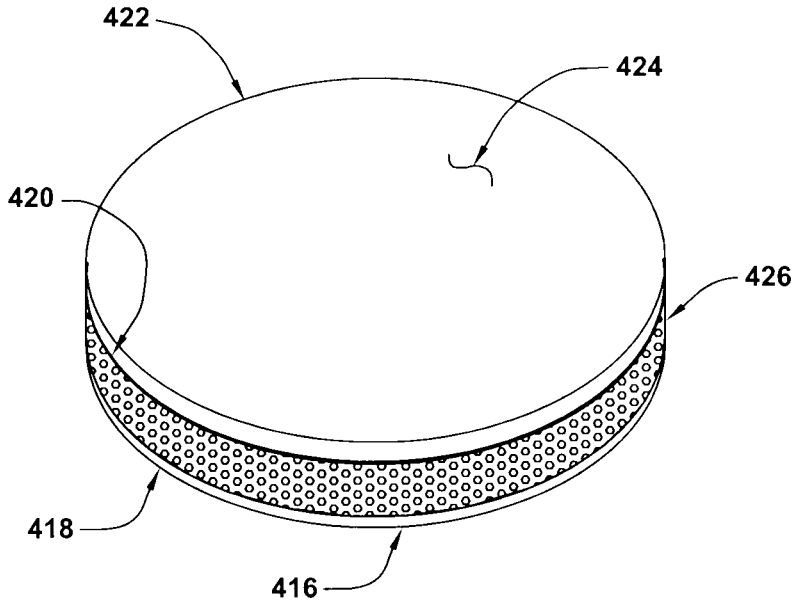
FIG. 14 is an isometric view of a semiconductor wafer with an attached resilient pad.

The resilient pads 408 can be used with non-circular workpieces 402 that have rectangular abraded-surface shapes, elliptical abraded-surface shapes, irregular abraded-surface shapes, incongruous or non-continuous abraded-surface shapes, or other non-circular abraded-surface shapes. The resilient pads 408 can nominally have the same flat-surfaced shape as the flat-surfaced periphery outline shapes of the abraded-surface of the workpieces 402. Also, the resilient pads 408 can have flat-surfaced shapes that are larger or smaller than the workpieces' 402 flat-surfaced abraded-surfaces FIG. 14 is an isometric view of a semiconductor wafer with an attached resilient pad. A semiconductor wafer 422 having a flat surface 424 is attached to a resilient pad 426 by an low-tack adhesive layer 420. The resilient pad 426 can be easily removed from the wafer 422 by peeling the flexible pad 426 from the wafer 422. The resilient pad 426 is shown with an attached bottom vacuum-sealed layer 416 that has a flat surfaced bottom 418 where the pad 426 can be attached to a rotary workpiece spindle (not shown) by applying vacuum to the pad continuous sealed bottom 418.

Figure 15:
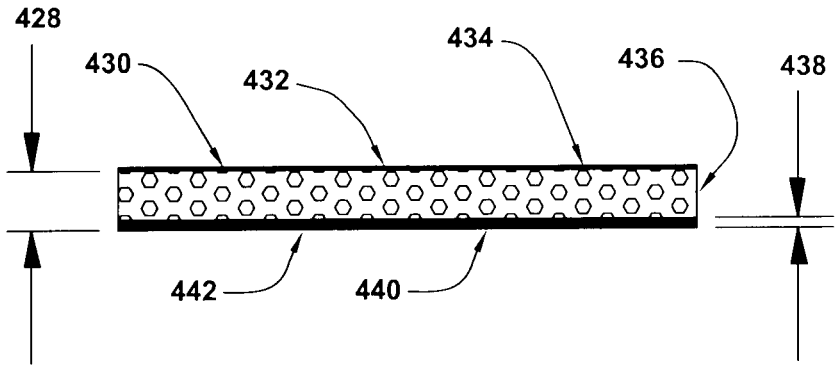
FIG. 15 is a cross section view of a semiconductor wafer support resilient pad.

FIG. 15 is a cross section view of a semiconductor wafer support resilient pad. The wafer pad 436 has a layer of adhesive or low-tack adhesive or coating or an attached flexible polymer film 430 which bonds the wafer (not shown) bottom surface to the wafer pad 436. Also, the wafer pad 436 has a bottom flexible metal or polymer layer 440 having a layer 440 thickness 438 where the layer 440 has a flat surface 442. The wafer pad 436 bottom layer 440 can be a sealed layer that allows vacuum to be used where the wafer pad 436 is attached to a rotary workpiece spindle (not shown) by the vacuum acting on the layer 440 flat surface 442. The compressible resilient wafer pad 436 has a nominal uncompressed thickness 428 that is uniform over the full surface of the pad 436.

Non-uniform-thickness flat-surfaced wafer workpieces or non-wafer workpieces are attached to the flat top surface 434 of the resilient wafer pads 436 that are attached to the spindles rotary spindle-tops (not shown) top flat surfaces by vacuum, adhesives, low-tack adhesives, mechanical fastener, electro-static, liquid surface tension, or other, wafer pad 436 attachment devices. The workpieces can be attached to the resilient wafer pads 436 by vacuum, adhesives, low-tack adhesives, mechanical fastener, electro-static, liquid surface tension, or other, wafer pad 436 attachment devices.

Figure 16:
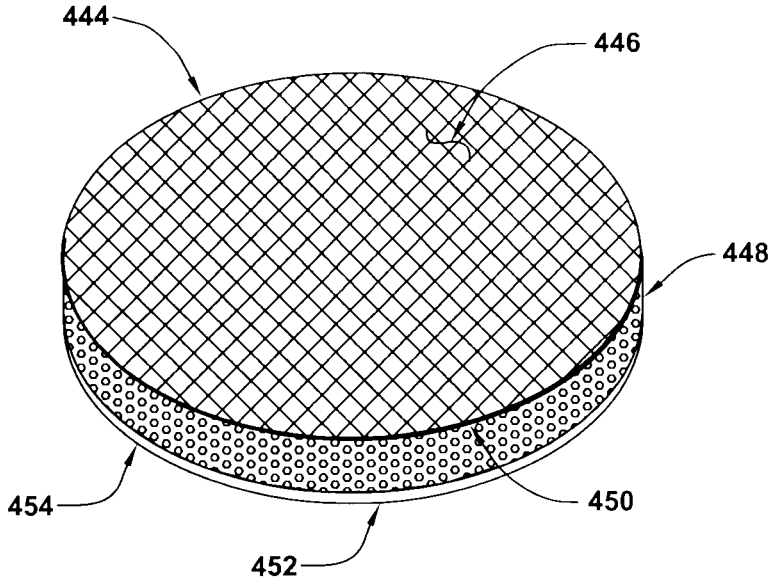
FIG. 16 is an isometric view of a semiconductor wafer support resilient pad

FIG. 16 is an isometric view of a semiconductor wafer support resilient pad. A semiconductor wafer (not shown) having a flat surface is attached to the top flat surface 446 of a composite resilient wafer pad 444 having a resilient core 448 by a low-tack adhesive layer 450. The resilient pad 444 can be easily removed from the wafer by peeling the flexible pad 444 from the wafer. The resilient pad 444 is shown with an attached bottom sealed layer 454 that has a flat surfaced bottom 452 where the pad 444 can be attached to a rotary workpiece spindle (not shown) by applying vacuum to the pad 444 continuous sealed bottom 452.

Figure 17:
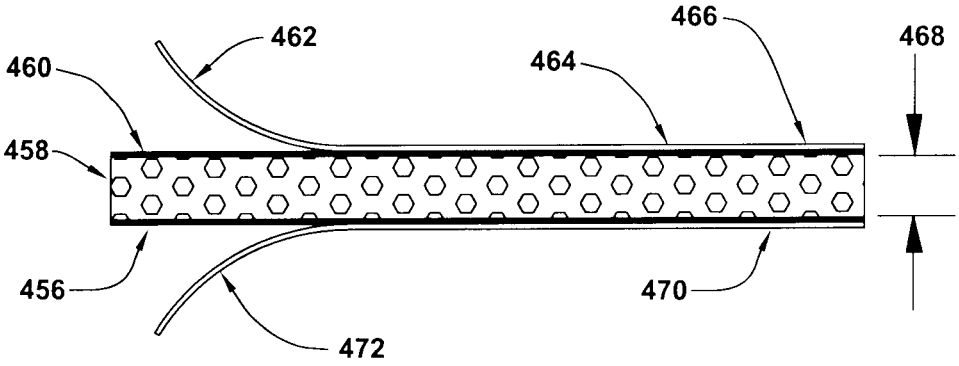
FIG. 17 is a cross section view of a wafer support resilient pad with release liners.

FIG. 17 is a cross section view of a semiconductor wafer support resilient pad with release liners. The resilient wafer pad 458 has a layer of adhesive or low-tack adhesive or coating or an attached flexible polymer film 460 which bonds the wafer (not shown) bottom surface to the wafer pad 458. Also, the wafer pad 458 has a layer of adhesive or low-tack adhesive or coating or an attached flexible polymer film 456 which bonds the wafer pad 458 bottom surface to the wafer workpiece spindle (not shown). The compressible resilient wafer pad 458 has a nominal uncompressed thickness 468 that is uniform over the full surface of the pad 458.

A flexible release liner 464 having a flat surface 466 is releasably attached to the adhesive layer 460 that is present at the top surface of the flexible wafer pad 458 where the release liner 464 can be removed from the adhesive layer 460 without the adhesive layer 460 loosing its adhesive tackiness which allows the flexible wafer pad 458 to be adhesively attached to the flat surface of a workpiece or a wafer workpiece. The leading portion 462 of the release liner 464 can be peeled back to expose the tacky adhesive 460 for flat conformal attachment of the wafer pad 458 to a flat wafer surface.

A flexible release liner 470 having a flat surface is releasably attached to the adhesive layer 456 that is present at the bottom surface of the wafer pad 458 where the release liner 470 can be removed from the adhesive layer 456 without the adhesive layer 456 loosing its adhesive tackiness which allows the flexible wafer pad 458 to be adhesively attached to a rotary workpiece spindle top. The leading portion 472 of the release liner 470 can be peeled back to expose the tacky adhesive 456 for flat conformal adhesive attachment of the wafer pad 458 to the flat surface of a rotary workpiece spindle top.

The flexible release liners 464, 470 can be produced from polymers or organic materials such as paper or silicone rubber where the release liner 464,470 can be coated with non-stick materials such as silicone oils, oils and polytetrafluoroethylene-type materials to provide that the wafer pad 458 adhesive layers 456, 460 remain tacky for long periods of time before the wafer pads 458 are attached to workpieces or workpiece rotary spindles.

Figure 18:
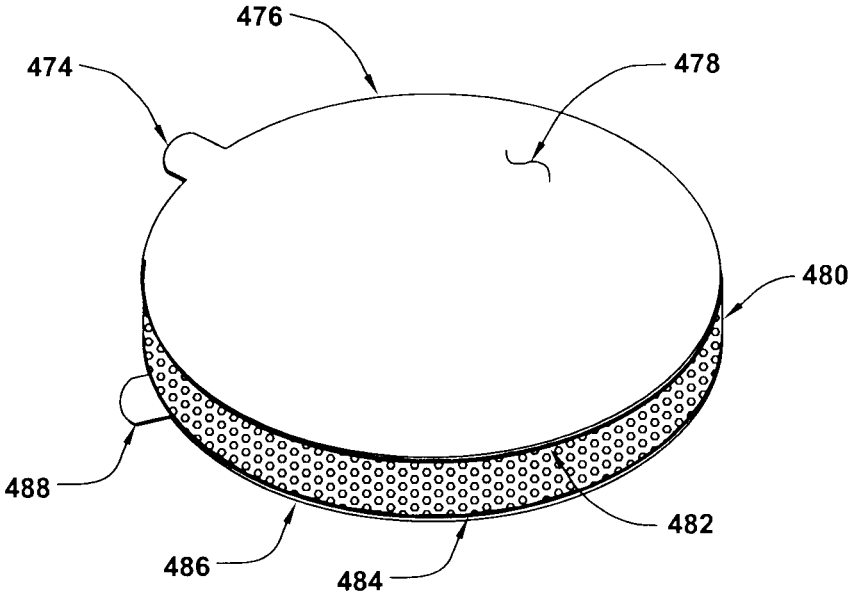
FIG. 18 is an isometric view of a wafer support resilient pad with release liners.

FIG. 18 is an isometric view of a semiconductor wafer support resilient pad with release liners. A semiconductor wafer (not shown) having a flat surface is attached to the top flat surface of a composite resilient wafer pad 480 having a resilient core by a low-tack adhesive layer 482. The resilient pad 480 can be easily removed from the wafer by peeling the flexible pad 480 from the wafer. The resilient pad 480 bottom surface has a low-tack adhesive layer 484 that is covered with a removable release liner 486 that can be removed by use of the tab 488 that is a integral part of the removable release liner 486. The resilient pad 480 top surface low-tack adhesive layer 482 is covered with a removable release liner 476 having a flat surface 476 that can be removed by use of the tab 474 that is a integral part of the removable release liner 476.

Also, the release liners 476, 486 can have split lines (not shown) where the liners have two matching parts that are mutually joined together at a line where one part of the liners 476, 486 can be removed before the other matching remaining part is removed either before or after partial adhesive attachment of the wafer pads 480 on either the workpiece wafers or the workpiece spindles.

Figure 19:
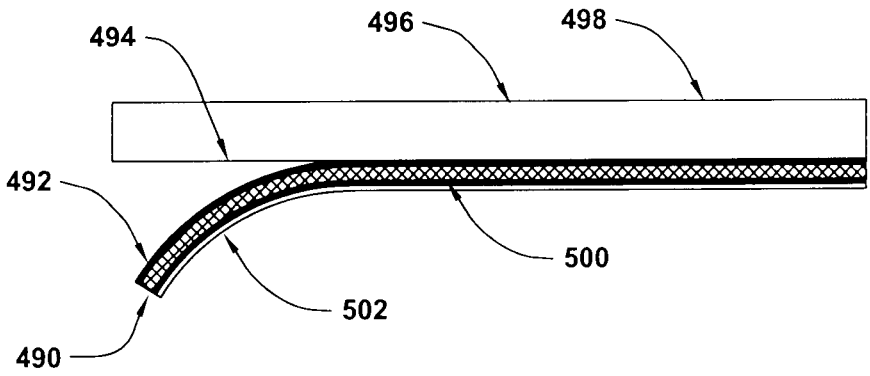
FIG. 19 is a cross section view of a peelable resilient pad attached to a workpiece.

FIG. 19 is a cross section view of a peelable resilient pad attached to a workpiece. A flat-surfaced workpiece 496 having a flat abraded surface 498 and a bottom flat surface 494 is attached at the bottom flat surface 494 to the top flat surface of a composite resilient workpiece wafer pad 490 having a resilient core by a low-tack adhesive layer 492 that is attached to the wafer pad 490. The flexible resilient pad 490 can be easily removed from the wafer 496 surface 494 by peeling the flexible pad 490 from the wafer 496. The resilient pad 490 bottom surface has an adhesive layer 500 that allows a flexible polymer cover 502 to be attached to the flexible pad 490. The vacuum-sealed flexible polymer cover 502 allows the resilient workpiece pad 490 and the attached wafer 496 to be attached to the flat surface of a rotatable workpiece spindle (not shown) by use of vacuum.

Figure 20:
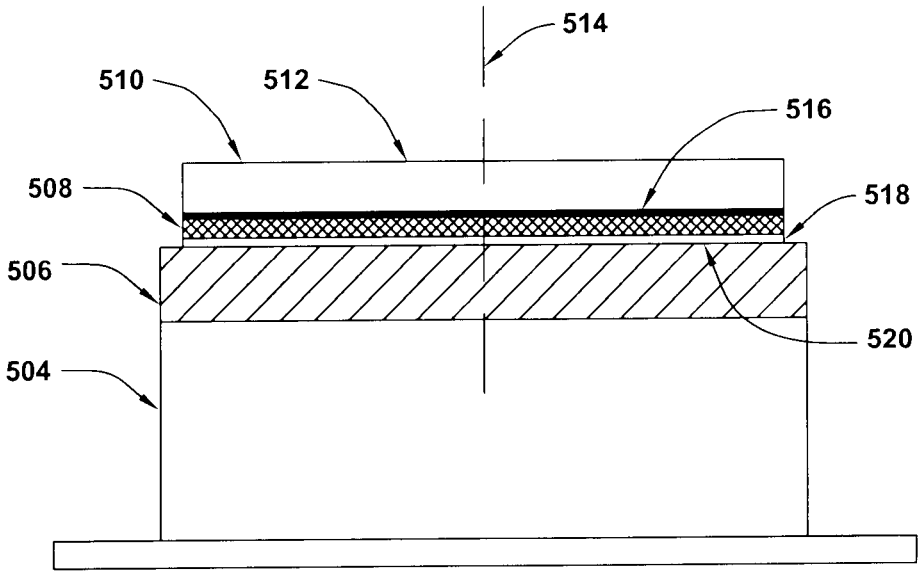
FIG. 20 is a cross section view of a workpiece with a resilient pad attached to a spindle.

FIG. 20 is a cross section view of a workpiece with an attached resilient pad attached to a rotatable workpiece spindle. A flat-surfaced workpiece 510 having a flat abraded surface 512 and a bottom flat surface is attached at the bottom flat surface to the top flat surface of a composite resilient workpiece or wafer pad 508 having a resilient core by a low-tack adhesive layer 516 that is attached to the wafer pad 508.

The resilient workpiece pad 508 bottom surface has an attached flexible polymer cover 518. The vacuum-sealed flexible polymer cover 518 allows the attached resilient workpiece pad 508 and the attached wafer 510 to be attached, by vacuum acting on the vacuum-sealed flexible polymer cover 518, to the flat surface 520 of a workpiece spindle 504 rotatable spindle-top 506 by use of vacuum.

Figure 21:
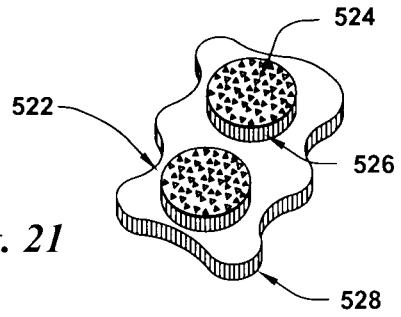
FIG. 21 is an isometric view of fixed-abrasive coated raised islands on an abrasive disk.

FIG. 21 is an isometric view of fixed-abrasive coated raised islands on an abrasive disk. Abrasive particle 524 coated raised islands 526 are attached to an abrasive disk 522 backing 528.

Figure 22:
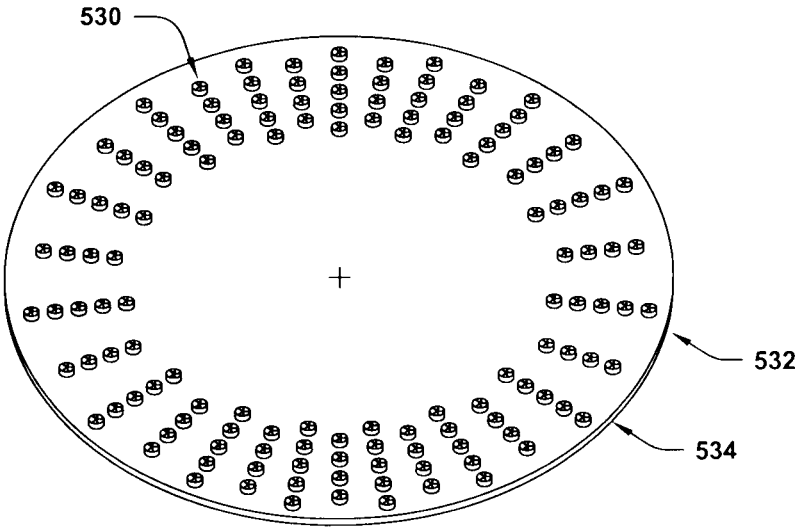
FIG. 22 is an isometric view of a flexible fixed-abrasive coated raised island abrasive disk.

FIG. 22 is an isometric view of a flexible fixed-abrasive coated raised island abrasive disk. Abrasive particle coated raised islands 530 are attached to an abrasive disk 534 backing 532.

Figure 23:
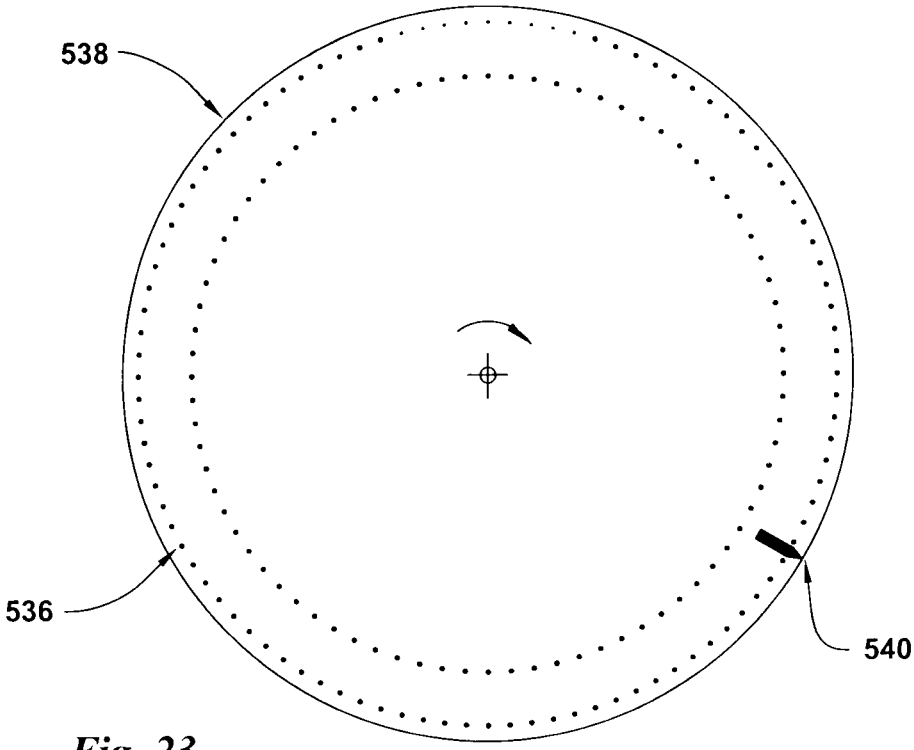
FIG. 23 is a top view of a rotary abrading platen having vacuum port holes.

FIG. 23 is a top view of a rotary abrading platen having vacuum port holes. The rotary platen 538 has rows of vacuum port holes 536 that extend around the circumference of the platen 538. Also, the platen 538 has an indicator marker 540 that is an integral part of the platen 538 where the marker 540 can be used to circumferentially register flexible abrasive disks (not shown) when they are attached to the platen 538. This indicator marker allows the abrasive disks, having a respective indicator mark, to be removed form a platen and be re-attached to the same platen 538 where the original "ground-in" or "dressed" surface of the abrasive disk abrasive is re-established simply by re-attaching the abrasive disk where the abrasive disk indicator mark is tangentially aligned with the abrading platen 538 indicator mark 540.

Figure 24:
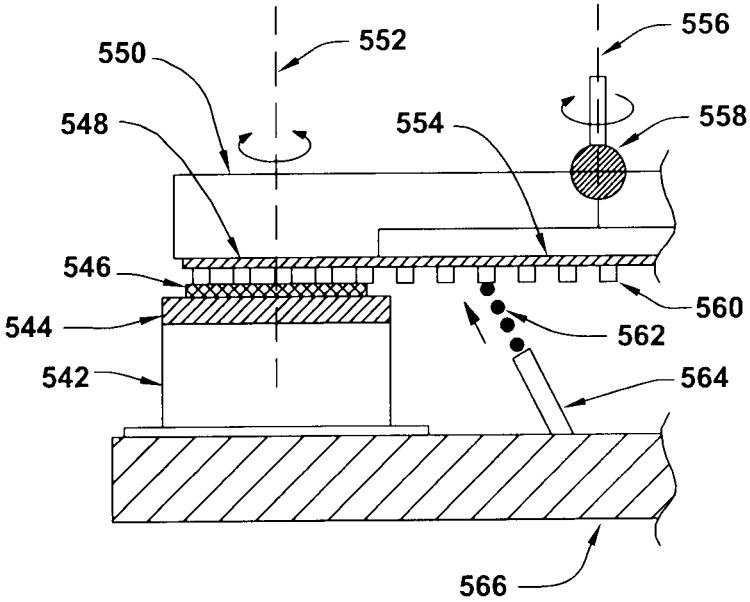
FIG. 24 is a cross section view of raised islands with water coolant to abrade a workpiece.

FIG. 24 is a cross section view of raised island structures on a disk that is used with water coolant to abrade a workpiece that is attached to a fixed-position rotary spindle. An abrasive disk 554 having attached raised island structures 560 is attached to the flat-surfaced abrading-surface 548 of a rotary platen 550 that has a spherical-action mechanism device 558 that allows the platen 550 to float while the platen 550 is rotated about a platen 550 rotation axis 556. A flat-surfaced workpiece 546 is attached to the flat surface of a rotary spindle 542 rotatable spindle-top 544. The spindle 542 is attached to an abrading machine base 566 and the spindle-top 544 rotates about a spindle axis 552. A liquid jet device 564 is attached to the machine base 566 and has a liquid stream of liquid droplets 562 where the liquid 562 comprises water, a slurry liquid that contains abrasive particles, including ceria, and chemicals including abrasive action enhancing chemicals and abrading agents including those used in chemical mechanical planarization (CMP) abrading processes.

Figure 25:
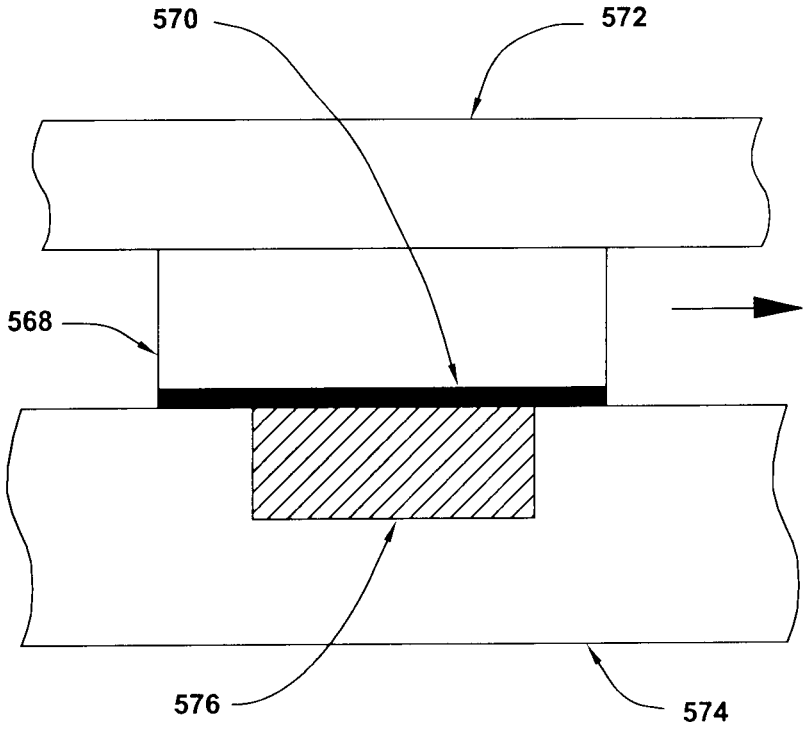
FIG. 25 is a cross section view of a wafer abraded by an abrasive-coated raised island.

FIG. 25 is a cross section view of a semiconductor wafer that is abraded by a flat surfaced abrasive-coated raised island. The raised island abrasive disk 572 has a flexible abrasive disk backing sheet that has raised island structures 568 that are attached to the backing sheet where the abrasive disk 572 is attached to a precision-flat platen (not shown). The raised island 568 has a thin precision thickness abrasive layer 570 that is comprised of a monolayer of abrasive particles or abrasive particle filled abrasive beads or an abrasive particle coating. The abrasive 570 is in flat surface contact with the semiconductor 574 top surface where the flat-surfaced abrasive 570 bridges across the metal paths 576 which are embedded in the surface of the semiconductor wafer 574. The semiconductor wafer 574 has a bottom surface that is supported by a planar support device (not shown). No gouging, dishing or erosion of the metal paths 576 takes place during the abrading action because the flat-surfaced abrasive 570 bridges across the metal paths 576.

Figure 26:
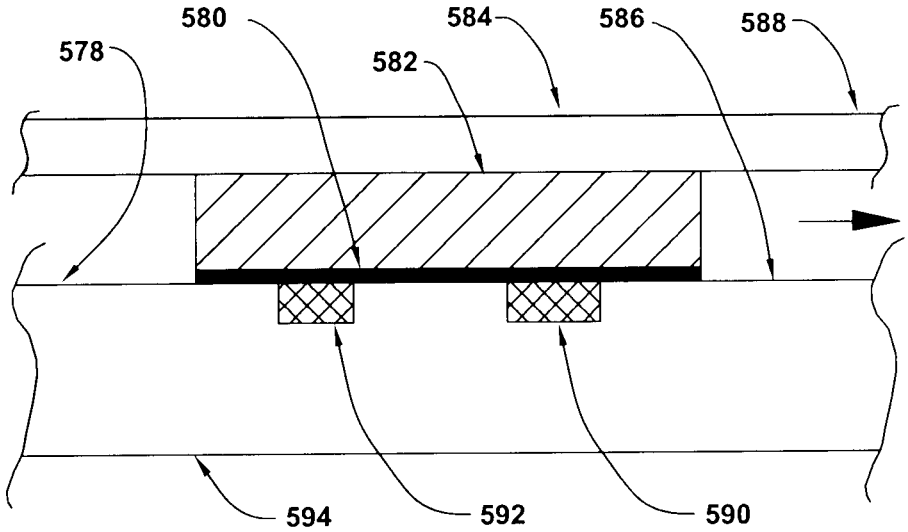
FIG. 26 is a cross section view of a wafer that is abraded by a raised island abrasive disk.

FIG. 26 is a cross section view of a semiconductor workpiece wafer that is abraded by a flat surfaced raised island abrasive disk. The raised island abrasive disk 584 has a flexible abrasive disk backing sheet 588 that has raised island structures 582 that are attached to the backing sheet 588 where the abrasive disk 584 is attached to a precision-flat platen (not shown). The raised island 582 has a thin precision thickness abrasive layer 580 that is comprised of a monolayer of abrasive particles or abrasive particle filled abrasive beads or an abrasive coating. The abrasive 580 is in flat surface contact with the semiconductor wafer 578 top surface 586 where the abrasive 580 bridges across the metal paths 590, 592 which are embedded in the surface 586 of the semiconductor wafer 578. The semiconductor wafer 578 has a bottom surface 594 that is supported by a planar support device (not shown). No gouging, dishing or erosion of the metal paths 590, 592 takes place during the abrading action because the flat-surfaced abrasive 580 bridges across the metal paths 590, 592.

Figure 27:
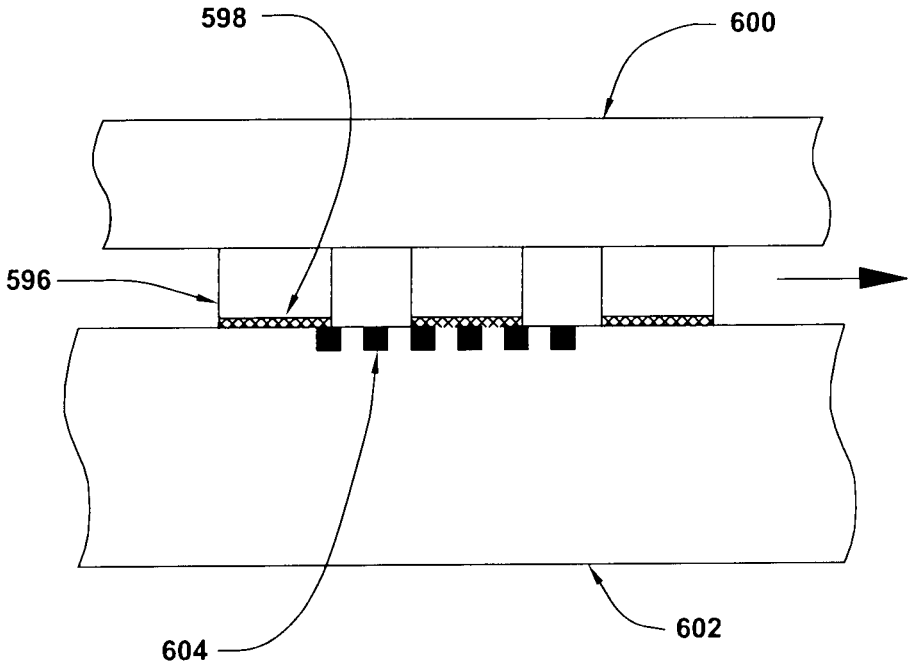
FIG. 27 is a cross section view of a wafer abraded by a raised island abrasive disk.

FIG. 27 is a cross section view of a semiconductor wafer abraded by a flat surfaced raised island abrasive disk. An abrasive disk 600 having attached flat-surfaced raised islands 596 can be attached to precision-flat rotary platens (not shown) to flat lap semiconductor wafers 602 without erosion of soft metal paths 604 portions of the wafer 602 surface. Fixed-abrasive particles 598 are bonded to the flat surface of the individual raised island structures 596 where individual abrasive particles 598 cannot preferentially erode the portions of the wafer 602 where a number of metal interconnect paths 604 are closely grouped together in patterns. These metal interconnect paths 604 regions have a small amount of supporting structure of rigid silicone that is directly adjacent to the individual soft metal paths 604. However, this susceptible metal interconnect path 604 wafer surface region is protected from erosion by the combination of precision-thickness raised island abrasive disks 600 and the rigid precision-flat rotating platen. Here, each individual precision-thickness abrasive islands 596 having precision-flat abrasive particle 598 coated surfaces are held in planar contact with the wafer 602 surface where both the rigid silicone semiconductor material and the soft metal paths 604 are mutually abraded to the same flat condition.

Figure 28:
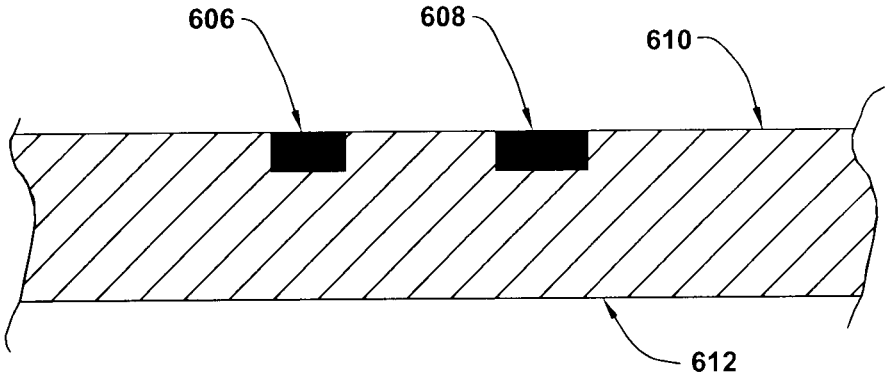
FIG. 28 is a cross section view of a wafer having metal paths abraded by flat raised islands.

FIG. 28 is a cross section view of a semiconductor wafer having metal paths that was abraded by a flat surfaced raised island abrasive disk. A flat-lapped semiconductor wafer 610 is shown that did not experience erosion of soft metal paths 606, 608 portions of the wafer 610 surface by an abrasive disk (not shown) that had flat-surfaced abrasive coated island structures. These metal interconnect paths 606, 608 regions have a small amount of supporting structure of rigid silicone semiconductor wafer material that is directly adjacent to the individual soft metal paths 606, 608. However, these susceptible metal interconnect paths 606, 608 located in this wafer 610 surface region is protected from erosion by the combination of precision-thickness raised island abrasive disks and the rigid precision-flat rotating platen (not shown). Here, each individual precision-thickness abrasive islands having precision-flat abrasive particle coated surfaces are held in planar contact with the wafer 610 surface where both the rigid silicone semiconductor material and the soft metal paths 606, 608 are mutually abraded to the same flat condition having the same surface elevation. The wafer 610 has a flat bottom surface 612.

Wafer Periphery Erosion From CMP Pads

The chemical mechanical planarization (CMP) abrading system is often used to polish semiconductor wafers that are exceedingly flat. Here, a resilient porous pad is saturated with a liquid abrasive slurry mixture and is held in moving contact with the flat-surfaced semiconductor wafers to remove a small amount of material from the top surface of the wafers.

There are a number of disadvantages with this wafer polishing system, including the mess of the liquid abrasive slurry that has to be cleaned off the wafers after polishing. In addition, the abrasive slurry tends to build up a slurry crust on top of the slurry pad which must be broken up with a sharp-edged tool to enable consistent abrading of the wafers. Wafers are typically rotated while in abrading contact with rotating pads, where the net abrading speed on the wafers is a composite speed generated by both the rotating CMP pad and the rotating wafer. CMP polishing is done at very low abrading speeds and only extremely small amounts of material are removed from the wafer surfaces during a polishing operation.

Furthermore, the resilient pad is compressed as it is held in abrading contact with the flat surfaced wafer. The compressed CMP pad assumes a flat profile where it contacts the central portion of the circular wafer. However, the localized portion of the moving resilient CMP pad that comes into contact with the outer periphery of the rotating wafer becomes distorted. This CMP pad distortion tends to produce undesirable above-average material removal at the wafer periphery. This uneven abrading action results in non-flat wafers.

Also, dues to the slow time response dimensional recovery characteristics of the typical CMP pads, the CMP pads must be operated at slow abrading speeds. Resilient pads must be compressed as they come into contact with the wafers that are thrust into the surface depth of the CMP pads. These pads have a viscoelastic behavior when they are subjected to deformation. Rather than compressed pads recovering instantly from a deformed state, they respond slowly. Also, they tend to resist compression even though they are constructed from flexible materials. When a CMP pad is rotated, it constantly experiences compression-distortion as it contacts the leading edge of a wafer. After, a compressed portion of the CMP pad moves away6 from contact with a wafer, it takes some time for the surface of the CMP pad to recover to it's natural uncompressed state. This means that CMP pads can not be operated at high abrading speeds because of the slow time-response of the CMP pad material.

Figure 29:
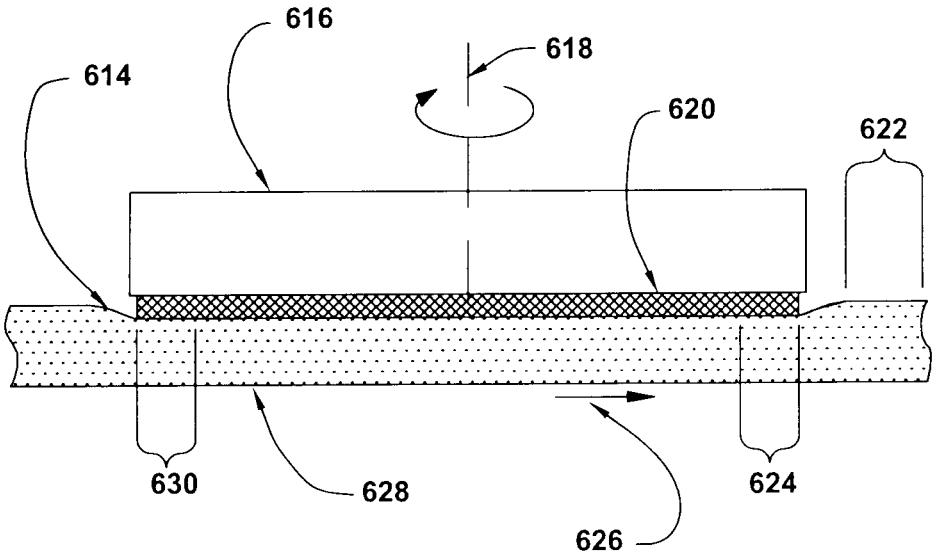
FIG. 29 is a cross section view of a wafer polished by a CMP pad using liquid slurry.

FIG. 29 is a cross section view of a wafer polished by a resilient CMP pad using a liquid abrasive slurry. A resilient CMP pad 628 experiences a pad distortion area 614 at the outer periphery of a flat-surfaced circular semiconductor wafer 620 that is thrust into the surface depth of the resilient CMP pad 628 by a wafer carrier 616. The wafer 620 is rotated about an axis 618 by the rotating wafer carrier 616 while the CMP pad 628 moves in a direction 626 along the abraded surface of the wafer 620. A liquid abrasive slurry mixture (not shown) is applied to the surface of the moving CMP pad 628 to provide material removal from the wafer 620 abraded surface.

When the wafer 620 is thrust down into the localized depths of the distorted CMP pad 628, the CMP pad has a localized distortion area 614 that extends around the outer periphery of the rotating wafer 620. An undistorted portion of the non-compressed CMP pad 628 area 622 extends outward from the perimeter of the wafer 620. When the distorted area 614 of the CMP pad 628 contacts the outer periphery of the wafer 620, a region of extra-high abrading pressure area 630, 624 exists at the outer periphery region of the wafer 620 which results in excessive material removal form the wafer 620 in these periphery region areas 630, 624. This results in undesirable non-uniform material removal across the flat surface of the wafer 620.

Typically, the resilient CMP pads 628 are constructed from open or closed cell foamed polymers or from polymer or organic fiberous materials that will absorb the liquid abrasive slurry mixture and present it for abrading contact with the abraded flat surface of the wafer 620. The material removal is often highest at the extended tips of the individual fibers that contact the wafer 620 surface. Liquid chemicals and other chemicals are applied to soften-up selected portions of the semiconductor wafer materials to enhance their rate of material removal form the surface of the wafer 620. A crust of abrasive slurry tends to develop on the abrading surface of the resilient CMP pads 628 that is continuously or periodically broken-up by surface contact with sharp-toothed CMP pads 628 conditioning tools (not shown).

Here, the wafer CMP pad 628 becomes initially distorted when the wafer carrier 616 is lowered to provide abrading-force controlled abrading of the workpiece wafers 620. This distortion of the CMP pad 628 changes constantly during each revolution of the circular CMP pad 628. Periodic compression and relaxation of different portions of the wafer pads 628 is required during operation of the CMP abrading process. Also, it is necessary to provide uniform abrading pressure contact across the full abraded surface of the wafer 620 with the abrasive surface of the CMP pad 628.

The rotation speed of the CMP pad 628 is highly restrained by slow-response dynamic restoration of the original non-distorted shape of the wafer pad 628 material during each high-speed revolution of the CMP pad 628. These resilient CMP pads 628 can only be operated at slow abrading speeds.

The uneven abrading effects caused by the localized distortion of the resilient CMP pad at the outer periphery of a semiconductor wafer can be minimized by use of a sacrificial ring device. The sacrificial annular ring has a top rounded surface that is positioned where the ring top surface is level with the top surface of the wafer. The movable sacrificial ring is rigidly held in this top-level position by vacuum. The sacrificial ring material is selected to provide the same abrasive wear rate as the wafer so that the ring wears down at the same rate as the wafer during the CMP polishing action.

As the CMP pad translates across the leading edge of the wafer, it becomes distorted when compressed as it encounters the protrusion of the rounded portion of the sacrificial ring. Then the moving pad assumes a level-flat pad surface as it encounters the leading edge of the wafer. It retains this flat-pad configuration as the moving pad translates over the full abraded top surface of the wafer. The result is uniform abrasive material removal across the full flat surface of the wafer.

Figure 30:
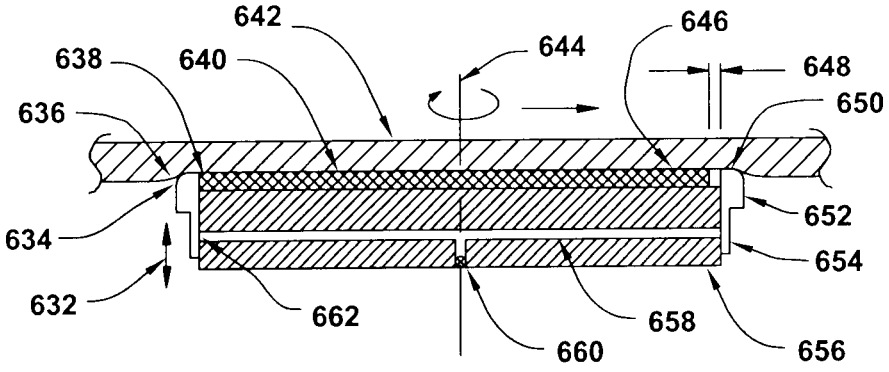
FIG. 30 is a cross section view of a CMP workpiece carrier with a sacrificial ring.

FIG. 30 is a cross section view of a CMP workpiece carrier with a sacrificial ring. A circular-shaped flat-surfaced carrier plate 656 has an attached flat-surfaced workpiece 640 that rotates about an axis 644 and that is in abrading contact with a resilient CMP pad 642 that moves in pressurized abrading contact across the surface 646 of the workpiece 640. A sacrificial annular ring 652 having a top rounded surface 634 is positioned with the ring 652 top surface 650 level with the top surface 646 of the workpiece 640. The sacrificial ring 652 is movable in the direction 632 and is held in this top-level position by vacuum that is introduced through the valve 660 into the passageways 658 where the vacuum applied at 662 deflects the annular ring 652 flex tabs 654 tightly against the circular peripheral body of the workpiece carrier plate 656. There is a space gap 648 that can range from a tight fit and a loose fit between the workpiece 640 and the sacrificial ring 652.

When the CMP pad 642 translates across the leading edge 638 of the workpiece 640, the resilient CMP pad 642 is distorted 636 when it is compressed as it encounters the protrusion of the rounded 634 portion of the sacrificial ring 652 and the pad 642 assumes a level-flat pad 642 surface as it encounters the leading edge 638 of the workpiece 640 and it retains this flat pad 642 configuration as the moving pad 642 translates over the full abraded top surface 646 of the workpiece 640. The rounded 634 portion of the sacrificial ring 652 provides assurance that the liquid abrasive slurry (not shown) is not scrapped-off the surface 646 of the CMP pad 642 by the leading edge of the sacrificial ring 652 whereby the abrasive slurry is carried past the sacrificial ring 652 leading edge by the moving resilient CMP pad 642 where the abrasive slurry is presented for abrading contact with the top surface 646 of the workpiece 640.

Without the sacrificial ring 652, the moving pad 642 would distort as it encounters the leading edge 638 of the workpiece 640 with the result that the leading edge 638 outer periphery portion of the workpiece 640 would become excessively abraded with the result that the workpiece 640 would have an undesired non-flat abraded surface 646. At set-up, the sacrificial ring top surface 650 can be easily positioned level with the workpiece 640 top surface 646 by turning the assembly upside down where both the ring 652 top surface 650 and the workpiece 640 top surface 646 are in full-face contact with a precision-flat plate (not shown), after which vacuum is applied through the valve 660 to firmly attach the ring 652 to the body of the carrier 656 by deflecting the ring 652 flex band 654 against the body of the carrier 656. Both the ring 652 top surface 650 and the workpiece 640 top surface 646 are mutually abraded by the resilient CMP pad 642 but the wear of the ring 652 top surface 650 during one workpiece 640 CMP polishing operation is insignificant relative to the typical amount that the CMP pad 642 is compressed by abrading pressure. In addition, the sacrificial ring 652 can have a composite construction, where the upper wear surface 650 portion of the ring 652 is made of the same material as the workpiece 640 material to provide equal wear-down of both the workpiece 640 and the ring 652 surface 650. The composite sacrificial ring 652 can have a polymer flex-band 654 that will deflect easily when subjected to the vacuum force. Release of the sacrificial ring 652 from the carrier plate 656 is easily accomplished by opening the vacuum valve 660 which allows the sacrificial ring 652 to be used repetitively. The sacrificial ring 652 can have an off-set top or complex-geometry top (not shown) to accommodate workpieces 640 that are smaller than the diameter of the workpiece carrier plate 656 or multiple workpieces 640.

Figure 31:
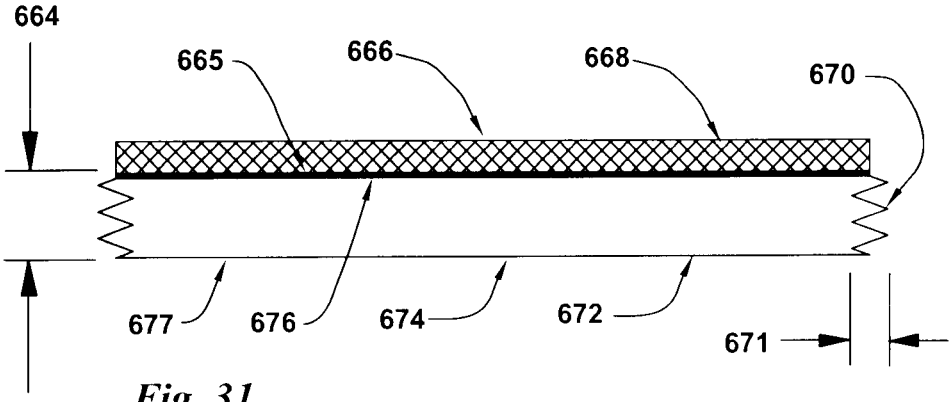
FIG. 31 is a cross section view of a semiconductor wafer with an attached pleated air pad.

FIG. 31 is a cross section view of a semiconductor wafer with an attached pleated air pad. A semiconductor wafer workpiece 666, or other type of workpiece 666, having a flat surface 668 that is abraded is attached to a wafer air pad 677. The wafer air pad 677 has a layer of adhesive or low-tack adhesive or wear resistant coating or an attached flexible polymer film 676 which attaches the wafer 666 bottom surface 665 to the wafer air pad 677. Also, in one embodiment, the wafer air pad 677 has a bottom flexible metal or polymer bottom layer 672 having a flat surface 674. The wafer air pad 677 bottom layer 672 can be a vacuum-sealed layer that allows vacuum to be used where the wafer air pad 677 is attached to a rotary workpiece spindle (not shown) by the vacuum acting on the bottom layer 672 flat surface 674. The wafer air pad 677 has a nominal thickness 664 that is uniform over the full attachment surface 665 of the wafer workpiece 666.

The air contained inside the sealed wafer air pad 677 can be a compressible air or gas. Here, the air inside the wafer air pad 677 provides a uniform pressure for the full flat bottom surface 665 of the wafer 666. When the wafer workpiece 666 is forced downward against the wafer air pad 677 by a rotary abrasive coated platen (not shown), the air pressure is increased inside the wafer air pad 677 and this increased air pressure is applied uniformly across the full bottom surface 665 of the wafer 666 to provide a uniform abrading pressure across the full top surface 668 of the wafer 666.

When the air contained inside the sealed wafer air pad 677 is a compressible, the compressed stiffness of the sealed wafer air pad 677 is a function of the wafer pad 677 thickness 664 where a small thickness 664 provides a stiff wafer air pad 677 which results in small changes of the pad thickness 664 when the attached wafer workpiece 666 is subjected to an applied abrading force. Likewise, a large pad thickness 664 of a wafer pad 677 filled with compressible air provides a low-stiffness wafer air pad 677 which results in large changes of the pad thickness 664 when the attached wafer workpiece 666 is subjected to an applied abrading force.

A sealed wafer air pad 677 having a lager thickness 664 can be partially filled with an incompressible liquid such as water where the remaining wafer pad internal volume can be filled with a compressible air such as air or other gasses. If the volume or equivalent thickness of the compressible gas is small, the overall deflection stiffness of the sealed wafer air pad 677 will be large and there will be small changes of the pad thickness 664 when the semiconductor wafer workpiece 666 is subjected to a given abrading force.

Also, the sealed volume contained within the sealed wafer air pad 677 can be partially or wholly filled with an incompressible liquid such as water, solvents, oils or other organic or inorganic liquids to provide a sealed wafer air pad 677 having a large stiffness. However, when a sealed wafer air pad 677 filled with a liquid is rotated at high speeds, the liquid tends to be thrown to the outer periphery of the sealed wafer air pad 677 which can cause localized disruptions of the uniform liquid pressure inside the sealed wafer air pad 677. Centrifugal forces caused by rotation of the air-filled sealed wafer air pads 677 does not produce undesirable pressure variations inside the sealed wafer air pads 677 because of the low mass density of the contained air.

When a sealed wafer air pad 677 is constructed using pleated annular segments 670, these pleated segments 670 are very flexible in a direction perpendicular to the wafer 666 bottom surface 665. However, these pleated annular segments 670 are very stiff in a lateral direction parallel to the wafer 666 bottom surface 665 and the pleated annular segments 670 resist distortion when the pressure of the air inside the sealed wafer air pad 677 is raised when the attached wafer workpiece 666 is subjected to a increased abrading force.

Use of thick construction materials and short pleated lengths 671 to fabricate the pleated annular segments 670 increases the stiffness of the pleated annular segments 670 in both perpendicular and lateral directions. Use of long pleated lengths 671 results in lower stiffness of the pleated annular segments 670 in a perpendicular direction to the wafer 666 bottom surface 665 and but results in higher stiffness of the pleated annular segments 670 in a lateral direction parallel to the wafer 666 bottom surface 665. When the pleated annular segments 670 are stiff in a lateral direction parallel to the wafer 666 bottom surface 665, the pleated annular segments 670 resist distortion when the pressure of the air inside the sealed wafer air pad 677 is raised. Here, the stiffness of the sealed wafer air pad 677 in a direction perpendicular to the wafer 666 bottom surface 665 is maintained because the air-containing volume of the sealed wafer air pad 677 does not increase because the pleated annular segments 670 resist distortion due to the stiffness of the pleated annular segments 670.

The thickness of the sheet material used to produce the pleated annular segments 670 can range from 0.002 inches (1 microns) to 0.020 inches (0.51 mm) and the pleated annular segments 670 pleated lengths 671 can range from 0.10 inches (0.25 cm) to 1.5 inches (3.8 cm). The pleated annular segments 670 can be cut out from sheet material and annular-edge-joined together with adhesives, brazing or welding to form the flexible pleated annular segments 670. The high stiffness of the pleated annular segments 670 in a lateral direction parallel to the wafer 666 bottom surface 665 is important to prevent distortion of the sealed wafer air pad 677 by abrading forces that are imposed on the sealed wafer air pad 677 by the moving abrasive that contacts the attached wafer 666 top flat abraded surface 668 in a lateral direction that is parallel to the wafer 666 bottom surface 665 and the wafer 666 top flat abraded surface 668.

When air is injected into the wafer air pads 677 to fill the sealed wafer pads 677 with air, it is preferred that the thicknesses 664 of the wafer air pads 677 are equal for sets of multiple wafer pads 677 that are attached to the rotary spindle tops (not shown) to provide uniform simultaneous abrading for all of the attached wafers 666 by an abrasive coated rotary platen.

Uniform-thickness or non-uniform-thickness flat-surfaced wafer workpieces 666 or non-wafer workpieces are attached to air wafer pads 677 that are attached to the spindles rotary spindle-tops top flat surfaces by vacuum, adhesives, low-tack adhesives, mechanical fastener, electro-static, liquid surface tension, or other, wafer pad 677 attachment devices. The workpieces 666 can be attached to the air wafer pads 677 by vacuum, adhesives, low-tack adhesives, mechanical fastener, electro-static, liquid surface tension, or other, wafer pad 677 attachment devices 676. Here, the top surfaces 668 of wafer workpieces 666 are mutually contacted by the abrading surface of an annular flexible abrasive disk (not shown) that is attached to the precision-flat annular surface of the floating rotary platen.

The air wafer pads 677 can also be used with workpieces 666 in other abrading operations such as for CMP (chemical mechanical planarization) operations. Further, the air wafer pads 677 can be used to support other workpieces 666 comprising optical devices, fiber optics devices, mechanical air seal devices for use in other abrading operations such as lapping, grinding, flat honing and micro-grinding operations.

The air workpiece pads 677 nominally have the same diameter as the circular wafers or workpieces 666 but the air pads 677 can have larger or smaller diameters than the wafers 666. The air pads 677 can have a pad 677 non-compressed thickness 664 that is uniform across the full flat surface of the pads 677 where the pad 677 nominal thicknesses 664 ranges from 0.005 inches (0.0127 cm) to 0.50 inches (1.27 cm). The air pads 677 can be constructed from materials comprising metal materials, polymer materials, open or closed cell foamed polymer materials, synthetic or organic fiber materials and can be constructed as laminated pads 677 or constructed as composite pads 677 that are comprised of the construction materials defined here.

Figure 32:
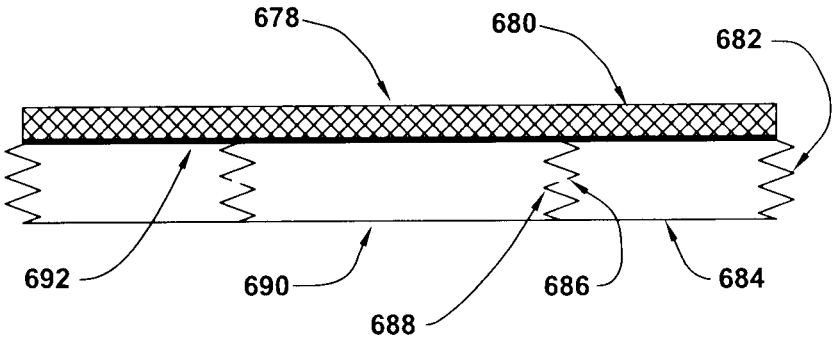
FIG. 32 is a cross section view of a wafer attached to a pleated wafer air pad.

The air pads 677 can be used with non-circular workpieces 666 that have rectangular abraded-surface shapes, elliptical abraded-surface shapes, irregular abraded-surface shapes, incongruous or non-continuous abraded-surface shapes, or other non-circular abraded-surface shapes. The air pads 677 can nominally have the same flat-surfaced shape as the flat-surfaced periphery outline shapes of the abraded-surface of the workpieces 666. Also, the air pads 677 can have flat-surfaced shapes that are larger or smaller than the workpieces' 666 flat-surfaced abraded-surfaces FIG. 32 is a cross section view of a wafer attached to a wafer air pad that has multiple pleated sections. To provide added stiffness to a wafer air pad 690 for improved resistances to abrading forces that are applied parallel to the flat abraded surface 680 of a wafer 678, one or more additional sets of pleated annular segments 688 are incorporated into the interior of the wafer air pad 690 in addition to the wafer air pad 690 periphery pleated annular segments 682. These additional sets of pleated annular segments 688 are flexible in a direction that is perpendicular to the flat abraded surface 680 of the wafer 678 but are very stiff in a direction that is parallel to the flat abraded surface 680 of the wafer 678.

Port holes 686 are incorporated in the pleated annular segments 688 to provide equalized air pressure in the full volume contained in the air-filled sealed wafer air pad 690. The wafer 678 is attached to the wafer air pad 690 having a flat bottom surface 684 by a low-tack adhesive 692.

Figure 33:
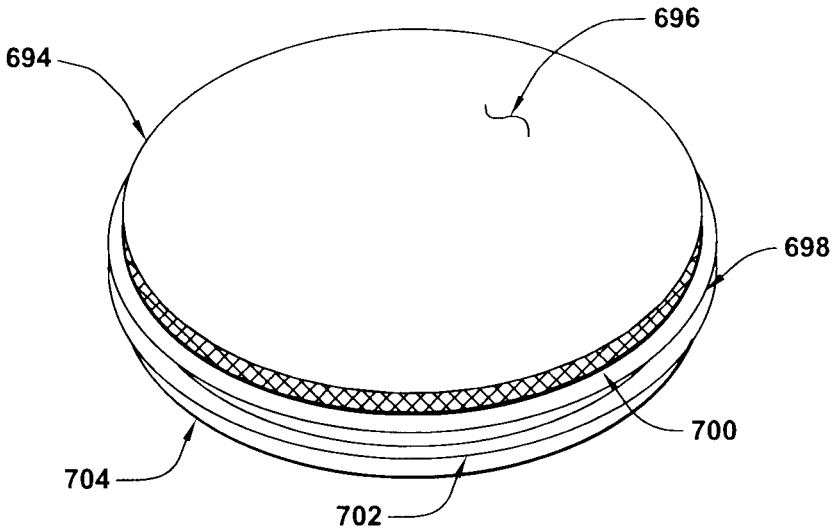
FIG. 33 is an isometric view of a semiconductor wafer with an attached pleated air pad.

FIG. 33 is an isometric view of a semiconductor wafer with an attached pleated air pad. A semiconductor wafer 694 having a flat surface 696 is attached to a air pad 698 by an low-tack adhesive layer 700. The air pad 698 can be easily removed from the wafer 694 by peeling the flexible pad 698 from the wafer 694. The air pad 698 is shown with pleated annular segments 702 where the air pad 698 has a flat surfaced bottom 704 where the pad 698 can be attached to a rotary workpiece spindle (not shown) by applying vacuum to the pad continuous sealed bottom 704.

Figure 34:
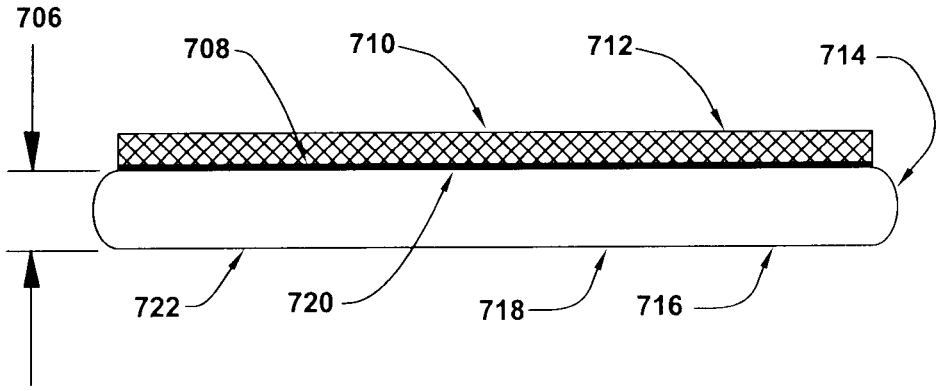
FIG. 34 is a cross section view of a semiconductor wafer with an attached sealed air pad.

FIG. 34 is a cross section view of a semiconductor wafer with an attached sealed diaphragm-type air pad. A diaphragm-type wafer air pad 722 is filled with air where the wafer air pad 722 is attached with adhesive 720 to the bottom flat surface 708 of a wafer 710 having a flat abraded surface 712. The sealed diaphragm-type wafer air pad 722 has a rounded annular periphery 714 where the sealed diaphragm-type wafer air pad 722 has a thickness 706 and a bottom surface 718 that is a flat surface 716.

When air is injected into the wafer air pads 722 to fill the sealed wafer pads 722 with air, it is preferred that the thicknesses 706 of the wafer air pads 722 are equal for sets of multiple wafer pads 722 that are attached to the rotary spindle tops (not shown) to provide uniform simultaneous abrading for all of the attached wafers (not shown) by an abrasive coated rotary platen (not shown).

Figure 35:
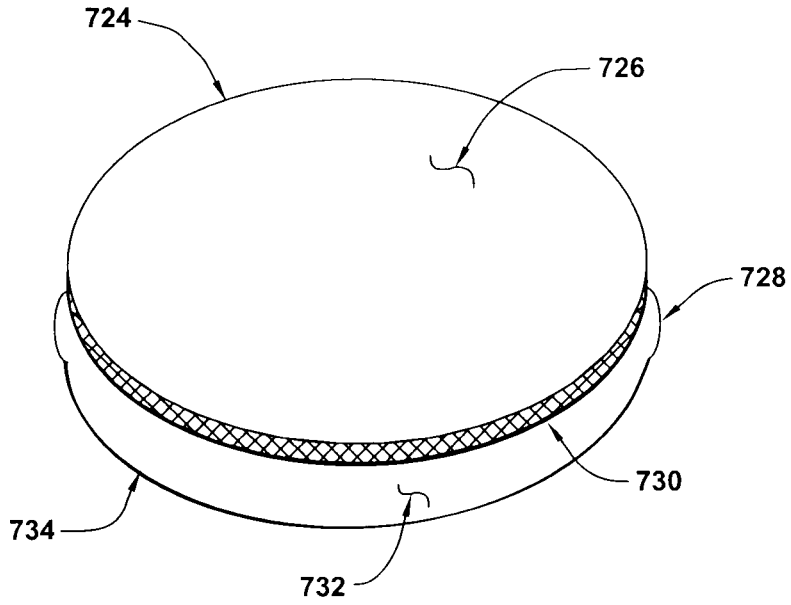
FIG. 35 is an isometric view of a semiconductor wafer with a diaphragm-type air pad.

FIG. 35 is an isometric view of a semiconductor wafer with an attached diaphragm-type air pad. A semiconductor wafer 724 having a flat surface 726 is attached to an air pad 728 by an low-tack adhesive layer 730. The diaphragm-type air pad 728 can be easily removed from the wafer 724 by peeling the flexible pad 728 from the wafer 724. The air pad 728 is shown with rounded-edge annular periphery 732 where the air pad 728 has a flat surfaced bottom 734 where the pad 728 can be attached to a rotary workpiece spindle (not shown) by applying vacuum to the pad continuous sealed bottom 734.

Figure 36:
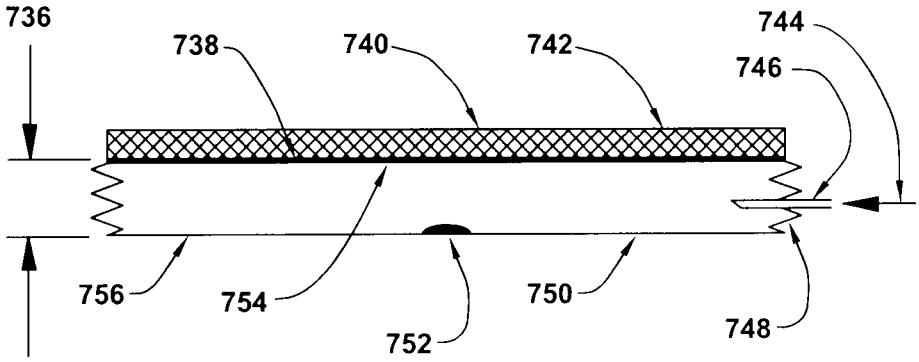
FIG. 36 is a cross section view of a wafer with an attached sealed air-filled pleated air pad.

FIG. 36 is a cross section view of a semiconductor wafer with an attached sealed air-filled pleated air pad. A semiconductor wafer workpiece 740, or other type of workpiece 740, having annular flexible pleated polymer or annular flexible pleated metal sheet stock 748 and having a flat surface 742 that is abraded is attached to a wafer air pad 756. The wafer air pad 756 has a layer of adhesive or low-tack adhesive or coating or an attached flexible polymer film 754 which attaches the wafer 740 bottom surface 738 to the wafer air pad 756. Also, in one embodiment, the wafer air pad 756 has a bottom flexible metal or polymer bottom layer 750 having a flat surface. The wafer air pad 756 bottom layer 750 can be a vacuum-sealed layer that allows vacuum to be used where the wafer air pad 756 is attached to a rotary workpiece spindle (not shown) by the vacuum acting on the bottom layer 750 flat surface. The wafer air pad 756 has a nominal thickness 736 that is uniform over the full attachment surface 738 of the wafer workpiece 740.

When air 744 is injected into the wafer air pads 756 to fill the sealed wafer pads 756 with air, it is preferred that the thicknesses 736 of the wafer air pads 756 are equal for sets of multiple wafer pads 756 that are attached to the rotary spindle tops (not shown) to provide uniform simultaneous abrading for all of the attached wafers 740 by an abrasive coated rotary platen. Use of wafer air pads 756 having precisely equal thicknesses 736 reduces tilting of the rotary abrasive coated platen (not shown) that is used to abrade the top exposed surfaces 742 of the equal-thickness semiconductor wafer workpiece 740, or other type of workpiece 740, that are typically flat-lapped or polished using sets of at least three rotary workpiece spindles.

Air 744 can be injected into the sealed interior of the wafer air pad 756 with the use of a sharp-edge hypodermic needle 746 or another alternative device to inflate the wafer air pad 756 to obtained a controlled the wafer air pad 756 nominal thickness 736 to have a nominal thickness 736 that is within a specified nominal thickness variation that is less than 0.200 inches (0.51 cm) or preferred to be within 0.050 inches (0.13 cm), more preferred to be within 0.010 inches (0.025 cm) and most preferred to be within 0.005 inches (0.013 cm). After the air 744 is injected into the sealed interior of the wafer air pad 756, the sharp-edge hypodermic needle 746 is withdrawn from the wafer air pad 756 or another alternative inflation device is disconnected from the wafer air pad 756 and the wafer air pad 756 is sealed to lock the air 744 inside the sealed wafer air pad 756. Air 744 can also be injected into the wafer air pad 756 at a sealable port-hole device 752 that is sealed when the sharp-edge hypodermic needle 746 is withdrawn from the wafer air pad 756 or another alternative inflation device is disconnected from the wafer air pad 756. The sealable port-hole device 752 can be positioned at various alternative locations on the body of the wafer air pad 756.

Figure 37:
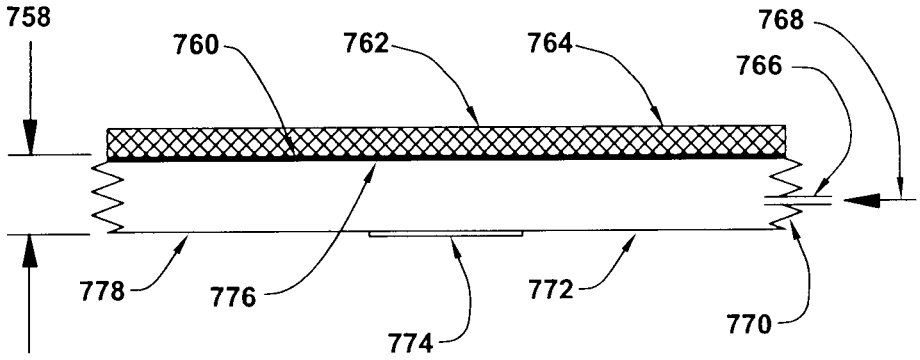
FIG. 37 is a cross section view of a wafer with a pleated air pad having a sealable air tube.

FIG. 37 is a cross section view of a semiconductor wafer with an attached sealed air-filled pleated air pad having a sealable air tube and a tape-sealed air injection port hole. A semiconductor wafer workpiece 762, or other type of workpiece 762, having annular flexible pleated polymer or annular flexible pleated metal sheet stock 770 and having a flat surface 764 that is abraded is attached to a wafer air pad 778. The wafer air pad 778 has a layer of adhesive or low-tack adhesive or coating or an attached flexible polymer film 776 which attaches the wafer 762 bottom surface 760 to the wafer air pad 778. Also, in one embodiment, the wafer air pad 778 has a bottom flexible metal or polymer bottom layer 772 having a flat surface. The wafer air pad 778 bottom layer 772 can be a vacuum-sealed layer that allows vacuum to be used where the wafer air pad 778 is attached to a rotary workpiece spindle (not shown) by the vacuum acting on the bottom layer 772 flat surface. The wafer air pad 778 has a nominal thickness 758 that is uniform over the full attachment surface 760 of the wafer workpiece 762.

When air 768 is injected into the wafer air pads 778 to fill the sealed wafer pads 778 with air, it is preferred that the thicknesses 758 of the wafer air pads 778 are equal for sets of multiple wafer pads 778 that are attached to the rotary spindle tops (not shown) to provide uniform simultaneous abrading for all of the attached wafers 762 by an abrasive coated rotary platen. Use of wafer air pads 778 having precisely equal thicknesses 758 reduces tilting of the rotary abrasive coated platen (not shown) that is used to abrade the top exposed surfaces 764 of the equal-thickness semiconductor wafer workpiece 762, or other type of workpiece 762, that are typically flat-lapped or polished using sets of at least three rotary workpiece spindles.

Air 768 can be injected into the sealed interior of the wafer air pad 778 with the use of a hollow tube 766 that can be used to inflate the wafer air pad 778 where the hollow tube 766 can be sealed with heat or sealed with adhesives after the wafer air pad 778 is inflated with air to a selected nominal thickness 758. Also, air 768 can also be injected into the wafer air pad 778 at a selected location where a layer of flexible sealing tape 774 is used to seal the access hole where air 768 was injected into the interior of the wafer air pad 778 or another alternative inflation device is disconnected from the wafer air pad 778. The sealable tape 774 can be positioned at various alternative locations on the body of the wafer air pad 778.

Figure 38:
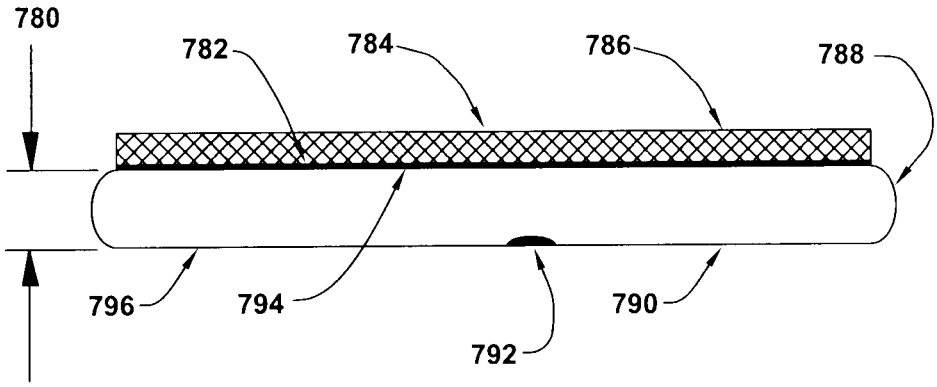
FIG. 38 is a cross section view of a wafer with an attached sealed diaphragm-type air.

FIG. 38 is a cross section view of a semiconductor wafer with an attached sealed diaphragm-type air pad and a sealable air injection port. A diaphragm-type wafer air pad 796 is filled with air where the wafer air pad 796 is attached with adhesive 794 to the bottom flat surface 782 of a wafer 784 having a flat abraded surface 786. The sealed diaphragm-type wafer air pad 796 has a rounded annular periphery 788 where the sealed diaphragm-type wafer air pad 796 has a thickness 780 and a bottom surface 782 that is a flat surface 790.

When air is injected into the wafer air pads 796 to fill the sealed wafer pads 796 with air, it is preferred that the thicknesses 780 of the wafer air pads 796 are equal for sets of multiple wafer pads 796 that are attached to the rotary spindle tops (not shown) to provide uniform simultaneous abrading for all of the attached wafers (not shown) by an abrasive coated rotary platen (not shown).

Air can also be injected into the wafer air pad 796 at a sealable port-hole device 792 that is sealed when a sharp-edge hypodermic needle (not shown) is withdrawn from the wafer air pad 796 or another alternative inflation device is disconnected from the wafer air pad 796. The sealable port-hole device 792 can be positioned at various alternative locations on the body of the wafer air pad 796.

Figure 39:
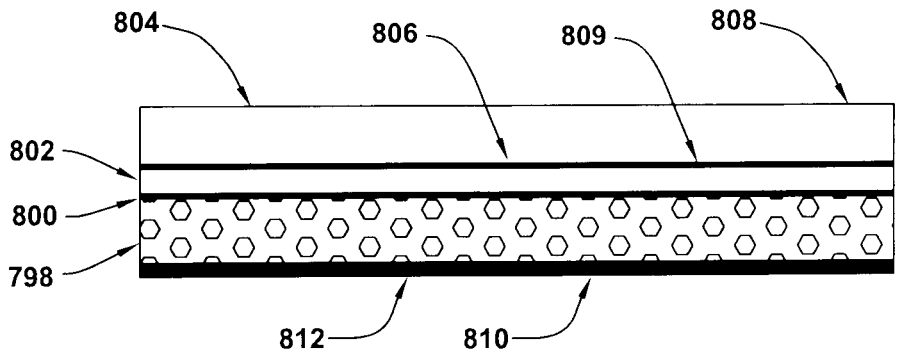
FIG. 39 is a cross section view of a wafer with an attached resilient pad surface plate.

FIG. 39 is a cross section view of a semiconductor wafer with an attached resilient pad that has a surface plate. A semiconductor wafer workpiece 804, or other type of workpiece 804, having a flat surface 808 that is abraded is attached to a flat plate 802 that is attached to a compressible resilient wafer pad 798. The wafer pad 798 has a layer of adhesive or low-tack adhesive or coating or an attached flexible polymer film 800 which attaches the flat plate 802 to the wafer pad 798. The flat plate 802 is attached to the wafer 804 bottom surface 806 by a layer of adhesive or low-tack adhesive or coating or an attached flexible polymer film 800 or by surface tension forces where the attachment layer 809 is a film of water.

Uniform-thickness or non-uniform-thickness flat-surfaced wafer workpieces 804 or non-wafer workpieces 804 can be attached to the flat plate 802 where the workpieces 804 can be attached by a low-tack adhesive, mechanical fasteners, electro-statics 809 or a surface-tension-causing film of water 809 that allows the workpieces 804 to be easily separated from the flat plate 802 after the abrading action is completed on the workpiece 804 flat abraded surface 808. Here, the top surfaces 808 of wafer workpieces 804 are mutually contacted by the abrading surface of an annular flexible abrasive disk (not shown) that is attached to the precision-flat annular surface of a floating rotary platen (not shown).

The resilient wafer pads 798 can also be used with workpieces 804 in other abrading operations such as for CMP (chemical mechanical planarization) operations. Further, the resilient wafer pads 798 can be used to support other workpieces 804 comprising optical devices, fiber optics devices, mechanical fluid seal devices for use in other abrading operations such as lapping, grinding, flat honing and micro-grinding operations.

The wafer pad 798 layer 810 can be a vacuum-sealed layer that allows vacuum to be used where the wafer pad 798 is attached to a rotary workpiece spindle (not shown) by the vacuum acting on the wafer pad 798 layer 810 flat surface 812. The compressible resilient wafer pad 798 has a nominal uncompressed thickness that is uniform over the full surface of the pad 798.

Figure 40:
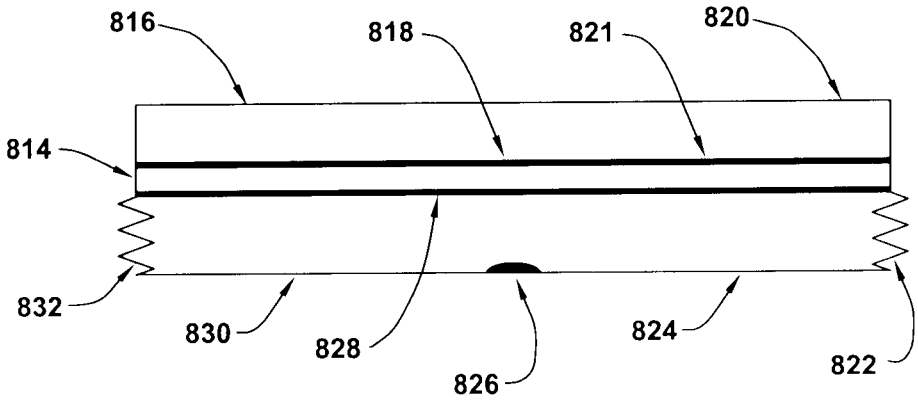
FIG. 40 is a cross section view of a wafer with an attached air pad that has a surface plate.

FIG. 40 is a cross section view of a semiconductor wafer with an attached compressible air pad that has a surface plate. A semiconductor wafer workpiece 816, or other type of workpiece 816, having a flat surface 820 that is abraded is attached to a flat plate 814 that is attached to a compressible pleated wafer air pad 832. The wafer air pad 832 has a layer of adhesive or low-tack adhesive or coating or an attached flexible polymer film 828 which attaches the flat plate 814 to the wafer air pad 832. The flat plate 814 is attached to the wafer 816 bottom surface 818 by a layer of adhesive or low-tack adhesive or coating or an attached flexible polymer film 821 or by surface tension forces where the attachment layer 821 is a film of water.

Uniform-thickness or non-uniform-thickness flat-surfaced wafer workpieces 816 or non-wafer workpieces 816 can be attached to the flat plate 814 where the workpieces 816 can be attached by a low-tack adhesive, mechanical fasteners, electro-statics 821 or a surface-tension-causing film of water 821 that allows the workpieces 816 to be easily separated from the flat plate 814 after the abrading action is completed on the workpiece 816 flat abraded surface 820. Here, the top surfaces 820 of wafer workpieces 816 are mutually contacted by the abrading surface of an annular flexible abrasive disk (not shown) that is attached to the precision-flat annular surface of a floating rotary platen (not shown).

The pleated wafer air pads 832 can also be used with workpieces 816 in other abrading operations such as for CMP (chemical mechanical planarization) operations. Further, the pleated wafer air pads 832 can be used to support other workpieces 816 comprising optical devices, fiber optics devices, mechanical fluid seal devices for use in other abrading operations such as lapping, grinding, flat honing and micro-grinding operations.

The wafer air pad 832 bottom layer 824 having a flat surface 830 can be a vacuum-sealed layer that allows vacuum to be used where the wafer air pad 832 is attached to a rotary workpiece spindle (not shown) by the vacuum acting on the wafer air pad 832 layer 824 flat surface 830. The compressible pleated wafer air pad 832 has a nominal uncompressed thickness that is uniform over the full surface 830 of the pad 832. The wafer air pad 832 layer 824 having flexible annular pleats 822 can have a sealable air injection port-hole device 826 that is used to inject air into the interior of the sealed wafer air pad 832.

Figure 41:
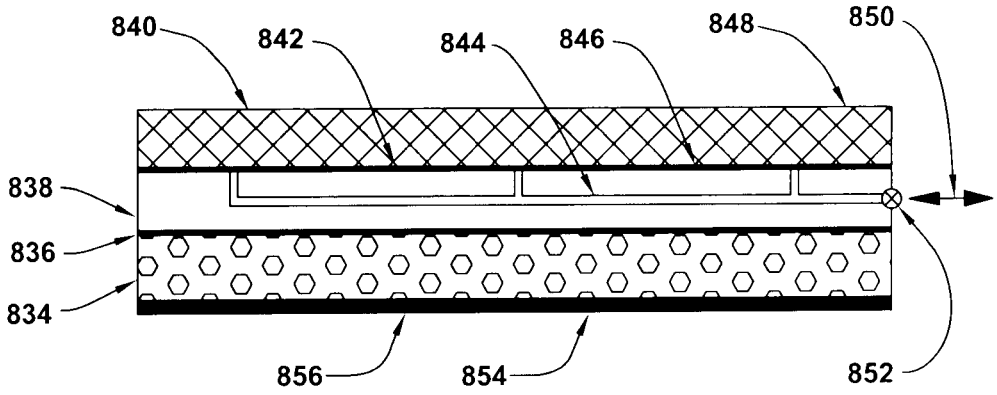
FIG. 41 is a cross section view of a wafer with an attached water-wetted surface plate.

FIG. 41 is a cross section view of a semiconductor wafer with an attached resilient pad that has a water-wetted surface plate having vacuum ports. A semiconductor wafer 840, or other type of workpiece 840, having a flat surface 848 that is abraded is attached to a flat plate 838 that is attached to a compressible resilient wafer pad 834. The wafer pad 834 has a layer of adhesive or low-tack adhesive or coating or an attached flexible polymer film 836 which attaches the flat plate 838 to the wafer pad 834. The flat plate 838 is attached to the wafer 840 bottom surface 842 by surface tension forces where the attachment layer 846 is a film of water 846.

Wafers 840 can be attached to the flat plate 838 where the workpieces 840 can be attached by surface-tension-causing film of water 846 that allows the wafer 840 to be easily separated from the flat plate 838 after the abrading action is completed on the wafer 840 flat abraded surface 848. To enhance the attachment of the water film 846 wetted wafer 840 to the flat plate 838, vacuum 850 can be applied through a self-sealing or manual valve 852 where vacuum is present in the flat plate 838 fluid passageways 844. The wafers 840 can be easily drawn into flat conformal contact with the water 846 wetted flat plate 838 where surface tension forces from the water film 846 will bond the wafer 840 to the wetted flat plate 838 even when the vacuum not longer exists in the passageways 844. To enhance separation of the wafer 840 from the wetted flat plate 838, positive fluid pressure 850 can be applied to the valve 852 where it enters the passageways 844 and gently lifts the wafer 840 from the flat plate 838.

Here, the top surfaces 848 of wafer workpieces 840 are mutually contacted by the abrading surface of an annular flexible abrasive disk (not shown) that is attached to the precision-flat annular surface of a floating rotary platen (not shown).

The resilient wafer pads 834 can also be used with workpieces 840 in other abrading operations such as for CMP (chemical mechanical planarization) operations. Further, the resilient wafer pads 834 can be used to support other workpieces 840 comprising optical devices, fiber optics devices, mechanical fluid seal devices for use in other abrading operations such as lapping, grinding, flat honing and micro-grinding operations.

The wafer pad 834 layer 854 can be a vacuum-sealed layer that allows vacuum to be used where the wafer pad 834 is attached to a rotary workpiece spindle (not shown) by the vacuum acting on the wafer pad 834 layer 854 flat surface 856. The compressible resilient wafer pad 834 has a nominal uncompressed thickness that is uniform over the full surface of the pad 834.

Figure 42:
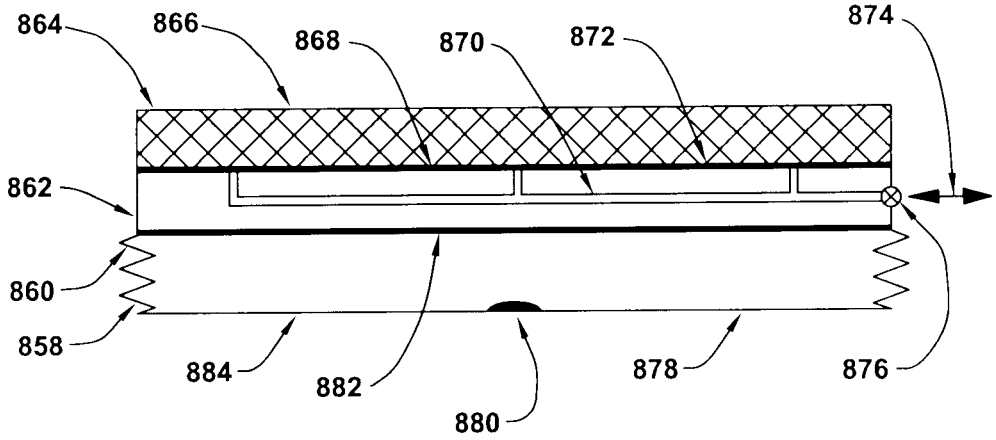
FIG. 42 is a cross section view of a wafer with an air pad water-wetted plate with vacuum.

FIG. 42 is a cross section view of a semiconductor wafer with an attached compressible air pad that has a water-wetted surface plate with vacuum ports. A semiconductor wafer workpiece 864, or other type of workpiece 864, having a flat surface 866 that is abraded is attached to a flat plate 862 that is attached to a compressible pleated wafer air pad 858. The wafer air pad 858 has a layer of adhesive or low-tack adhesive or coating or an attached flexible polymer film 882 which attaches the flat plate 862 to the wafer air pad 858. The flat plate 862 is attached to the wafer 864 bottom surface 868 by a layer of adhesive or low-tack adhesive or coating or an attached flexible polymer film 872 or by surface tension forces where the attachment layer 872 is a film of water.

Wafers 864 can be attached to the flat plate 862 by a surface-tension-causing film of water 872 that allows the wafers 864 to be easily separated from the flat plate 862 after the abrading action is completed on the workpiece 864 flat abraded surface 866. Here, the top surfaces 866 of wafer workpieces 864 are mutually contacted by the abrading surface of an annular flexible abrasive disk (not shown) that is attached to the precision-flat annular surface of a floating rotary platen (not shown).

Wafer workpieces 864 can be attached by surface-tension-causing film of water 872 that allows the workpieces 864 to be easily separated from the flat plate 862 after the abrading action is completed on the workpiece 864 flat abraded surface 866. To enhance the attachment of the water film 872 wetted wafers 864 to the flat plate 862, vacuum 874 can be applied through a self-sealing or manual valve 876 where vacuum is present in the flat plate 862 fluid passageways 870. The wafer workpieces 864 can be easily drawn into flat conformal contact with the water 872 wetted flat plate 862 where surface tension forces from the water film 872 will bond the wafers 864 to the wetted flat plates 862 even when the vacuum not longer exists in the passageways 870. To enhance separation of the wafer 864 from the water 872 wetted flat plate 862 positive fluid pressure 874 can be applied to the valve 876 where it enters the passageways 870 and gently lifts the wafer 864 from the flat plate 862.

The pleated wafer air pads 858 can also be used with workpieces 864 in other abrading operations such as for CMP (chemical mechanical planarization) operations. Further, the pleated wafer air pads 858 can be used to support other workpieces 864 comprising optical devices, fiber optics devices, mechanical fluid seal devices for use in other abrading operations such as lapping, grinding, flat honing and micro-grinding operations.

The wafer air pad 858 bottom layer 878 having a flat surface 884 can be a vacuum-sealed layer that allows vacuum to be used where the wafer air pad 858 is attached to a rotary workpiece spindle (not shown) by the vacuum acting on the wafer air pad 858 layer 878 flat surface 884. The compressible pleated wafer air pad 858 has a nominal uncompressed thickness that is uniform over the full surface 884 of the pad 858. The wafer air pad 858 layer 878 having flexible annular pleats 860 can have a sealable air injection port-hole device 880 that is used to inject air into the interior of the sealed wafer air pad 858.

Figure 43:
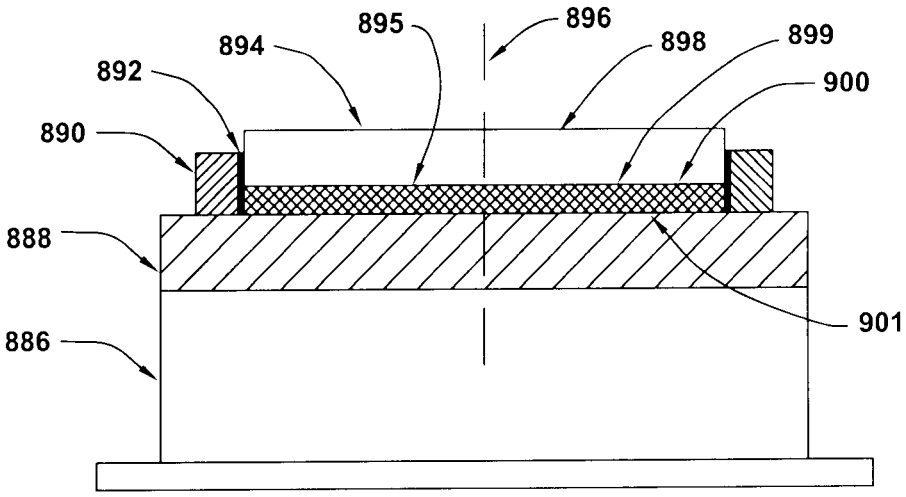
FIG. 43 is a cross section view of a workpiece contained in a ring with a resilient pad.

FIG. 43 is a cross section view of a workpiece contained in a annular ring with a resilient pad. A flat-surfaced workpiece 894 is contained in an annular retaining ring 890 that has attached low-friction pins 892 that contact the outer perimeter of the workpiece 894 to restrain the workpiece 894 as it is subjected to abrading forces applied to the workpiece abraded surface 898. The retaining ring 890 is attached to the top flat surface 901 of a workpiece spindle 886 rotating spindle-top 888 that rotates about an axis 896. The workpiece 894 floats freely inside the retaining ring 890 as the workpiece 894 bottom surface 895 is contacted by the top surface 899 of a resilient workpiece support pad 900. The annular retaining ring 890 can also be used to contain the workpiece 894 without the use of the low-friction pins 892 that contact the outer perimeter of the workpiece 894.

Figure 44:
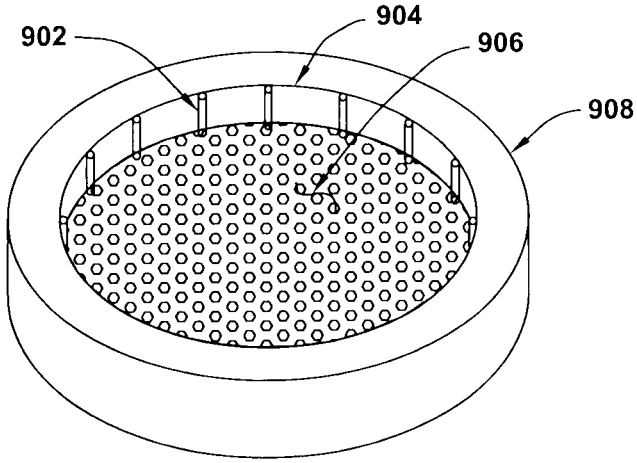
FIG. 44 is a isometric view of a workpiece restraining annular ring with a resilient pad.

FIG. 44 is a isometric view of a workpiece restraining annular ring with a resilient pad. An annular retaining ring 908 has attached low-friction pins 902 located at the retaining ring 908 inner perimeter 904 that contact the outer perimeter of the workpiece (not shown) to restrain the workpiece as it is subjected to abrading forces applied to the workpiece abraded surface. The workpiece floats freely inside the retaining ring 908 as the workpiece bottom surface is contacted by the top surface of a resilient workpiece support pad 906. The annular retaining ring 908 can also be used to contain or restrain the workpiece without the use of the low-friction pins 902.

Figure 45:
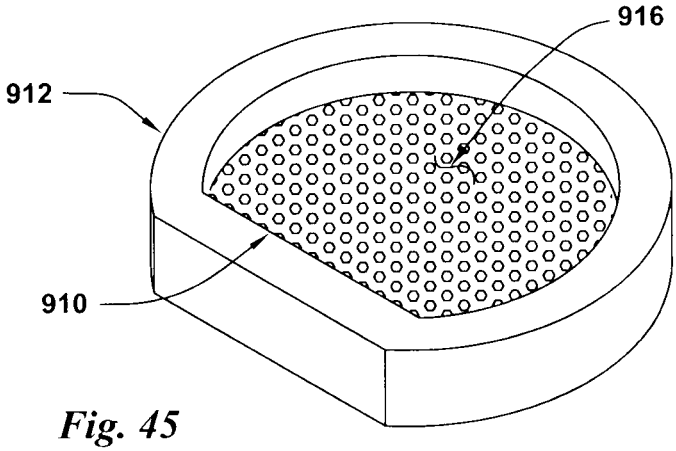
FIG. 45 is a isometric view of a flat-sided workpiece restraining ring with a resilient pad.

FIG. 45 is a isometric view of a flat-sided workpiece, such as a semiconductor wafer, restraining annular ring with a resilient pad. An annular retaining ring 912 has an inner flat-sided perimeter 910 that contacts the outer perimeter of a flat-sided workpiece, such as a semiconductor wafer, (not shown) to restrain the flat-sided workpiece as it is subjected to abrading forces applied to the workpiece abraded surface. The workpiece floats freely inside the retaining ring 912 as the workpiece bottom surface is contacted by the top surface of a resilient workpiece support pad 916.

Fixed-Spindle Floating-Platen Resilient Workpiece Pad Description

An at least three-point, fixed-spindle floating-platen abrading machine is described that has resilient workpiece support pads comprising:

a) at least three rotary workpiece spindles having rotatable flat-surfaced spindle-tops, each of the rotary spindle-tops having a respective rotary spindle-top axis of rotation at the center of a respective rotatable flat-surfaced rotary spindle-top for each respective rotary workpiece spindles;

b) wherein the respective axis of rotation for each of the at least three workpiece rotary spindle-tops' is perpendicular to respective rotary spindle-tops' flat surface;

c) an abrading machine base having a horizontal, nominally-flat top surface and a spindle-circle where the spindle-circle is coincident with the machine base nominally-flat top surface;

d) the at least three rotary workpiece spindles being located with near-equal spacing between the respective at least three rotary workpiece spindles where respective at least three rotary spindle-tops' axes of rotation intersect the machine base spindle-circle and where respective at least three rotary workpiece spindles are mechanically attached to the machine base top surface;

e) the at least three workpiece rotary spindle-tops' flat surfaces are configured to be adjustably alignable to be co-planar with each other;

f) a floating, rotatable abrading platen having a flat annular abrading surface where the platen is supported by and rotationally driven about a platen rotation axis located at a rotational center of the platen by a spherical-action rotation device located at a rotational center of the platen and the spherical-action rotation device restrains the platen in a radial direction relative to the platen axis of rotation and the platen axis of rotation is concentric with the machine base spindle-circle;

g) wherein the spherical-action rotation device causes spherical motion of the floating platen about the rotational center of the platen where the platen abrading surface is nominally horizontal;

h) flexible abrasive disk components having annular bands of abrasive coated flat surfaces and wherein a flexible abrasive disk is attached in flat conformal contact with the platen abrading surface wherein the attached abrasive disk is concentric with the platen abrading surface;

i) workpiece carriers having an impervious, compressible and resilient body having a thickness wherein the workpiece carrier's compressible and resilient body has a top flat surface and has a parallel opposed bottom flat surface wherein the workpiece carrier's body thickness is measured between the carrier top flat surface and the carrier bottom flat surface;

j) wherein the workpiece carrier's bottom flat surfaces are attached in full flat-surfaced contact with the flat surfaces of the respectable spindle-tops wherein the workpiece carrier's top flat surfaces are compressible relative to the workpiece carrier's opposed bottom flat surfaces and wherein the workpiece carrier's top flat surfaces are resilient relative to the workpiece carrier's opposed bottom flat surfaces;

k) wherein equal-thickness workpieces having parallel opposed top and bottom flat surfaces are attached with full flat-surfaced contact of the respective workpieces' bottom surfaces with the top flat surfaces of the respective workpiece carriers;

l) wherein the floating rotatable abrading platen is vertically moveable to allow the abrasive surface of the abrasive disk that is attached to the floating rotatable platen abrading surface to contact the full top surfaces of the respective workpieces wherein the respective workpiece carriers are compressed to provide uniform abrading pressure across the full top surfaces of the respective workpieces;

m) wherein the at least three spindle-tops having the attached workpieces can be rotated about respective spindles' axes and the floating rotatable abrasive platen can be rotated about the floating rotatable abrasive platen rotation axis where the flat abrasive surface of the abrasive disk attached to the platen is in force-controlled abrading pressure with the top surfaces of the respective workpieces to single-side abrade the top surfaces of the workpieces.

The abrading machine is described where the machine base comprises a structural material selected from the group consisting of granite, epoxy-granite, and metal and wherein the machine base structural material is either a non-porous solid or is a solid material that is temperature controlled by a temperature-controlled fluid that circulates in fluid passageways internal to the machine base structural materials.

Also, the at least three rotary workpiece spindles can be air bearing rotary workpiece spindles and each workpiece carrier's compressible and resilient body can be constructed from an open-celled polymer foam-type material wherein each workpiece carrier's compressible and resilient body has a flexible impervious coating or is constructed from a impervious closed-celled polymer foam-type material.

In addition, each workpiece carrier top flat surface has a flat-surface size and a flat-surface shape and the respective workpiece carrier opposed bottom flat surface has a flat-surface size and a flat-surface shape wherein the respective workpiece carriers' top flat-surface sizes and bottom flat-surface sizes are substantially equal and wherein the respective workpiece carriers' top flat-surface shapes and bottom flat-surface shapes are substantially similar and wherein each workpiece has a bottom flat-surface size and a bottom flat-surface shape wherein the respective workpiece carriers' top flat-surface sizes are substantially equal to the respective workpiece bottom flat-surface sizes and the respective workpiece carriers' top flat-surface shapes are substantially similar to the respective workpieces' bottom flat-surface shapes.

Also, the workpieces can be attached with full flat-surfaced contact of the respective workpieces' bottom surfaces with the top flat surfaces of the respective workpiece carriers coated with an adhesive coating selected from the group consisting of an adhesive coating, a low-tack adhesive coating and a water film coating that creates surface tension workpiece adhesive-type attachment forces.

Further, the machine is described where each workpiece carrier has a rigid workpiece mounting plate having parallel opposed top and bottom flat surfaces where the bottom surface of the rigid workpiece mounting plate is attached with full flat-surfaced contact with the top flat surface of the respective workpiece carrier and wherein equal-thickness workpieces are attached with full flat-surfaced contact of the respective workpieces' bottom surfaces with the top flat surfaces of the respective rigid workpiece mounting plates having an adhesive coating selected from the group consisting of an adhesive coating, a low-tack adhesive coating, a wear-resistant coating and a water film coating that creates surface tension workpiece adhesive-type attachment forces.

The rigid workpiece mounting plate has a flat-surface size and a flat-surface shape and the respective rigid workpiece mounting plate opposed bottom flat surface has a flat-surface size and a flat-surface shape wherein the respective rigid workpiece mounting plates' top flat-surface sizes and bottom flat-surface sizes are substantially equal and wherein the respective rigid workpiece mounting plates' top flat-surface shapes and bottom flat-surface shapes are substantially similar and wherein each workpiece has a bottom flat-surface size and a bottom flat-surface shape wherein the respective rigid workpiece mounting plates' top flat-surface sizes are substantially equal to the respective workpiece bottom flat-surface sizes and the respective rigid workpiece mounting plates' top flat-surface shapes are substantially similar to the respective workpieces' bottom flat-surface shapes.

Further, each rigid workpiece mounting plate can have internal fluid passageways that connect to a fluid valve located on the external surface of the workpiece mounting plate and connects to port holes that are located on the workpiece mounting plate top flat surface wherein vacuum can be applied at the fluid valve to the internal fluid passageways wherein workpieces are attached by vacuum with full flat-surfaced contact of the respective workpieces' bottom surfaces with the top flat surfaces of the respective workpiece mounting plate. Here, pressurized air can be applied at the fluid valve to the internal fluid passageways wherein workpieces are separated by pressurized air from full flat-surfaced contact of the respective workpieces' bottom surfaces with the top flat surfaces of the respective workpiece mounting plate.

In addition, the workpiece carrier compressible and resilient body can be constructed from a sealed air bag that is expanded to a selected workpiece carrier body thickness by filling the air bag with air and sealing the workpiece carrier air bag.

In another embodiment, the workpiece carrier's compressible and resilient body is a sealed pleated air bags comprising:

a) annular bands of flexible polymer or metal material that are joined together at the peripheral edges of the individual annular bands to form flexible pleated annular peripheral walls of the workpiece carrier's body;

b) circular disks of polymer or metal sheet material are provided to form the workpiece carrier's top flat surface and to form the workpiece carrier's bottom flat surface;

c) wherein the pleated annular peripheral wall of the workpiece carrier's body and the circular workpiece carrier's top flat surface and the workpiece carrier's bottom flat surface are joined together to form a sealed pleated workpiece carrier having a sealed interior;

d) wherein air is introduced into the interior of the sealed pleated workpiece carrier to inflate the workpiece carrier to provide a selected sealed pleated workpiece carrier thickness measured from the pleated workpiece carrier's top flat surface and to the pleated workpiece carrier's bottom flat surface;

e) wherein the pleated workpiece carrier is sealed after being filled with air to retain the air that resides in the pleated workpiece carriers'sealed interior when the pleated workpiece carrier's top flat surface is resiliently compressed relative to the pleated workpiece carrier's opposed bottom flat surface.

A process is described of providing an at least three-point, fixed-spindle floating-platen abrading machine having resilient workpiece support pads comprising:

a) providing at least three rotary workpiece spindles having rotatable flat-surfaced spindle-tops, each of the rotary spindle-tops having a respective rotary spindle-top axis of rotation at the center of a respective rotatable flat-surfaced rotary spindle-top for each respective rotary workpiece spindles;

b) providing that the respective axes of rotation for each of the at least three workpiece rotary spindle-tops' are perpendicular to respective rotary spindle-tops' flat surfaces;

c) providing an abrading machine base having a horizontal, nominally-flat top surface and a spindle-circle where the spindle-circle is coincident with the machine base nominally-flat top surface;

d) positioning the at least three rotary workpiece spindles in locations with near-equal spacing between the respective at least three of the rotary workpiece spindles where respective at least three workpiece rotary spindle-tops' axes of rotation intersect the machine base spindle-circle and where respective at least three rotary workpiece spindles are mechanically attached to the machine base top surface;

e) aligning the at least three workpiece spindles' rotary spindle-tops' flat surfaces so that they are co-planar with each other and locking the co-planar aligned at least three workpiece spindles in their co-planar aligned positions.

f) providing a floating, rotatable abrading platen having a flat annular abrading surface where the platen is supported by and rotationally driven about a platen rotation axis located at a rotational center of the platen by a spherical-action rotation device located at a rotational center of the platen and the spherical-action rotation device restrains the platen in a radial direction relative to the platen axis of rotation and the platen axis of rotation is concentric with the machine base spindle-circle;

g) providing the spherical-action rotation device causes spherical motion of the floating platen about the rotational center of the platen where the platen abrading surface is nominally horizontal;

h) providing flexible abrasive disk components having annular bands of abrasive coated flat surfaces and wherein a flexible abrasive disk is attached in flat conformal contact with the platen abrading surface wherein the attached abrasive disk is concentric with the platen abrading surface;

i) providing workpiece carriers having an impervious, compressible and resilient body having a thickness wherein the workpiece carrier's compressible and resilient body has a top flat surface and has a parallel opposed bottom flat surface wherein the workpiece carrier's body thickness is measured between the carrier top flat surface and the carrier bottom flat surface;

j) providing that the workpiece carrier's bottom flat surfaces are attached in full flat-surfaced contact with the flat surfaces of the respectable spindle-tops wherein the workpiece carrier's top flat surfaces are compressible relative to the workpiece carrier's opposed bottom flat surfaces and wherein the workpiece carrier's top flat surfaces are resilient relative to the workpiece carrier's opposed bottom flat surfaces;

k) providing equal-thickness workpieces having parallel opposed top and bottom flat surfaces are attached with full flat-surfaced contact of the respective workpieces' bottom surfaces with the top flat surfaces of the respective workpiece carriers;

l) moving the floating rotatable abrading platen vertically to allow the abrasive surface of the abrasive disk that is attached to the floating rotatable platen abrading surface to contact the full top surfaces of the respective workpieces wherein the respective workpiece carriers are compressed to provide uniform abrading pressure across the full top surfaces of the respective workpieces;

m) rotating the at least three spindle-tops having the attached workpieces about respective spindles' axes and rotating the floating rotatable abrasive platen about the floating rotatable abrasive platen rotation axis where the flat abrasive surface of the abrasive disk attached to the platen is in force-controlled abrading pressure with the top surfaces of the respective workpieces to single-side abrade the top surfaces of the workpieces.

In the process described, the at least three rotary workpiece spindles can be air bearing rotary workpiece spindles and each workpiece carrier's compressible and resilient body can be constructed from an open-celled polymer foam-type material wherein each workpiece carrier's compressible and resilient body has a flexible impervious coating or is constructed from a impervious closed-celled polymer foam-type material.

Further, in this process, each workpiece carrier top flat surface has a flat-surface size and a flat-surface shape and the respective workpiece carrier opposed bottom flat surface has a flat-surface size and a flat-surface shape wherein the respective workpiece carriers' top flat-surface sizes and bottom flat-surface sizes are substantially equal and wherein the respective workpiece carriers' top flat-surface shapes and bottom flat-surface shapes are substantially similar and wherein each workpiece has a bottom flat-surface size and a bottom flat-surface shape wherein the respective workpiece carriers' top flat-surface sizes are substantially equal to the respective workpiece bottom flat-surface sizes and the respective workpiece carriers' top flat-surface shapes are substantially similar to the respective workpieces' bottom flat-surface shapes.

In the described process, workpieces can be attached with full flat-surfaced contact of the respective workpieces' bottom surfaces with the top flat surfaces of the respective workpiece carriers coated with an adhesive coating selected from the group consisting of an adhesive coating, a low-tack adhesive coating and a water film coating that creates surface tension workpiece adhesive-type attachment forces.

Also, in the process, each workpiece carrier has a rigid workpiece mounting plate having parallel opposed top and bottom flat surfaces where the bottom surface of the workpiece mounting plate is attached with full flat-surfaced contact of the respective workpiece mounting plate bottom surface with the top flat surface of the respective workpiece carrier and wherein equal-thickness workpieces are attached with full flat-surfaced contact of the respective workpieces' bottom surfaces with the top flat surfaces of the respective workpiece mounting plate having an adhesive coating selected from the group consisting of an adhesive coating, a low-tack adhesive coating, wear-resistant coating and a water film coating that creates surface tension workpiece adhesive-type attachment forces.

In this process, each workpiece carrier workpiece mounting plate has a flat-surface size and a flat-surface shape and the respective rigid workpiece mounting plate opposed bottom flat surface has a flat-surface size and a flat-surface shape wherein the respective rigid workpiece mounting plates' top flat-surface sizes and bottom flat-surface sizes are substantially equal and wherein the respective rigid workpiece mounting plates' top flat-surface shapes and bottom flat-surface shapes are substantially similar and wherein each workpiece has a bottom flat-surface size and a bottom flat-surface shape wherein the respective rigid workpiece mounting plates' top flat-surface sizes are substantially equal to the respective workpiece bottom flat-surface sizes and the respective rigid workpiece mounting plates' top flat-surface shapes are substantially similar to the respective workpieces' bottom flat-surface shapes.

And, in this process, each rigid workpiece mounting plate can have internal fluid passageways that connect to a fluid valve located on the external surface of the workpiece mounting plate and connect to port holes that are located on the workpiece mounting plate top flat surface wherein vacuum can be applied at the fluid valve to the internal fluid passageways wherein workpieces are attached by vacuum with full flat-surfaced contact of the respective workpieces' bottom surfaces with the top flat surfaces of the respective workpiece mounting plate and wherein pressurized air is applied at the fluid valve to the internal fluid passageways wherein workpieces are separated by pressurized air from full flat-surfaced contact of the respective workpieces' bottom surfaces with the top flat surfaces of the respective workpiece mounting plate.

What is claimed:

1. An at least three-point, fixed-spindle floating-platen abrading machine having resilient workpiece support pads comprising:

a) at least three rotary workpiece spindles having rotatable flat-surfaced spindle-tops, each of the rotary flat-surfaced spindle-tops having a respective rotary spindle-top axis of rotation at a center of a respective rotatable flat-surfaced rotary spindle-top for each respective rotary workpiece spindles;

b) the respective axis of rotation for each of the at least three workpiece rotary spindle-tops' is perpendicular to the respective rotary spindle-tops' flat surface;

c) an abrading machine base having a horizontal, nominally-flat top surface and a spindle-circle where the spindle-circle is coincident with the machine base nominally-flat top surface;

d) the at least three rotary workpiece spindles are located with near-equal spacing between the respective at least three rotary workpiece spindles and the respective at least three rotary spindle-tops' axes of rotation intersect the machine base spindle-circle and the respective at least three rotary workpiece spindles are mechanically attached to the machine base top surface;

e) the at least three workpiece rotary spindle-tops' flat surfaces are configured to be adjustably alignable to be co-planar with each other;

f) a floating, rotatable abrading platen having a flat annular abrading surface where the platen is supported by and rotationally driven about a platen rotation axis located at a rotational center of the platen by a spherical-action rotation device located at a rotational center of the platen, and the spherical-action rotation device restrains the platen in a radial direction relative to the platen axis of rotation, and the platen axis of rotation is concentric with the machine base spindle-circle;

g) the spherical-action rotation device is configured to cause spherical motion of the floating, rotatable platen about the rotational center of the floating, rotatable platen where the floating, rotatable platen abrading surface is nominally horizontal;

h) flexible abrasive disk components having annular bands of abrasive-coated flat surfaces and each flexible abrasive disk component is attached in flat conformal contact with a respective floating, rotatable platen abrading surface wherein the attached abrasive disk is concentric with the floating, rotatable platen abrading surface;

i) workpiece carriers having an impervious, compressible and resilient body having a thickness wherein each workpiece carrier's compressible and resilient body has a top flat surface and a parallel opposed bottom flat surface, wherein each workpiece carrier's body has a thickness between the carrier top flat surface and the carrier bottom flat surface;

j) wherein the workpiece carrier's bottom flat surfaces are attached in full flat-surfaced contact with the flat surfaces of the respectable spindle-tops wherein the workpiece carrier's top flat surfaces are compressible relative to the workpiece carrier's opposed bottom flat surfaces and wherein the workpiece carrier's top flat surfaces are resilient relative to the workpiece carrier's opposed bottom flat surfaces;

k) equal-thickness workpieces having parallel opposed top and bottom flat surfaces are attached with full flat-surfaced contact of the respective workpieces' bottom surfaces with the top flat surfaces of the respective workpiece carriers;

l) the floating rotatable abrading platen is vertically moveable to allow the abrasive surface of the abrasive disk that is attached to the floating rotatable platen abrading surface to contact the full top surfaces of the respective workpieces, wherein the respective workpiece carriers are compressed to provide uniform abrading pressure across the full top surfaces of the respective workpieces;

m) the at least three spindle-tops having attached workpieces are configured to be rotated about the respective spindle-tops' rotation axes, and the rotatable floating abrading platen having the attached flexible abrasive disk is configured to be rotated about the rotatable floating abrading platen cylindrical-rotation axis to single-side abrade the workpieces that are attached to the flat surfaces of the at least three spindle-tops while the moving abrasive surface of the flexible abrasive disk that is attached to the moving rotatable floating abrading platen flat annular abrading surface is in force-controlled abrading contact with the top surfaces of the workpieces that are attached to the respective at least three spindle-tops.

2. The apparatus of claim 1 wherein the machine base comprises a structural material selected from the group consisting of granite, epoxy-granite, and metal and wherein the machine base structural material is either a non-porous solid or is a solid material that is temperature controlled by a temperature-controlled fluid that circulates in fluid passageways internal to the machine base structural materials.

3. The apparatus of claim 1 wherein the at least three rotary workpiece spindles are air bearing rotary workpiece spindles.

4. The apparatus of claim 1 wherein each workpiece carrier's compressible and resilient body is constructed from an open-celled polymer foam material wherein each workpiece carrier's compressible and resilient body has a flexible impervious coating or is constructed from a impervious closed-celled polymer foam material.

5. The apparatus of claim 1 wherein each workpiece carrier top flat surface has a flat-surface size and a flat-surface shape and the respective workpiece carrier opposed bottom flat surface has a flat-surface size and a flat-surface shape, wherein the respective workpiece carriers' top flat-surface sizes and bottom flat-surface sizes are substantially equal and the respective workpiece carriers' top flat-surface shapes and bottom flat-surface shapes are substantially similar and each workpiece has a bottom flat-surface size and a bottom flat-surface shape, wherein the respective workpiece carriers' top flat-surface sizes are substantially equal to the respective workpiece bottom flat-surface sizes and the respective workpiece carriers' top flat-surface shapes are substantially similar to the shapes of the respective workpieces' bottom flat-surface.

6. The apparatus of claim 1 wherein workpieces are attached with full flat-surfaced contact of the respective workpieces' bottom surfaces with the top flat surfaces of the respective workpiece carriers coated with an adhesive coating selected from the group consisting of an adhesive coating, a low-tack adhesive coating and a water film coating that creates surface tension workpiece adhesive-type attachment forces.

7. The apparatus of claim 1 wherein each workpiece carrier has a rigid workpiece mounting plate having parallel opposed top and bottom flat surfaces wherein the bottom flat surface of the rigid workpiece mounting plate is attached with full flat-surfaced contact with the top flat surface of the respective workpiece carrier and wherein equal-thickness workpieces are attached with full flat-surfaced contact of the respective workpieces' bottom surfaces with the top flat surfaces of the respective rigid workpiece mounting plates having an adhesive coating selected from the group consisting of an adhesive coating, a low-tack adhesive coating, a wear-resistant coating and a water film coating that creates surface tension workpiece adhesive-type attachment forces.

8. The apparatus of claim 7 wherein each rigid workpiece mounting plate has a flat-surface size and a flat-surface shape and the respective rigid workpiece mounting plate opposed bottom flat surface has a flat-surface size and a flat-surface shape, wherein the respective rigid workpiece mounting plates' top flat-surface sizes and bottom flat-surface sizes are substantially equal and wherein the respective rigid workpiece mounting plates' top flat-surface shapes and bottom flat-surface shapes are substantially similar and each workpiece has a bottom flat-surface size and a bottom flat-surface shape, wherein the respective rigid workpiece mounting plates' top flat-surface sizes are substantially equal to the respective workpiece bottom flat-surface sizes and the respective rigid workpiece mounting plates' top flat-surface shapes are substantially similar to the shapes of the respective workpieces' bottom flat-surface.

9. The apparatus of claim 7 wherein each rigid workpiece mounting plate has internal fluid passageways that connect to a fluid valve located on the external surface of the workpiece mounting plate and connect to port holes that are located on the workpiece mounting plate top flat surface and wherein vacuum is applied at the fluid valve to the internal fluid passageways, wherein workpieces are attached by vacuum with full flat-surfaced contact of the respective workpieces' bottom surfaces with the top flat surfaces of the respective workpiece mounting plate.

10. The apparatus of claim 8 wherein each rigid workpiece mounting plate has internal fluid passageways that connect to a fluid valve located on the external surface of the workpiece mounting plate and wherein the internal fluid passageways connect to port holes that are located on the workpiece mounting plate top flat surface and wherein pressurized air is applied at the fluid valve to the internal fluid passageways, wherein workpieces are separated by pressurized air from full flat-surfaced contact of the respective workpieces' bottom surfaces with the top flat surfaces of the respective workpiece mounting plate.

11. The apparatus of claim 1 wherein the workpiece carrier's compressible and resilient body comprises a sealed air bag that expanded to a selected workpiece carrier body thickness by air and a seal securing the air in the workpiece carrier air bag.

12. The apparatus of claim 1 wherein the workpiece carrier's compressible and resilient body is a sealed pleated air bags comprising:

a) annular bands of flexible polymer or metal material that are joined together at the peripheral edges of the individual annular bands to form flexible pleated annular peripheral walls of the workpiece carrier's body;

b) circular disks of polymer or metal sheet material forming the workpiece carrier's top flat surface and the workpiece carrier's bottom flat surface;

c) wherein the pleated annular peripheral wall of the workpiece carrier's body and the circular workpiece carrier's top flat surface and the workpiece carrier's bottom flat surface are joined together to form a sealed pleated workpiece carrier having a sealed interior;

d) wherein air introduced into the interior of the sealed pleated workpiece carrier inflates the workpiece carrier to provide a selected sealed pleated workpiece carrier thickness from the pleated workpiece carrier's top flat surface and to the pleated workpiece carrier's bottom flat surface;

e) wherein the pleated workpiece carrier has been sealed after being filled with air to retain the air that resides in the pleated workpiece carriers'sealed interior when the pleated workpiece carrier's top flat surface is resiliently compressed relative to the pleated workpiece carrier's opposed bottom flat surface.

13. A process of providing an at least three-point, fixed-spindle floating-platen abrading machine having resilient workpiece support pads comprising:

a) providing the machine having at least three rotary workpiece spindles having rotatable flat-surfaced spindle-tops, each of the rotary spindle-tops having a respective rotary spindle-top axis of rotation at the center of a respective rotatable flat-surfaced rotary spindle-top for each respective rotary workpiece spindles;

b) providing the respective axes of rotation for each of the at least three workpiece rotary spindle-tops' as perpendicular to respective rotary spindle-tops' flat surfaces;

c) providing the abrading machine base having a horizontal, nominally-flat top surface and a spindle-circle wherein the spindle-circle is coincident with the machine base nominally-flat top surface;

d) positioning the at least three rotary workpiece spindles in locations with near-equal spacing between the respective at least three of the rotary workpiece spindles wherein the respective at least three workpiece rotary spindle-tops' axes of rotation intersect the machine base spindle-circle and wherein the respective at least three rotary workpiece spindles are mechanically attached to the machine base top surface;

e) aligning the at least three workpiece spindles' rotary spindle-tops' flat surfaces to be co-planar with each other and locking the co-planar aligned at least three workpiece spindles in their co-planar aligned positions;

f) providing a floating, rotatable abrading platen having a flat annular abrading surface with the platen supported by and rotationally driven about a platen rotation axis located at a rotational center of the platen by a spherical-action rotation device located at a rotational center of the platen, the spherical-action rotation device restraining the platen in a radial direction relative to the platen axis of rotation and the platen axis of rotation is concentric with the machine base spindle-circle;

g) the spherical-action rotation device is configured to cause spherical motion of the floating, rotatable platen about the rotational center of the floating, rotatable platen where the floating, rotatable platen abrading surface is nominally horizontal;

h) providing flexible abrasive disk components having annular bands of abrasive coated flat surfaces wherein a flexible abrasive disk is attached in flat conformal contact with the platen abrading surface, the attached abrasive disk being concentric with the platen abrading surface;

i) providing workpiece carriers having an impervious, compressible and resilient body having a thickness wherein the workpiece carrier's compressible and resilient body has a top flat surface and a parallel opposed bottom flat surface, wherein the workpiece carrier's body thickness is between the carrier top flat surface and the carrier bottom flat surface;

j) providing the workpiece carrier's bottom flat surfaces attached in full flat-surfaced contact with the flat surfaces of the respectable spindle-tops, wherein the workpiece carrier's top flat surfaces are compressible relative to the workpiece carrier's opposed bottom flat surfaces and the workpiece carrier's top flat surfaces are resilient relative to the workpiece carrier's opposed bottom flat surfaces;

k) providing equal-thickness workpieces having parallel opposed top and bottom flat surfaces attached with full flat-surfaced contact of the respective workpieces' bottom surfaces with the top flat surfaces of the respective workpiece carriers;

l) moving the floating rotatable abrading platen vertically to allow the abrasive surface of the abrasive disk that is attached to the floating rotatable platen abrading surface to contact the full top surfaces of the respective workpieces, wherein the respective workpiece carriers are compressed to provide uniform abrading pressure across the full top surfaces of the respective workpieces;

m) rotating the at least three spindle-tops having attached workpieces about the respective spindle-tops' rotation axes, and rotating floating abrading platen having the attached flexible abrasive disk about the rotatable floating abrading platen cylindrical-rotation axis to single-side abrade the workpieces that are attached to the flat surfaces of the at least three spindle-tops while the moving abrasive surface of the flexible abrasive disk that is attached to the moving rotatable floating abrading platen flat annular abrading surface is in force-controlled abrading contact with the top surfaces of the workpieces that are attached to the respective at least three spindle-tops.

14. The process of claim 13 wherein the at least three rotary workpiece spindles are air bearing rotary workpiece spindles.

15. The process of claim 13 wherein each workpiece carrier's compressible and resilient body is constructed from an open-celled polymer foam material wherein each workpiece carrier's compressible and resilient body has a flexible impervious coating or is constructed from an impervious closed-celled polymer foam material.

16. The process of claim 13 wherein each workpiece carrier top flat surface has a flat-surface size and a flat-surface shape and the respective workpiece carrier opposed bottom flat surface has a flat-surface size and a flat-surface shape wherein the respective workpiece carriers' top flat-surface sizes and bottom flat-surface sizes are substantially equal and wherein the respective workpiece carriers' top flat-surface shapes and bottom flat-surface shapes are substantially similar and wherein each workpiece has a bottom flat-surface size and a bottom flat-surface shape, the respective workpiece carriers' top flat-surface sizes are substantially equal to the respective workpiece bottom flat-surface sizes and the respective workpiece carriers' top flat-surface shapes are substantially similar to the shapes of the respective workpieces' bottom flat-surface.

17. The process of claim 13 wherein workpieces are attached with full flat-surfaced contact of the respective workpieces' bottom surfaces with the top flat surfaces of the respective workpiece carriers coated with an adhesive coating selected from the group consisting of an adhesive coating, a low-tack adhesive coating and a water film coating that creates surface tension workpiece adhesive-type attachment forces.

18. The process of claim 13 wherein each workpiece carrier has a rigid workpiece mounting plate having parallel opposed top and bottom flat surfaces where the bottom surface of the workpiece mounting plate is attached with full flat-surfaced contact of the respective workpiece mounting plate bottom surface with the top flat surface of the respective workpiece carrier and wherein equal-thickness workpieces are attached with full flat-surfaced contact of the respective workpieces' bottom surfaces with the top flat surfaces of the respective workpiece mounting plate having an adhesive coating selected from the group consisting of an adhesive coating, a low-tack adhesive coating, wear-resistant coating and a water film coating that creates surface tension workpiece adhesive-type attachment forces.

19. The process of claim 18 wherein each rigid workpiece mounting plate has a flat-surface size and a flat-surface shape and the respective rigid workpiece mounting plate opposed bottom flat surface has a flat-surface size and a flat-surface shape, wherein the respective rigid workpiece mounting plates' top flat-surface sizes and bottom flat-surface sizes are substantially equal and wherein the respective rigid workpiece mounting plates' top flat-surface shapes and bottom flat-surface shapes are substantially similar and wherein each workpiece has a bottom flat-surface size and a bottom flat-surface shape wherein the respective rigid workpiece mounting plates' top flat-surface sizes are substantially equal to the respective workpiece bottom flat-surface sizes and the respective rigid workpiece mounting plates' top flat-surface shapes are substantially similar to the shape of the respective workpieces' bottom flat-surface.

20. The process of claim 18 wherein each rigid workpiece mounting plate has internal fluid passageways that connect to a fluid valve located on the external surface of the workpiece mounting plate and wherein the internal fluid passageways connect to port holes that are located on the workpiece mounting plate top flat surface and wherein vacuum is applied at the fluid valve to the internal fluid passageways, wherein workpieces are attached by vacuum with full flat-surfaced contact of the respective workpieces' bottom surfaces with the top flat surfaces of the respective workpiece mounting plate, and wherein pressurized air is applied at the fluid valve to the internal fluid passageways wherein workpieces are separated by pressurized air from full flat-surfaced contact of the respective workpieces' bottom surfaces with the top flat surfaces of the respective workpiece mounting plate.

* * * * *